US012799405B2

(12) United States Patent
McFarland

(10) Patent No.: US 12,799,405 B2
(45) Date of Patent: Nov. 17, 2026

(54) CHEMICAL REACTION AND CONVERSION IN THERMALLY HETEROGENEOUS AND NON-STEADY-STATE CHEMICAL REACTORS

(71) Applicant: The Regents of the University of California, Oakland, CA (US)

(72) Inventor: Eric W. McFarland, Santa Barbara, CA (US)

(73) Assignee: THE REGENTS OF THE UNIVERSITY OF CALIFORNIA, Oakland, CA (US)

( * ) Notice: Subject to any disclaimer, the term of this patent is extended or adjusted under 35 U.S.C. 154(b) by 576 days.

(21) Appl. No.: 18/041,733

(22) PCT Filed: Aug. 19, 2021

(86) PCT No.: PCT/US2021/046627
§ 371 (c)(1),
(2) Date: Feb. 15, 2023

(87) PCT Pub. No.: WO2022/040389
PCT Pub. Date: Feb. 24, 2022

(65) Prior Publication Data

US 2023/0340336 A1 Oct. 26, 2023

Related U.S. Application Data

(60) Provisional application No. 63/106,031, filed on Oct. 27, 2020, provisional application No. 63/067,569, filed on Aug. 19, 2020.

(51) Int. Cl.
*C10G 9/20* (2006.01)
*C10G 9/40* (2006.01)

(52) U.S. Cl.
CPC ..... *C10G 9/203* (2013.01); *C10G 9/206* (2013.01); *C10G 9/40* (2013.01); *C10G 2300/4006* (2013.01); *C10G 2300/4012* (2013.01)

(58) Field of Classification Search
None
See application file for complete search history.

(56) References Cited

U.S. PATENT DOCUMENTS 3,357,852 A 12/1967 Gunther
3,451,783 A * 6/1969 Collins ..... C01B 3/047 422/111

(Continued)

FOREIGN PATENT DOCUMENTS

DE 102013112205 * 5/2014
EA 035730 * 7/2020

(Continued)

OTHER PUBLICATIONS

PCT International Search Report and Written Opinion dated Jan. 5, 2022 for PCT Application No. PCT/US2021/046627.

*Primary Examiner* — Sheng H Davis
(74) *Attorney, Agent, or Firm* — GATES & COOPER LLP

(57) ABSTRACT

A process for performing high temperature reactions includes introducing reactants into a reactor vessel, generating a high temperature within the reactor vessel, exposing a first portion of the reactants to the high temperature, and reacting the first portion of the reactants based on contact with the high temperature to produce one or more products. The high temperature is higher than a lower temperature of a wall of the reactor vessel, and a temperature gradient is generated between the high temperature and the lower temperature of the wall. A second portion of the reactants are (Continued)

not exposed to the high temperature, and the second portion of the reactants do not react.

19 Claims, 39 Drawing Sheets

(56) References Cited

U.S. PATENT DOCUMENTS

| | | | | |
|---|---|---|---|---|
| 4,271,007 | A | 6/1981 | Souhrada et al. | |
| 2006/0130763 | A1 | 6/2006 | Emerson et al. | |
| 2009/0260288 | A1* | 10/2009 | de Graffenried, Sr. | C10J 3/26 48/197 FM |
| 2011/0002839 | A1 | 1/2011 | Jones | |
| 2011/0009681 | A1 | 1/2011 | Hershkowitz et al. | |
| 2012/0111271 | A1 | 5/2012 | Begarney et al. | |
| 2013/0153399 | A1 | 6/2013 | McAlister | |
| 2013/0213228 | A1* | 8/2013 | Ikeda | B01D 53/22 95/55 |
| 2013/0309592 | A1 | 11/2013 | Datta et al. | |
| 2014/0041485 | A1 | 2/2014 | Short | |
| 2016/0130698 | A1 | 5/2016 | Alcott | |

FOREIGN PATENT DOCUMENTS

| | | | | | |
|---|---|---|---|---|---|
| EP | 0615949 | | * | 3/1994 | |
| EP | 0615949 | A2 | * | 9/1994 | C01B 3/323 |
| EP | 2085354 | | * | 3/2007 | |
| EP | 2085354 | A1 | * | 8/2009 | B01J 8/0465 |
| JP | 2003243018 | | * | 8/2003 | |
| JP | 2018043913 | | * | 3/2018 | |
| JP | 2019156656 | | * | 9/2019 | |
| KR | 1020200086352 | A | | 7/2020 | |
| MY | 158081 | | * | 8/2016 | |
| MY | 158081 | A | * | 8/2016 | |
| WO | WO9921940 | | * | 5/1999 | |
| WO | 2014200601 | A2 | | 12/2014 | |

* cited by examiner

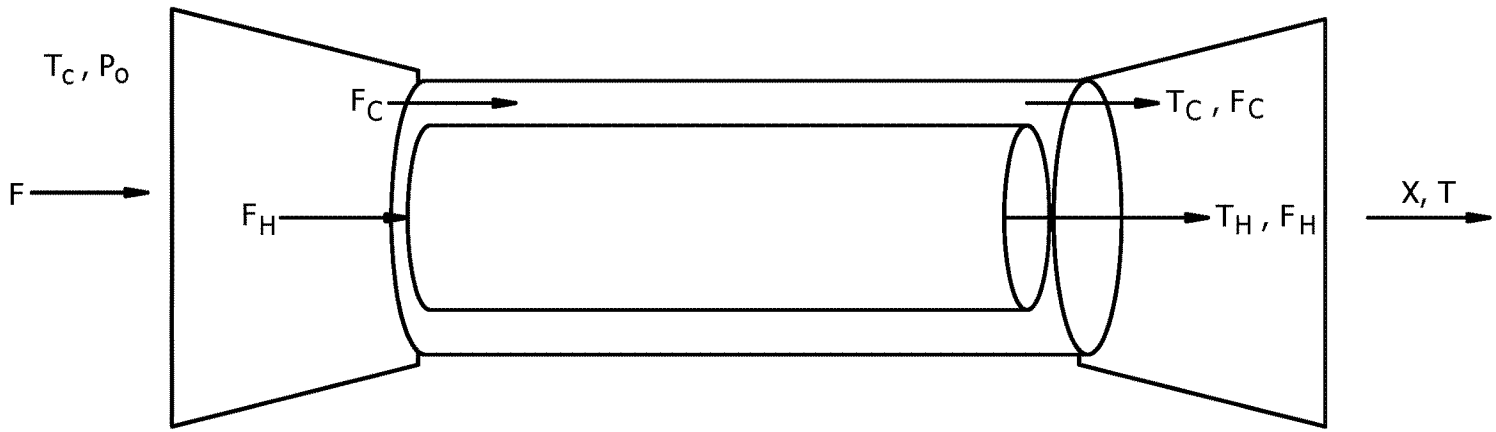

$$X = \frac{X_H * F_H + X_C * F_C}{F} = X_H * \frac{F_H}{F} + X_C * \left(1 - \frac{F_H}{F}\right)$$

$$T = \frac{T_H \frac{F_H}{F}\left((1-X_H) + \varepsilon X_H \frac{c_{pB}}{c_{pA}}\right) + T_C\left(1-\frac{F_H}{F}\right)\left((1-X_C) + \varepsilon X_C \frac{c_{pB}}{c_{pA}}\right)}{\left((1-X) + X\varepsilon \frac{c_{pB}}{c_{pA}}\right)} \xrightarrow{\frac{c_{pB}}{c_{pA}}=1,} T = \frac{T_H \frac{F_H}{F}(1-X_H(1-\varepsilon)) + T_C\left(1-\frac{F_H}{F}\right)(1-X_C(1-\varepsilon))}{(1-X(1-\varepsilon))}$$

$$\xrightarrow{X_H=1,\, X_C=0} X = \frac{F_H}{F}$$

$$\xrightarrow{X_H=1,\, X_C=0} T = T_H X + T_C (1-X)$$

*FIG. 3*

Ejected surface species ~ $\Phi_{surface} * P_{srxn} * \Delta H_{srxn} = \frac{P}{\sqrt{2\pi MWRT}} P_{srxn} * \Delta H_{srxn}$ Convection ~ $h_s (T_s - T)$ Radiation ~ $\varepsilon_s \sigma T_s^4 \xi_s \left(1 - \left(\frac{T}{T_s}\right)^4\right)$

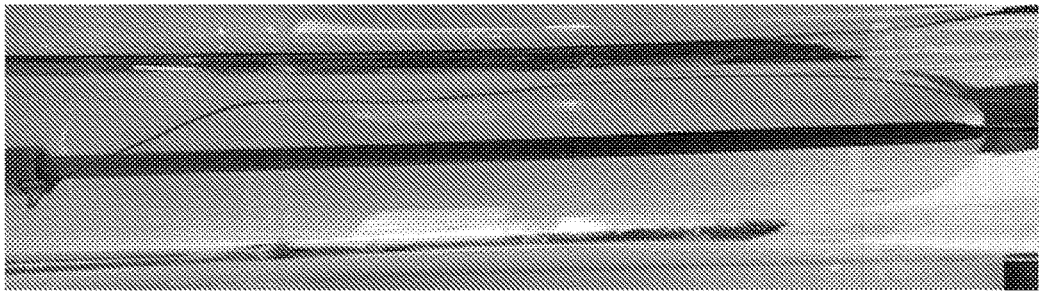
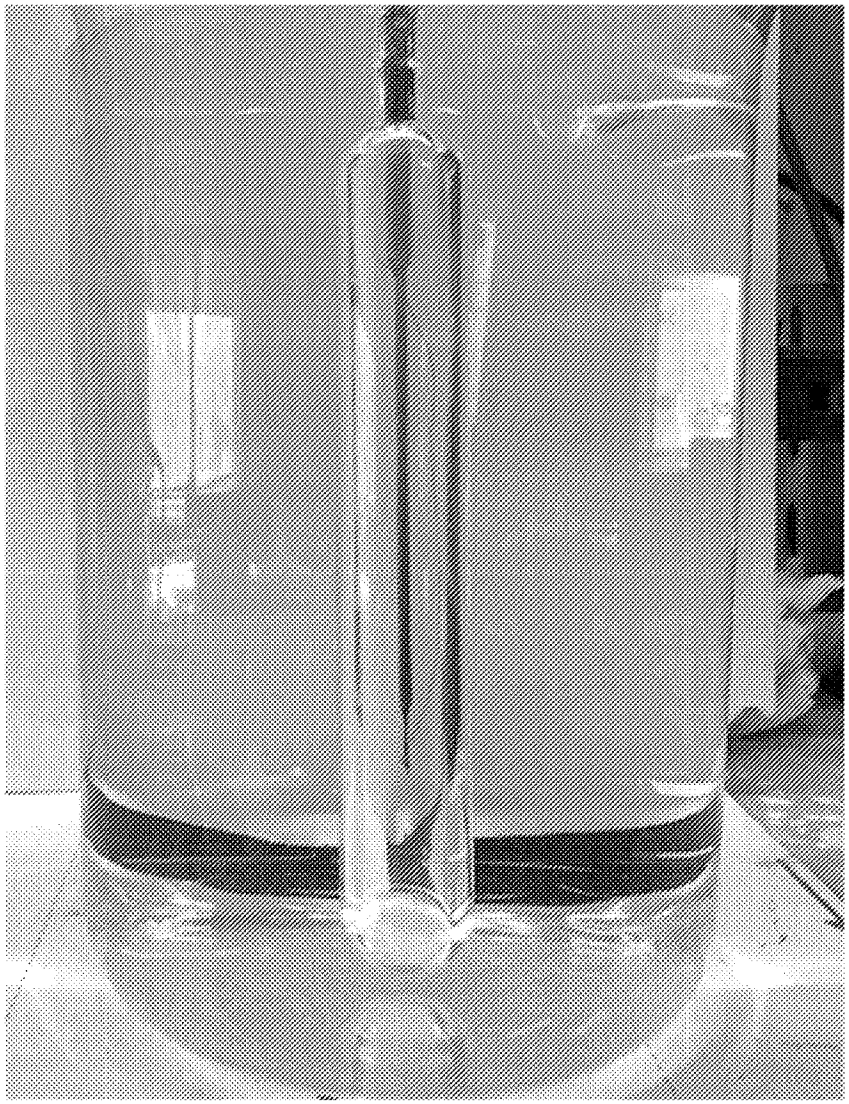
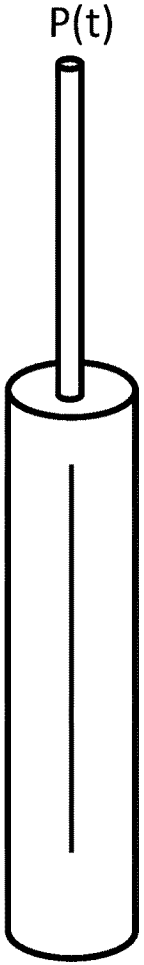
Figure 28

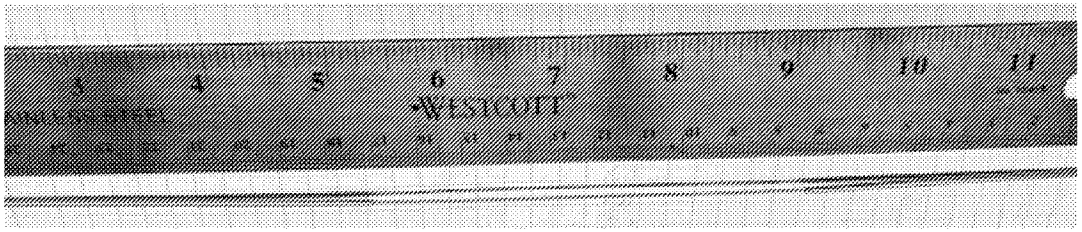
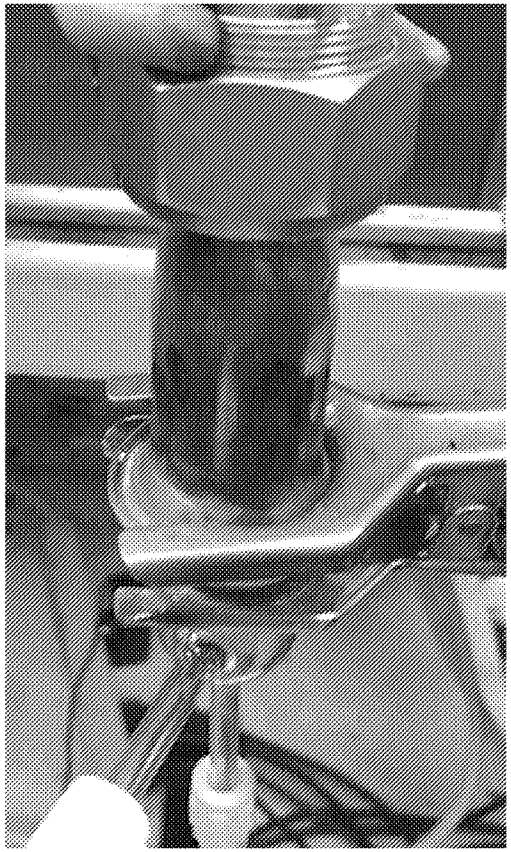
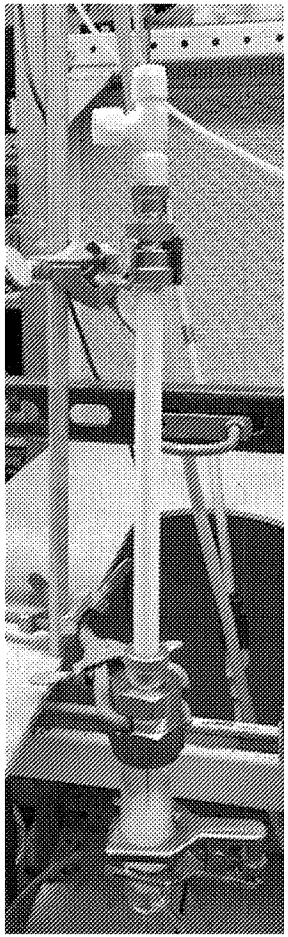
Figure 33

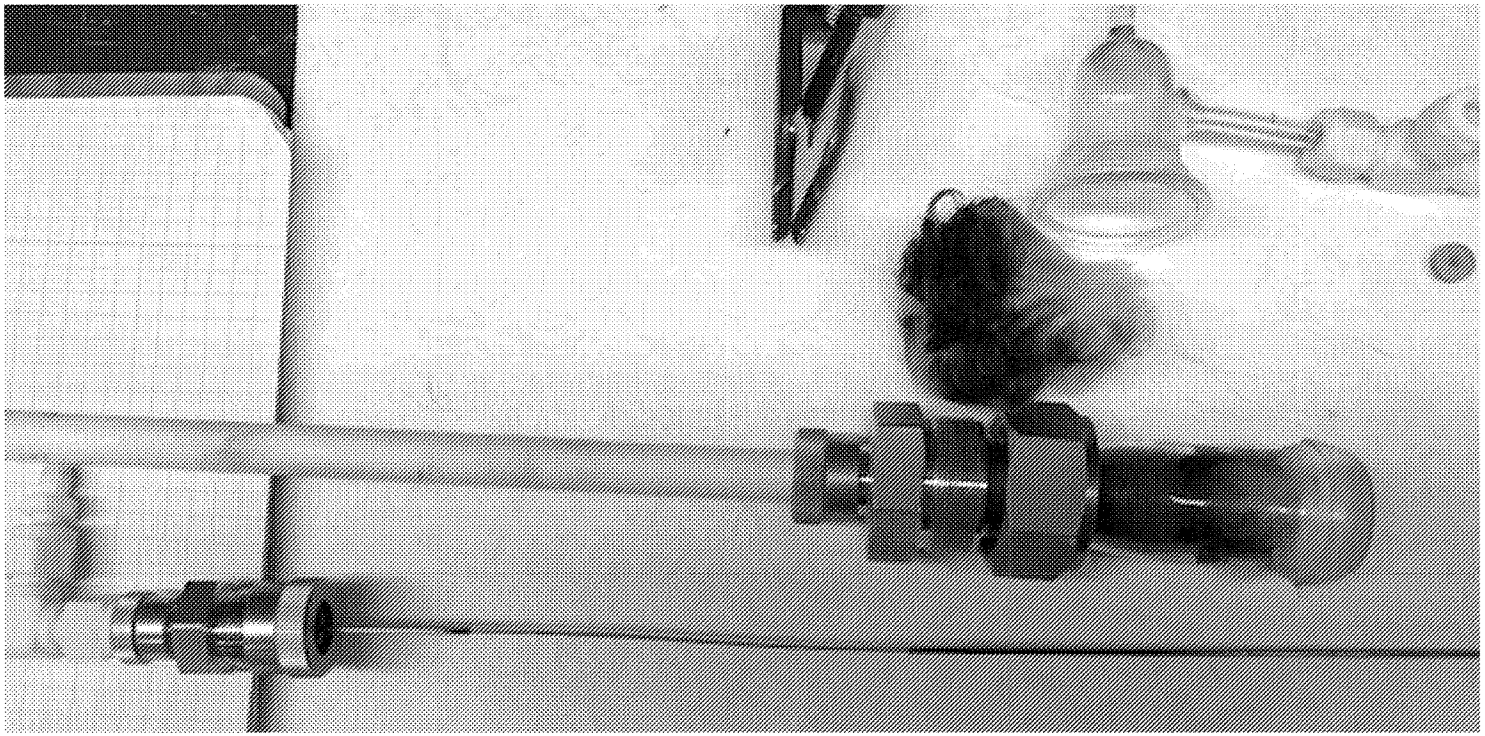
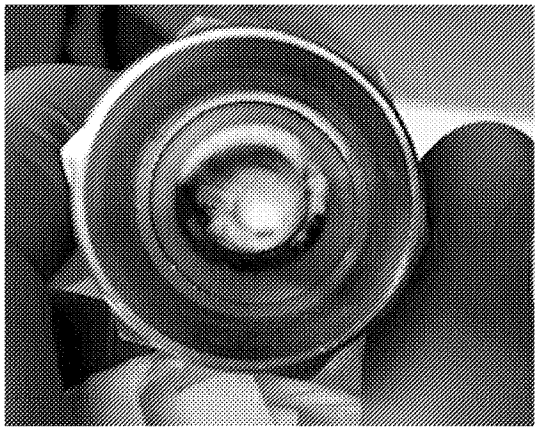
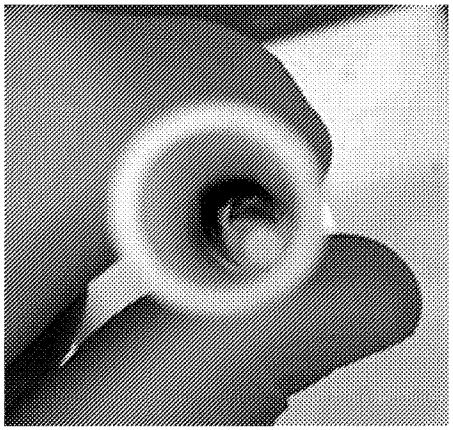
Figure 35

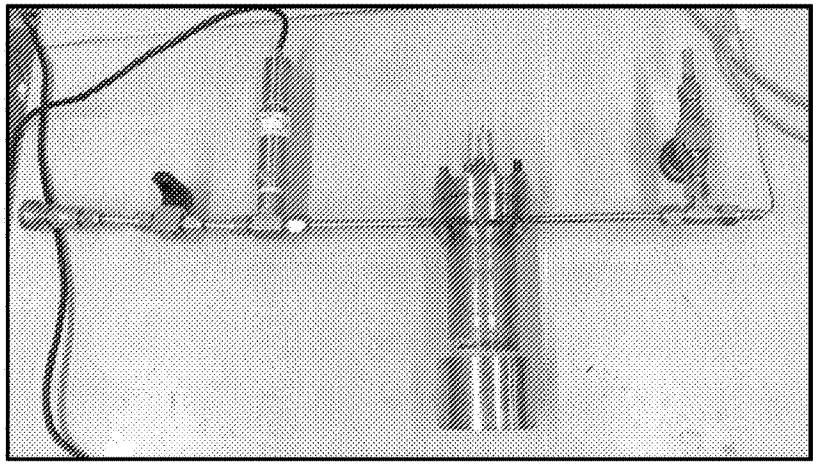
High Pressure Batch Reactor (3.81cm ID, 16cm length, V=182 ml)
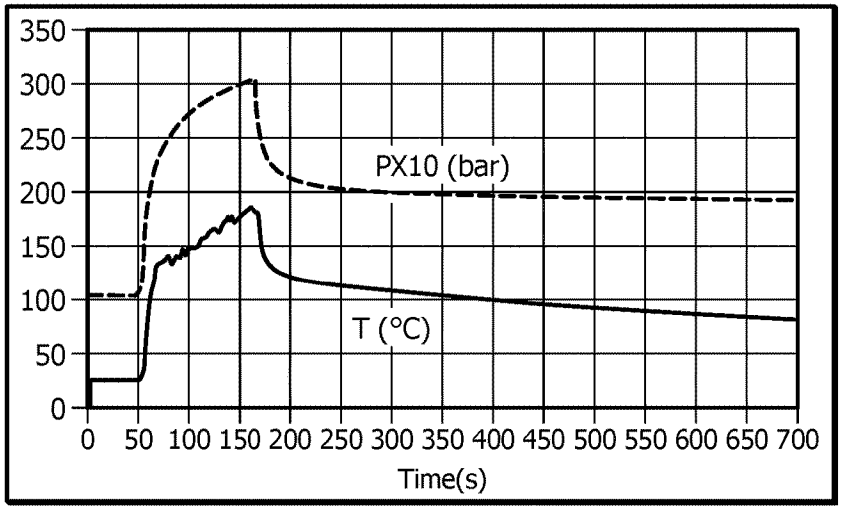
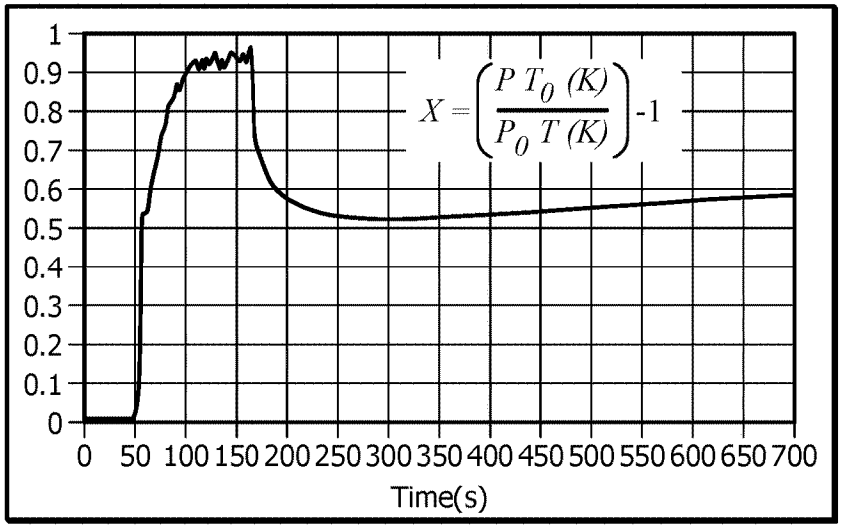
*FIG. 36*

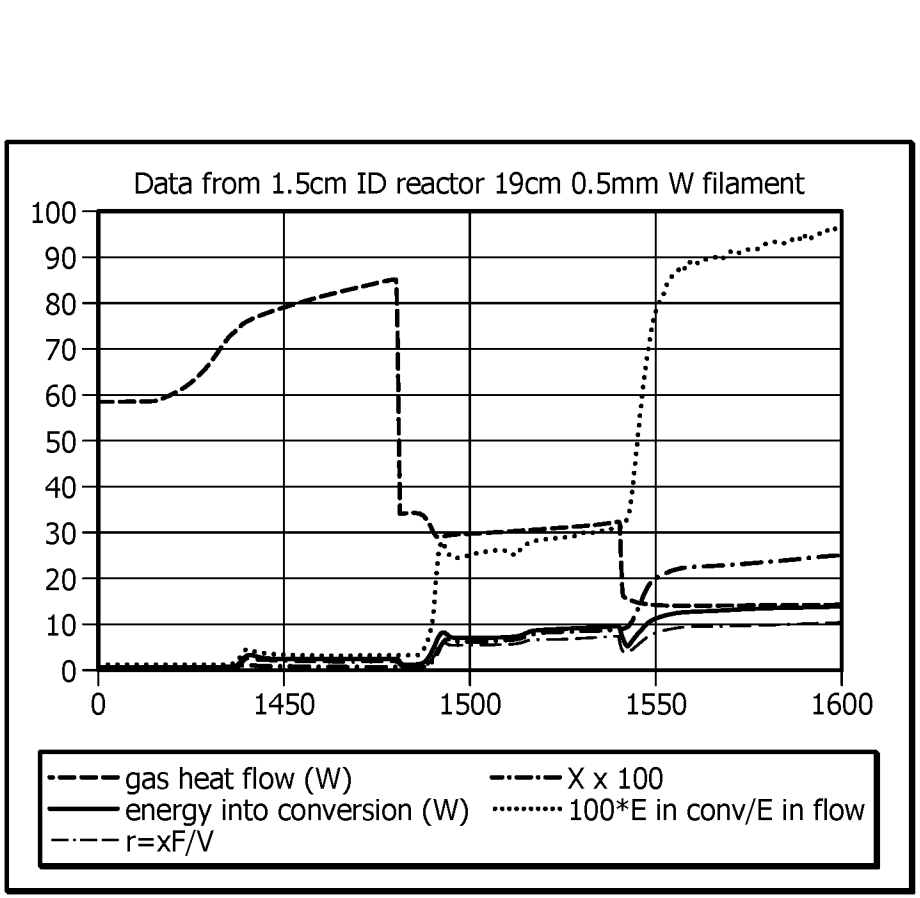
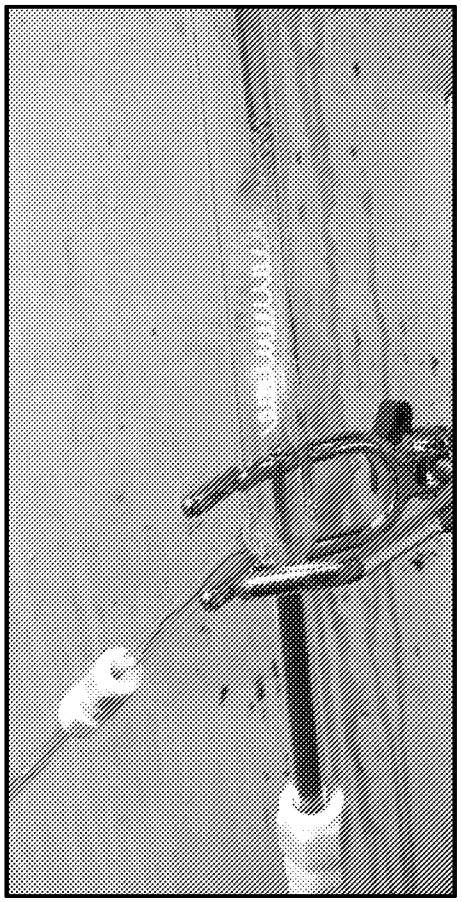
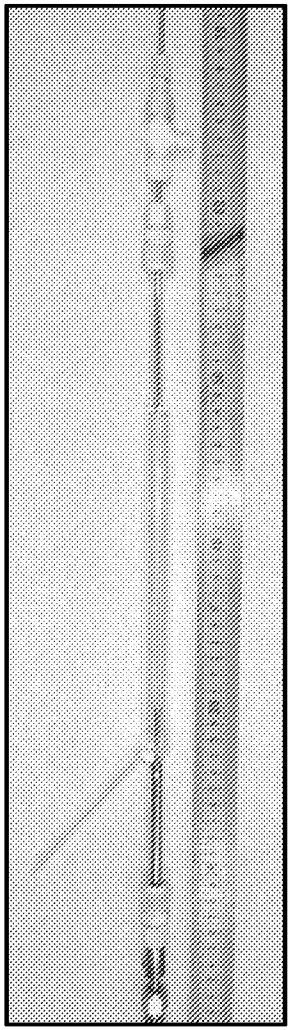
*FIG. 37*

CHEMICAL REACTION AND CONVERSION IN THERMALLY HETEROGENEOUS AND NON-STEADY-STATE CHEMICAL REACTORS

CROSS-REFERENCE TO RELATED APPLICATIONS

This application claims the benefit under 35 U.S.C. Section 119(e) of U.S. Provisional Application No. 63/067,569 filed on Aug. 19, 2020 by Eric W. McFarland and entitled "CHEMICAL REACTION AND CONVERSION IN THERMALLY HETEROGENEOUS AND NON-STEADY-STATE CHEMICAL REACTORS", and U.S. Provisional Application No. 63/106,031 filed on Oct. 27, 2020 by Eric W. McFarland and entitled "CHEMICAL PROCESSES AND REACTOR SYSTEMS FOR HIGH TEMPERATURE NON-ISOTHERMAL REACTORS" both of which applications are incorporated herein by reference in their entirety for all purposes.

STATEMENT REGARDING GOVERNMENTALLY SPONSORED RESEARCH OR DEVELOPMENT

None.

BACKGROUND

The transformation of chemical feedstocks into products relies on reactors with controlled internal conditions. Conversion of hydrocarbon feedstocks such as natural gas containing methane with strong carbon-hydrogen bonds is particularly challenging and typically utilizes reactors containing catalysts and/or making use of high temperatures. A major limitation in chemical reaction engineering is the inability to perform very high temperature reactions efficiently at high pressure due to the limitations of reactor construction materials. For reversible reactions, equilibrium limitations, can also make very high temperatures desirable but limited by reactor material considerations. This is especially true in corrosive environments. Above approximately 1000° C. few moderate cost materials can be used for construction of safe pressure vessels.

One example of an important reaction that would be favorable at very high temperatures is natural gas pyrolysis. In pyrolysis of hydrocarbon reactants, the molecules are dehydrogenated, cracked and broken down into lighter hydrocarbons, olefins, aromatics, and/or solid carbon. It is generally cost effective to operate at high pressures and equilibrium restrictions favor the use of very high temperatures. A catalyst may be used as well to hasten reaction rates and improve selectivities. Methane pyrolysis by rapid heating in a reaction zone has been investigated. Subatmospheric pressures and specific ranges of velocities of hydrocarbon gases through the reaction zone are disclosed in U.S. Pat. No. 3,156,733. Heat is supplied by burning of hydrocarbons.

A high-temperature arc furnace can be used in the pyrolysis of methane to achieve high conversions to hydrogen and a valuable carbon black co-product. U.S. Pat. No. 3,389,189 is an example of patents relating to production of acetylene by an electric arc. The furnace operation must be paused for removal of the solid carbon product. If the carbon produced from natural gas pyrolysis could be efficiently made and conveniently removed from the vessels, pyrolysis would be more useful in industry.

The conversion of methane, natural gas and other alkanes to unsaturated hydrocarbons and hydrogen by subjecting the hydrocarbons to high temperatures produced by electromagnetic radiation or electrical discharges has been extensively studied and disclosed in U.S. Pat. No. 5,277,773 using microwave radiation to produce an electric discharge and U.S. Pat. No. 5,131,993 which discloses a method using a microwave discharge plasma and a carrier gas, such as oxygen, hydrogen and nitrogen, and, generally, a catalyst.

SUMMARY

In an embodiment, a process for performing high temperature reactions comprises introducing reactants into a reactor vessel, generating a high temperature within the reactor vessel, exposing a first portion of the reactants to the high temperature, and reacting the first portion of the reactants based on contact with the high temperature to produce one or more products. The high temperature is higher than a lower temperature of a wall of the reactor vessel, and a temperature gradient is generated between the high temperature and the lower temperature of the wall. A second portion of the reactants are not exposed to the high temperature, and the second portion of the reactants do not react.

In an embodiment, a thermal gradient reactor comprises a reactor vessel comprising a reactor wall, an inner wall disposed within the reactor vessel, wherein an annular space is created within the reactor vessel between the reactor wall and the inner wall, a reaction zone defined within the inner wall, and a heat source disposed within the inner wall. The heat source is configured to generate a reaction temperature within the reaction zone, and the annular space and the reaction zone are configured to pass a reactant gas through an inlet, through the annular space, through the reaction zone, and out an outlet.

In an embodiment, a high temperature reaction process comprises passing a reactant gas into a reactor vessel, heating a heat source to generate a high temperature at the heat source, reacting at least a portion of the reactant within the reactor vessel based on generating the high temperature to create reaction products comprising solid carbon, cooling the heat source to maintain a wall of the reactor vessel below a threshold temperature, depositing the solid carbon within the reactor vessel, repeating the passing, heating, and reacting until an accumulation of solid carbon forms in the reactor vessel, and removing the solid carbon from the reactor vessel to recover the solid carbon. The heat source is only heated for a first time period, and the threshold temperature is below the high temperature.

In an embodiment, a high temperature reaction process comprises generating a high temperature at a first location within a liquid, passing a reactant gas through the high temperature within the liquid, forming reaction products based on the reactant gas passing through the high temperature, passing the reaction products away from the first location, cooling the reaction products based on passing the reaction products through the liquid away from the first location, and removing at least a portion of the reaction products from the reactor vessel. The liquid is within a reactor vessel, and the liquid away from the first location is at a lower temperature.

In an embodiment, a non-isothermal reactor comprises a pressure vessel, a plurality of high-temperature heat sources disposed within the pressure vessel, at least one heat shield, an inlet configured to introduce reactants into the pressure vessel, and an outlet configured to pass products out of the pressure vessel. The high-temperature heat source is configured to create a spatially varying temperature gradient within heat shield.

In an embodiment, a reaction process using a non-isothermal reactor comprises contacting a hydrocarbon with a high-temperature heat source within a pressure vessel, generating solid carbon and hydrogen in response to contacting the hydrocarbon with the high-temperature heat source, radiating heat from the high-temperature heat source, absorbing, by the solid carbon, the radiating heat, heating the solid carbon to a reaction temperature, contacting the hydrocarbon with the heated solid carbon to generate additional solid carbon and hydrogen, and shielding the radiating heat from a wall of the pressure vessel based on absorbing the radiating heat with the solid carbon.

These and other features will be more clearly understood from the following detailed description taken in conjunction with the accompanying drawings and claims.

BRIEF DESCRIPTION OF THE DRAWINGS

For a more complete understanding of the present disclosure, reference is now made to the following brief description, taken in connection with the accompanying drawings and detailed description:

FIG. 3 schematically illustrates a flow reactor with a central heated zone isolated from a peripheral cooler zone.

FIG. 28 is a photograph and illustration of the unmixed reactor of FIG. 1 and described in Example 1.

FIG. 33 photographs of the experimental thermal gradient reactor that is an infrared reflecting ceramic described in Example 6.

FIG. 35 photographs of the experimental thermal gradient reactor that is an infrared reflecting ceramic described in Example 6 showing minimal accumulation of carbon on alumina tube.

FIG. 36 photograph and data from experiment of Example 7 demonstrating methane pyrolysis batch operation of the non-isothermal reactor.

FIG. 37 photograph and data from experiment, Example 8, demonstrating high flow non-isothermal reactor for methane pyrolysis.

DETAILED DESCRIPTION

Figure 1A:
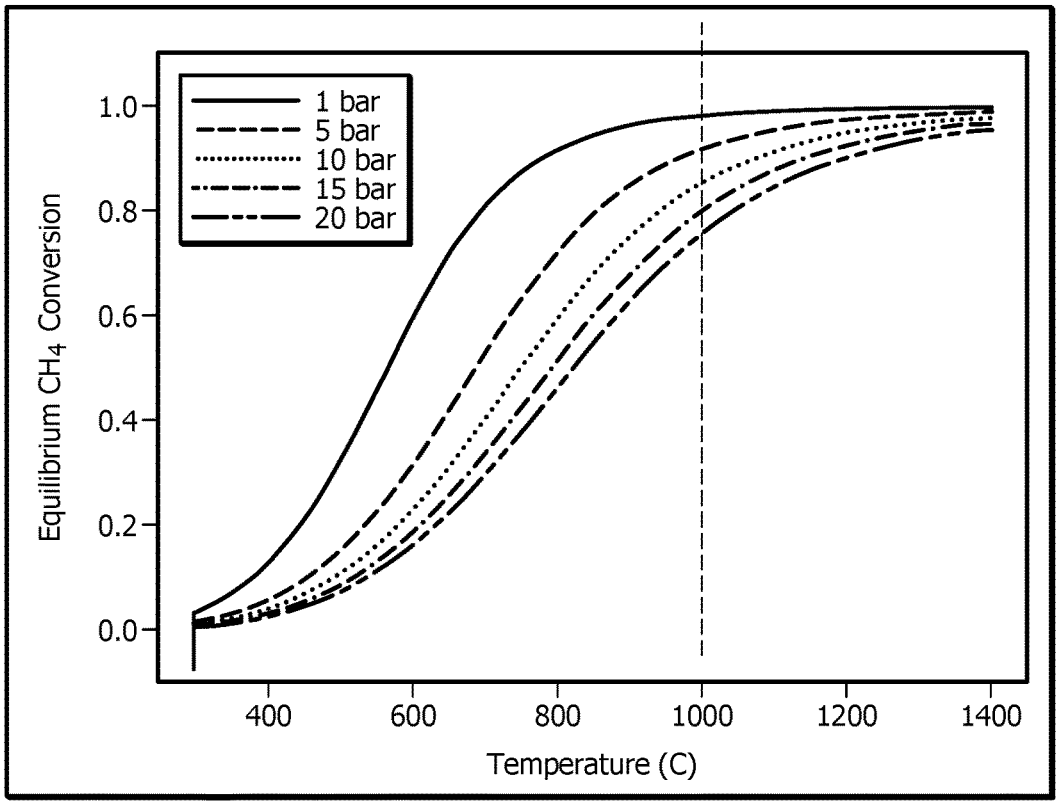
FIGS. 1A and 1B illustrates the equilibrium conversion of a hydrocarbon relative to temperature and the reaction kinetics to achieve equilibrium.

As used herein, a reactant refers to any substance that enters into and is potentially altered in the course of a chemical transformation. A product refers to a substance resulting from a set of conditions in a chemical or physical transformation. A reactor refers to a container or apparatus in which substances are made to undergo chemical transformations. A catalyst refers to a substance that increases the rate of a chemical reaction or enables a chemical reaction to proceed under different conditions than otherwise possible. A condensed phase refers to a liquid and/or solid. Natural gas refers to a collection of mostly methane with much smaller amounts of other light alkanes (ethane, propane, etc.) and trace impurities ($CO_2$, water, etc). Pyrolysis refers to the decomposition of a hydrocarbon to solid carbon and hydrogen.

In the past systems that have used electric arcs and other means for the production of plasmas, whereby the electronic temperature was very high and not in equilibrium with the nuclear temperature in the atoms and molecules, carbon black can be produced efficiently in commercial practice. However, these technologies are distinct from the present systems and methods and designs in that the goal and operating principals of the presently practiced plasma based systems do not rely or make use of a spatially varying temperature gradient. Further, plasmas in reactant gases of commercial interest cannot be sustained at high pressures. The systems and methods of the present disclosure are suitable for very high pressure operation with a wide range of choices of materials. In other systems, electric heating of platinum filaments was utilized by Q. Sun, et al. to achieve high temperatures at very short reaction (residence) times to obtain selective production of specific gaseous chemical intermediates (Energy & Fuels, 2000, 14, 490-494), product selectivity was obtained solely based on short reaction times and had a temperature gradient been important the selectivity would have been poor (undesirable). The present systems and methods are distinct based on the innovative use of spatial temperature gradients to ensure that no reactor structural material is required to sustain high temperatures, and in the production of desirable solid carbon. In some aspects, the reactor structural materials may not be able to maintain structural integrity at the pressure of the reactor and the temperature of the actual reaction. Further distinctions include management of the large radiative heat emission through the thermal design.

If pyrolysis were efficient, as enabled by the present systems and methods, then fossil based hydrocarbons such as methane could be used to make hydrogen without producing carbon dioxide. At present, industrial hydrogen is produced primarily using the steam methane reforming (SMR) process, and the product effluent from the reactors contains not only the desired hydrogen product but also other gaseous species including carbon oxides ($CO/CO_2$) and unconverted methane. Separation of the hydrogen for shipment or storage and separation of the methane for recirculation back to the reformer is carried out in a pressure swing adsorption (PSA) unit, a costly and energy-intensive separation. This separation process exists as an independent unit after reaction. Overall the existing commercial process produces significant amounts of carbon dioxide.

The systems and methods disclosed herein include chemical reactors designed whereby spatial and temporal temperature gradients and/or reactor zones of distinctly different temperatures allow temperature dependent chemical reactions to occur at different rates in different reaction zones, thereby providing unique flexibility in selectivity and reactor design while performing very high temperature chemistry in reactors made with materials suitable for less demanding environments. In addition, the processes, systems, and methods disclosed herein include chemical reactors designed specifically with temperature gradients in or around localized high temperature heat sources which provide for reactor zones of distinctly different temperatures which allow temperature dependent chemical reactions to occur at different rates in the different reactor zones, thereby providing unique flexibility in selectivity and reactor design while performing very high temperature chemistry in reactors made with materials suitable for less demanding environments. One or more embodiments discussed herein allow equilibrium limited reactions normally requiring high temperatures to be performed at lower or more moderate temperatures. Accordingly, the present systems and methods provide a novel means for obtaining efficient conversion of feedstocks while maintaining the reactor temperature or the reactor materials temperature such that low-cost materials may be utilized.

The present systems and methods consist of A) a process for the conversion of reactant molecules containing hydrogen and carbon(s) such as those in natural gas that may include, i) the pretreatment of the reactants, ii) the reaction of the reactants in a reactor that has a large temperature gradient by design, and iii) the separation of the products which contain hydrogen and carbon, and, B) chemical reactors with large thermal gradients inside the reactor by design to increase the rate of reaction.

Although, many prior processes are known by practioners that include chemical reactors that are non-isothermal, the present systems and methods are novel and distinct because, a large thermal gradient is created by design to allow extremely fast reaction rates in high temperature zones while the conditions within the reactor in other zones are milder. In general, chemical reactors are typically classified as isothermal when the reactor is designed to maintain a single temperature using a heat exchanger to add or remove reaction heat, or adiabatic when the reactor may be insulated and the temperature allowed to vary as the reaction proceeds and produces or consumes heat. The present systems and methods include reactors designed specifically with zones of very different temperatures within the same continuous reactor environment by design, thereby allowing for chemical conversions otherwise not possible with conventional reactor designs.

In some embodiments, the present systems and methods include reactors designed specifically with zones of very different temperatures within the same reactor environment by design to allow for chemical conversions otherwise not possible with conventional reactor designs. The basic systems and methods and novel aspects can be applied for reactions of gases and/or liquids whereby the reaction rates, mass, and heat transfer rates can have significant variability. In some embodiments, solid products can remain suspended in the gas or liquid fluid, thereby assisting in removal of the solid products from the reactor.

As an important example, methane pyrolysis is an endothermic, reversible chemical reaction whereby one mole of methane is converted to 2 moles of hydrogen and 1 mole of solid carbon. At high pressure, thermodynamics make it impossible to achieve high methane conversion except at very high temperatures as seen in FIG. 1A where the equilibrium conversion is plotted versus temperature. For example, the reaction temperature can be maintained above 1,000° C., above 1,100° C., above 1,200° C., above 1,300° C., above 1,400° C., or above 1,500° C. In some aspects, the temperature may be less than or equal to about 2,600° C., less than 2,500° C., or less than 2,400° C. The pressure of the reactions and reactor described herein can be greater than 1 bar, greater than 5 bar, greater than 10 bar, greater than 20 bar, greater than 30 bar, greater than 40 bar, or greater than 50 bar. In some aspects, the pressure may be less than or equal to 100 bar or less than about 80 bar.

Figure 1B:
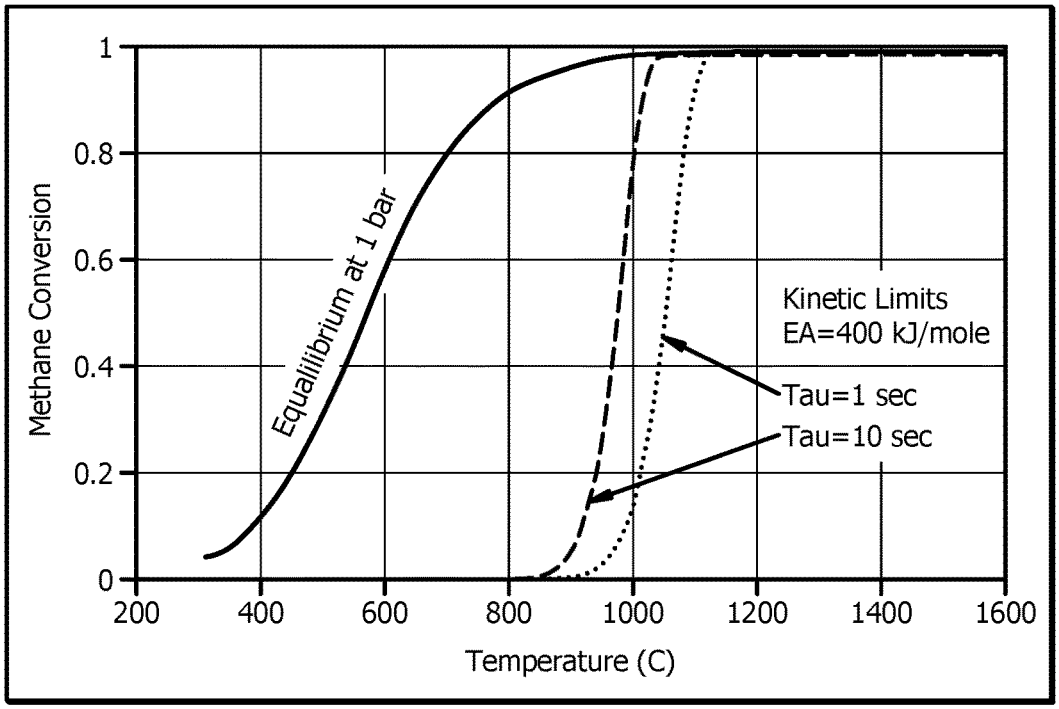

Whereas thermodynamics set the maximum equilibrium conversion under any chemical pathway, chemical kinetics determine how fast equilibrium conversion is achieved. Although at 1 bar pressure and 1000° C. it is possible to achieve nearly 100% methane conversion, without a catalyst the reaction time required to achieve equilibrium conversion may be prohibitively long. FIG. 1B shows a plot of the equilibrium conversion of methane together with the kinetically limited conversion at reaction times, tau, of 1 second and 10 seconds for a gas phase reaction without a catalyst where the activation energy for the reaction is approximately 400 kJ/mole. Although equilibrium provides that it is possible to reach nearly 100% conversion at 1 bar pressure at 1000° C., without a catalyst only approximately 10% conversion can be obtained kinetically in 1 second, and 70% in a larger reactor with 10 seconds of reaction time. This has significant cost implications based on the reactor size. In conventional reactors without a catalyst it is not possible without a catalyst to convert much of any methane below 800° C. It would be preferable both kinetically and thermodynamically to operate far above 1000° C., however, conventional materials of construction make this very challenging especially at high pressure.

Figure 2A:
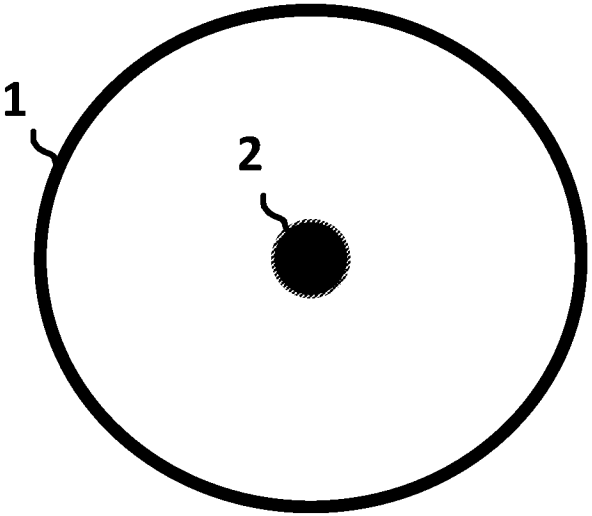
FIG. 2A schematically shows a reactor with a heat source in the center illustrating how a non-uniform temperature can provide high temperatures and high reaction rates near the source and low temperatures and low reaction rates away from the source.
Figure 2B:
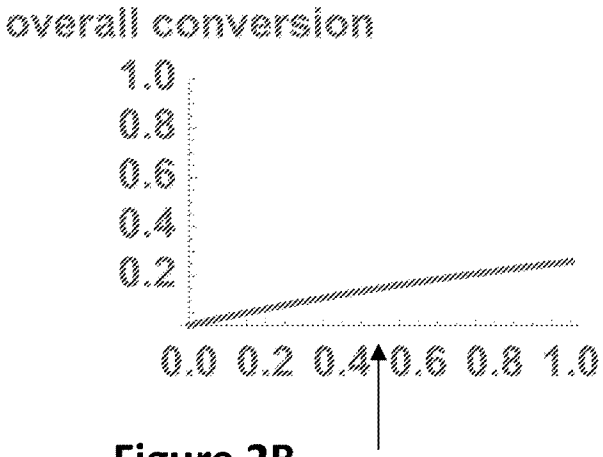
FIGS. 2B-2E illustrate the results of simplified calculations of the time dependent radial and average system temperature and the radial reactant concentration and average conversion for the reactor as shown in FIG. 2A.
Figure 2C:
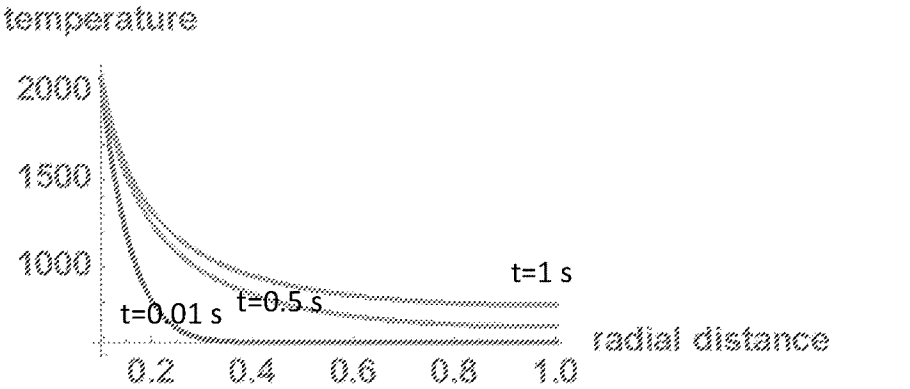
Figure 2D:
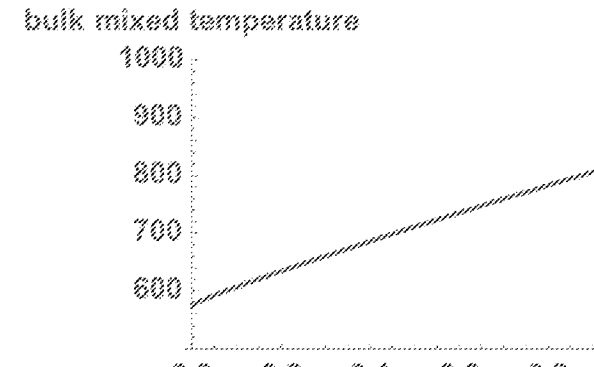
Figure 2E:
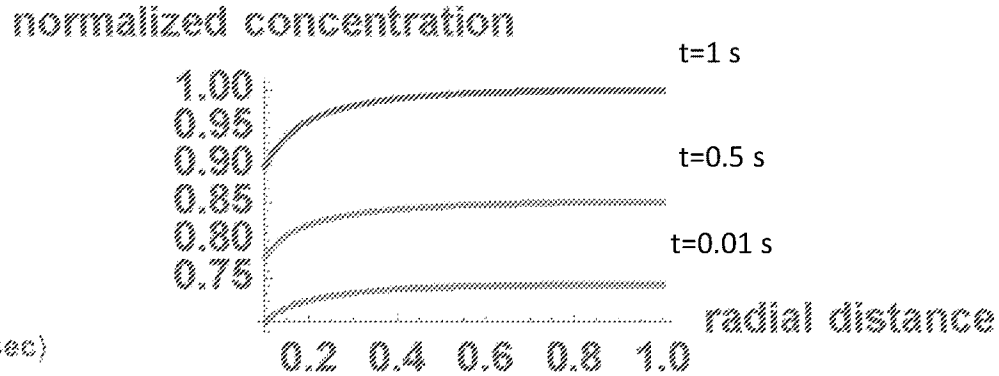

The basic concept of a temperature gradient reaction environment can be understood with reference to FIG. 2A which shows schematically a spherical unmixed reaction volume (reactor), with a gas tight pressure vessel wall 1 made, for example, of 316 stainless steel, and at the center, a localized heat source 2. As an example, the system can initially be at a uniform temperature of 573 K (300° C.) and 20 bar pressure filled with pure methane. At t=0, the central heat source 2 can be turned on such that the source temperature is 2073 K (1800° C.), (far too high for the reactor vessel wall 1 to safely sustain). The source is maintained at the high temperature for 0.5 seconds then turned off and allowing it to return to a lower temperature as it equilibrates with the gas. In 0.5 seconds, the propagation of heat is too slow to heat the entire contents of the reactor. Instead, methane in close proximity to the heat source 2 can react rapidly to produce solid carbon and hydrogen at nearly 100% conversion while methane further from the source is not heated high enough to react and has no conversion. The overall gas temperature (and pressure) of the vessel rises, but in this example, only to approximately 700 K (427° C.). Thus, the walls 1 of the pressure vessel do not need to sustain the high temperatures required to convert methane in an isothermal reactor. Because the reaction rate rises exponentially with temperature the high temperature zones react faster than they are able to transfer heat to the surrounding reactant media. In this simple illustrative example, the reactant media itself is effectively serving as an in situ reaction vessel.

The heat and mass balances of the reacting system can be readily modelled and the average temperature and methane conversion determined. Although the effective reaction rate constant typically will increase exponentially with temperature, ultimately the reaction rate will be mass transfer limited and model rate expression will need to reflect that limit. FIGS. 2B-2E shows the results of such model calculations for the example described above. If the heat source 2 remains on longer than 0.5 seconds, then the average gas temperature will continue to rise and eventually be too high for the reactor materials. Provided that the time is short enough, methane conversion is possible even at the high pressure at an average temperature far lower than that required to tax the limits of ordinary reactor materials. Although the same reactor concepts could make possible other reactions, methane decomposition (pyrolysis) is an ideal exemplar.

Whereas the description above provides the basic idea of how a time and spatially varying temperature gradient can be used in an unstirred reactor to allow reactions in reactors made of modest materials, most reaction systems would employ flow reactors. In the case of a flow reactor, modelling requires the addition of terms describing flow and the use of fluid dynamics. In a simplified scheme, FIG. 3 shows schematically how a reactant stream of molar flow rate F(moles/s) enters a reactor and is split into molar flows passing through a heated zone $F_{Ho}$ and an unheated, zone $F_{Co}$, where $F=F_{Ho}+F_{Co}$. The reactant in the heated zone has a conversion to products A→B (molecularity, ε=1) of $X_H$ and in the cold zone $X_C$. After leaving the heated zone the streams are mixed together. In this example, the combined stream leaving the reactor has an overall bulk conversion and temperature given by a weighted average (neglecting any heat of mixing). If we assume that the hot zone is hot enough for 100% conversion and the cold zone has no conversion then the weighted average conversion in the bulk flow leaving the reactor is given by the ratio of the molar flow rate through the hot zone to the total molar flow rate. This then determines the combined stream temperature.

As a specific example in a preferred embodiment, suppose the reactant stream is methane and we are examining pyrolysis, $CH_4 \rightarrow C+2H_2$ (ε=3 moles product per mole reactant).

$$\xrightarrow{X_H=1, X_C=0, \frac{c_{pB}}{c_{pA}}=1, \varepsilon=3} T = \frac{3T_H X + T_C(1-X)}{(1+2X)}$$

In a conventional reactor at 1 second of reaction time there would be negligible conversion at 950° C. without a catalyst, and even at 10 sec there would not be equilibrium conversion. However, a methane reactant stream at 200° C. can be converted (65% conversion) in a thermally heterogeneous reactor with a heated zone at 1100° C. with 65% of the molar flow passing through it and heated to 1100° C. where conversion is 100% in under one second. When mixed with the cold stream the temperature of the exit stream is only approximately 963° C. Because of the reactor design, the reactor vessel walls are only in contact with the cold stream making the materials of construction choices simpler. An important element of the design is therefore the reactant flow design to ensure the hot zone is isolated from major structural materials under stress. In some aspects, the reactor structural materials may not be able to maintain structural integrity at the pressure of the reactor and the temperature of the actual reaction. For example, the temperature of the wall can be maintained at a lower temperature based on the second portion of the reactants not being heated significantly because of the temperature gradient, where not being heated significantly refers to being maintained below a temperature limit of the structural integrity of the wall. There are many alternatives to achieve this flow design, where some are described below in the examples.

Another aspect of the invention is the utilization of a very high temperature heat source (T>1200° C.) in specific reaction environments where energy transfer by atypical pathways is important. For endothermic reactions, energy must be transferred to the reactants at a rate in proportion to the reaction rate. The energy can only be added by: i) interaction of the methane with energy in gas phase matter, ii) interaction of methane with a hot condensed matter surface (convection), or iii) from electromagnetic radiation. A high temperature surface can transfer heat to the methane by both convection and radiation, the heat flux is the heat transferred into a unit volume by radiation and convection. To maintain the temperature the heat transferred into the volume must equal the heat required for the reaction. Since the radiation component of heat transfer increases as the $4^{th}$ power of the source temperature, very high temperature sources transfer significant amounts of heat by radiation. Methane and the products of pyrolysis are strong absorbers of infrared radiation and significant heating of the vapor phase and developing solids surrounding the high temperature source will occur. The total heat added per unit area can be much greater than with a low temperature source.

Another important aspect of the invention making use of a high temperature source and temperature gradient for endothermic reactions such as methane pyrolysis as well as many other reactions where radical species are involved in the reaction pathway is the utilization of surface generated radicals. When hydrogen contacts a very high temperature source, it can dissociate and eject two hydrogen atoms into the gas phase. This reaction is very endothermic ($\Delta H$=436 kJ/mole) and it cools the surface. Similarly, when methane contacts a very high temperature surface it can dissociate and eject a methyl and hydrogen radical into the gas phase also cooling the surface, ($\Delta H$=439 kJ/mole). Radical ejection from the surface to the gas phase increases the rate of reaction within the gas where the radicals are injected.

A novel aspect of the systems and methods disclosed herein is the realization that the energy transfer and reaction rate enhancement in the region around a very high temperature surface is provided by the surface flux of activated chemical species ejected from the high temperature surface. Thus, the power delivered to the methane system is conveyed by: i) the radicals generated on the surface and ejected, ii) radiation emitted, and iii) convection. The power input from the source (electrical or combustion) is dissipated at the source surface into the production of active species ejected from the surface, blackbody radiation, and convection.

Figure 4:
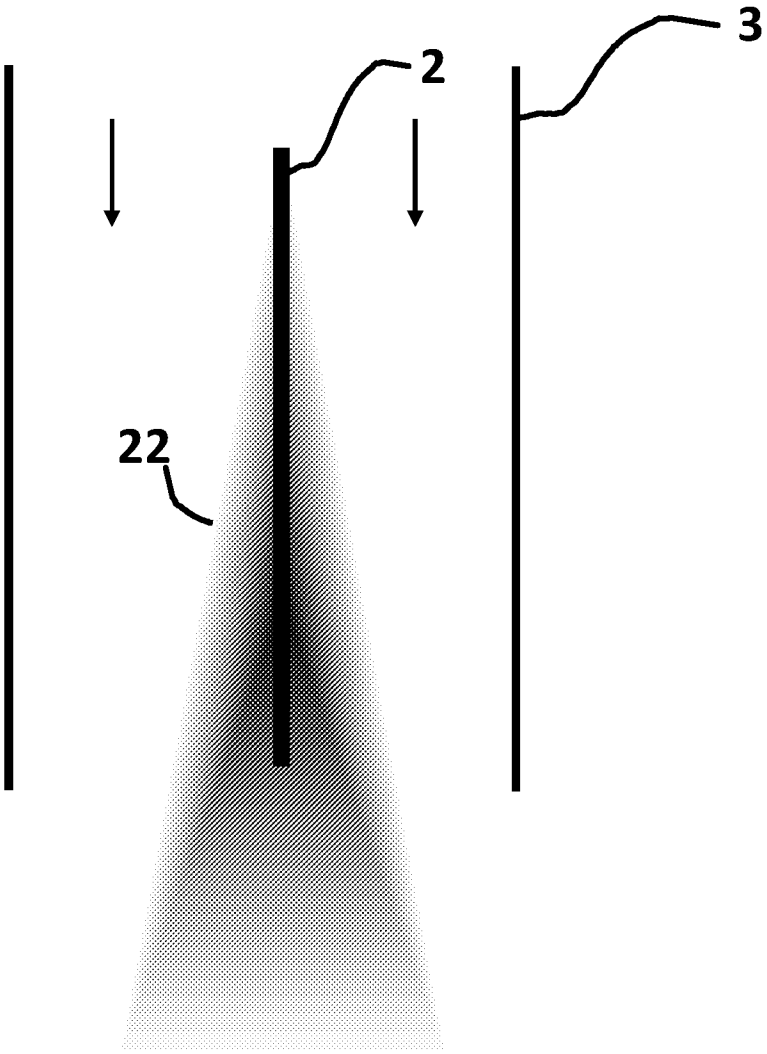
FIG. 4 schematically illustrates the development of suspended solid carbon in the reactant gas around the high temperature source which will absorb the radiated heat from the source preventing it from reaching the radiation shield and heating the solid so as to form additional sites for reaction to occur.

Prior systems, including those using plasma sources of heat, were limited in their operational pressure due to the materials of construction of the reactor pressure vessel walls. Based on the designs disclosed herein, the carbon formed during the reaction can be used to shield the high temperature source from radiation heat transfer losses by self-adsorption in the forming carbon around the heat source. The infrared radiation absorbed in the solid carbon can in turn heat the carbon particle (instead of transmitting it to the heat shield) forming another high temperature site for a high reaction rate (thermally autocatalytic). For example, FIG. 4 illustrates the formation of solid carbon along the direction of flow along the heating element 2. The solid carbon 22 can form as a suspension of solid particles in the reactant gas around the high temperature source 2 which can then absorb the radiated heat from the heat source 2 and prevent or reduce the heat from reaching the radiation shield 3 while heating the solid carbon so as to form additional sites for reaction to occur. This can create a high temperature reaction zone around the heat source 2 that can improve the overall reaction rate (e.g., the overall volumetric reaction rate, etc.). The self-adsorption of heat by the solid product produced may also be used in the unstirred reactor configuration and can reduce the heat moving away from the heat source 2 and enhance the reaction rate.

In previous systems for producing gaseous products such as acetylene and ethylene using high temperatures obtained by electric heating, generally the gas phase products were obtained from plasmas and without the benefit of a large thermal gradient and radiation shielding. In the designs disclosed herein, solid carbon is the desired product to be formed in the gas phase around the high temperature source. By virtue of the heat absorbing properties of the solid carbon formed and the radiation shielding around the source, the reactor materials used for the process can be standard for chemical reactors and be able to perform at very high reaction pressures. For example, the reactor pressures can be between atmospheric pressure up to about 100 bar, up to about 50 bar, up to 40 bar, up to about 30 bar, or up to about 20 bar.

It is also noteworthy that on heated surfaces solid chemicals can be deposited on the surface (e.g., coking, fouling). However, when a very high temperature surface is utilized solids do not form on the surface as the temperature exceeds the desorption temperature of all surface products. For hydrocarbon reactions, an important surface interaction is with hydrogen and methane.

Figure 5:
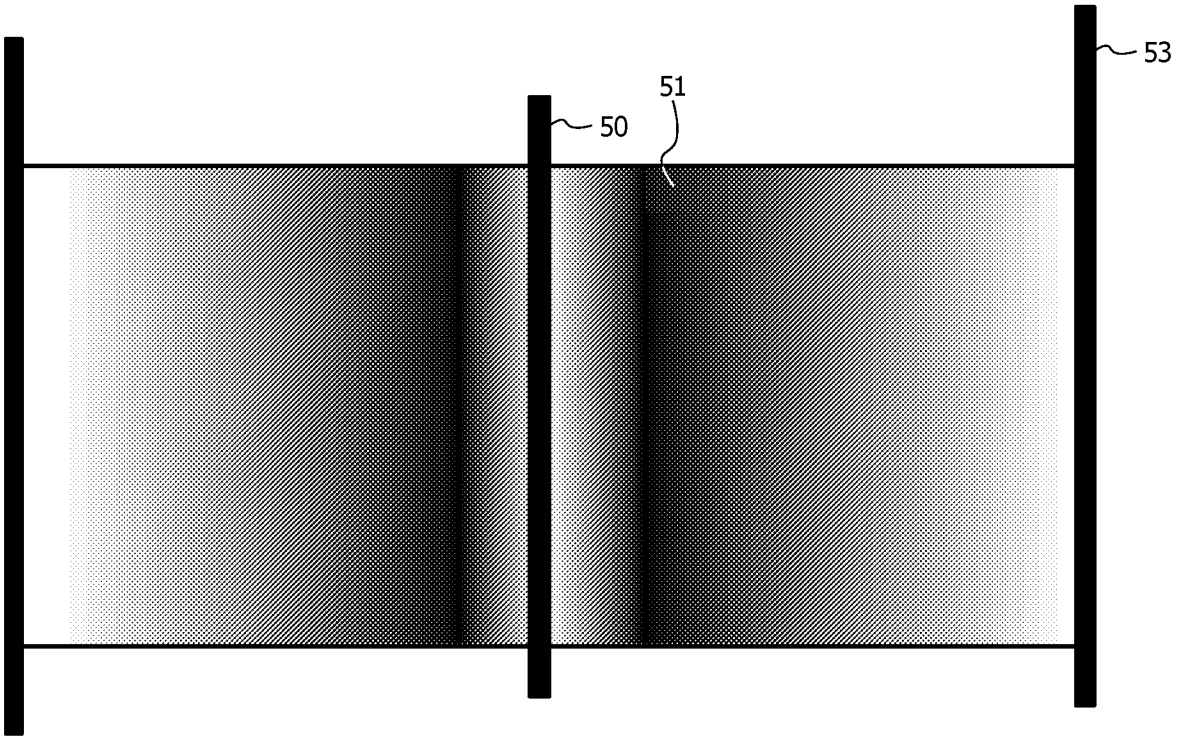
FIG. 5 schematically illustrates a localized heat source giving rise to non-isothermal reaction zones.

FIG. 5 shows a schematic illustration of methane pyrolysis using a localized high temperature heat source, 50, which in some embodiments can be an electrically heated source such as a conducting filament, or combustion heated source such as a combustion tube. The heat can be dissipated at the surface of the source by the three processes described above which promote the conversion of methane into solid carbon and hydrogen. As the carbon is formed, intermediate hydrocarbons and carbon itself have strong infrared absorbance, which absorbs the radiation from the source surface heating the species and further providing heat for the reactions occurring in the region 51 around the heat source 50. The absorbance of the surface radiation also partially shields the reactor components a distance 53 away from the heat source 50, and maintains a large temperature gradient which is one aspect of the systems and methods disclosed herein. Convection also contributes to lowering the surface temperature and allowing maximum power to be added to the unit volume. The heat source is maintained at a temperature high enough that no carbon deposition occurs on the source and instead the carbon remains suspended in the gas. For most applications the source temperature is greater than about 1400° C.

The high temperature surfaces described here can be limited within the reaction environment as described herein to avoid raising the entire system to such high temperatures. Practical considerations limit the maximum operational temperature of the process. There are few low-cost materials of construction that can operate at temperatures above 1000° C. at high pressure, and removing heat from a system is not practical above approximately 900° C. Thus, although it is desirable to contact high pressure methane with a 1500° C. source to achieve rapid rates of reaction to high conversion, it is not desirable to have a reactor outlet temperature greater than approximately 900° C., and if hydrocarbons are present, the outlet should be less than approximately 700° C. to avoid coke formation. Another feature disclosed herein is the use of a quench gas mixed with the high temperature product stream, which helps to prevent the structural materials of the reactor from exposure to extreme temperatures.

Often the heat source will be very high temperature and emit significant amounts of infrared radiation that will be poorly absorbed by the gas phase reactants. Although this important pathway was neglected in the descriptions above, most important gas phase reactants do not themselves absorb the infrared thermal energy and the systems and methods disclosed herein include the use of selective shielding materials that can minimize absorption of the infrared radiation to avoid significant heating by undesirable structural elements. In an embodiment as shown schematically in FIG. 6, methane at high pressure can be introduced in feed stream 6 to the reactor pressure vessel 1, and flow in an outer concentric flow channel 4, where the feed stream can be in contact with an inner wall forming a heat shield 3 that separates the hot reaction zone 5 from the colder outer flow channel 4. The outer concentric flow channel 4 can be defined between the inner surface of the pressure vessel 1 wall and an outer surface of the heat shield 3. The flow direction of the feed stream 6 can be opposite that of the reactant flow through the reaction zone 5. The methane introduced into the outer flow channel 4 provides cooling to the wall of the heat shield 3, which can be coated on the reaction side with an infrared conducting and/or reflective material. In some embodiments, the heat shield can comprise a ceramic such as alumina. The methane flow can pass from the outer concentric flow channel 4 into the reaction zone 5 and flow past the heat source 2 where the thermal gradient around the heat source 2 provides the heat to drive the reaction in the reaction zone around the heat source 2. During the reaction, the gas away from the heat source 2 can maintain the heat shield surface at a moderate temperature. Moreover, the heat shield 3 is not used to maintain pressure and can therefore be formed of suitable heat resistant material.

After passing by the heat source 2, no further heating of the gas stream may occur in the gas mixture of reactants and products. The flow velocity can be controlled to be high enough to keep solid carbon particles produced by the reaction suspended in the gas and transported out of the reactor in the product stream 7. The flow of the gas (e.g., the high velocity flow) can be laminar or turbulent flow. In some aspects, the flow of the gas can be turbulent and be introduced at a Reynolds number of greater than 500. The products in stream 7 can undergo conventional solid-gas separation in later units. Due to the material properties and high temperature of the heat source 2, no solid carbon (or substantially no solid carbon) may be deposited on the surface of the heat source 2.

Figure 7:
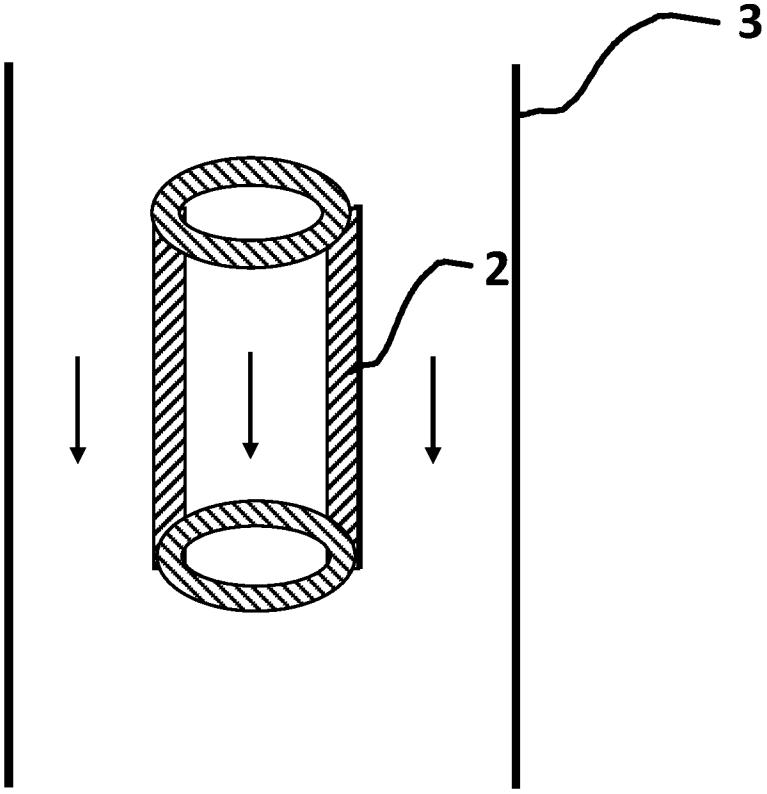
FIG. 7 schematically illustrates a thermal heat source configured as a tube whereby gas flow inside the tube reacts at high temperature and annular flow is heated in a thermal gradient with an external heat shield.
Figure 8:
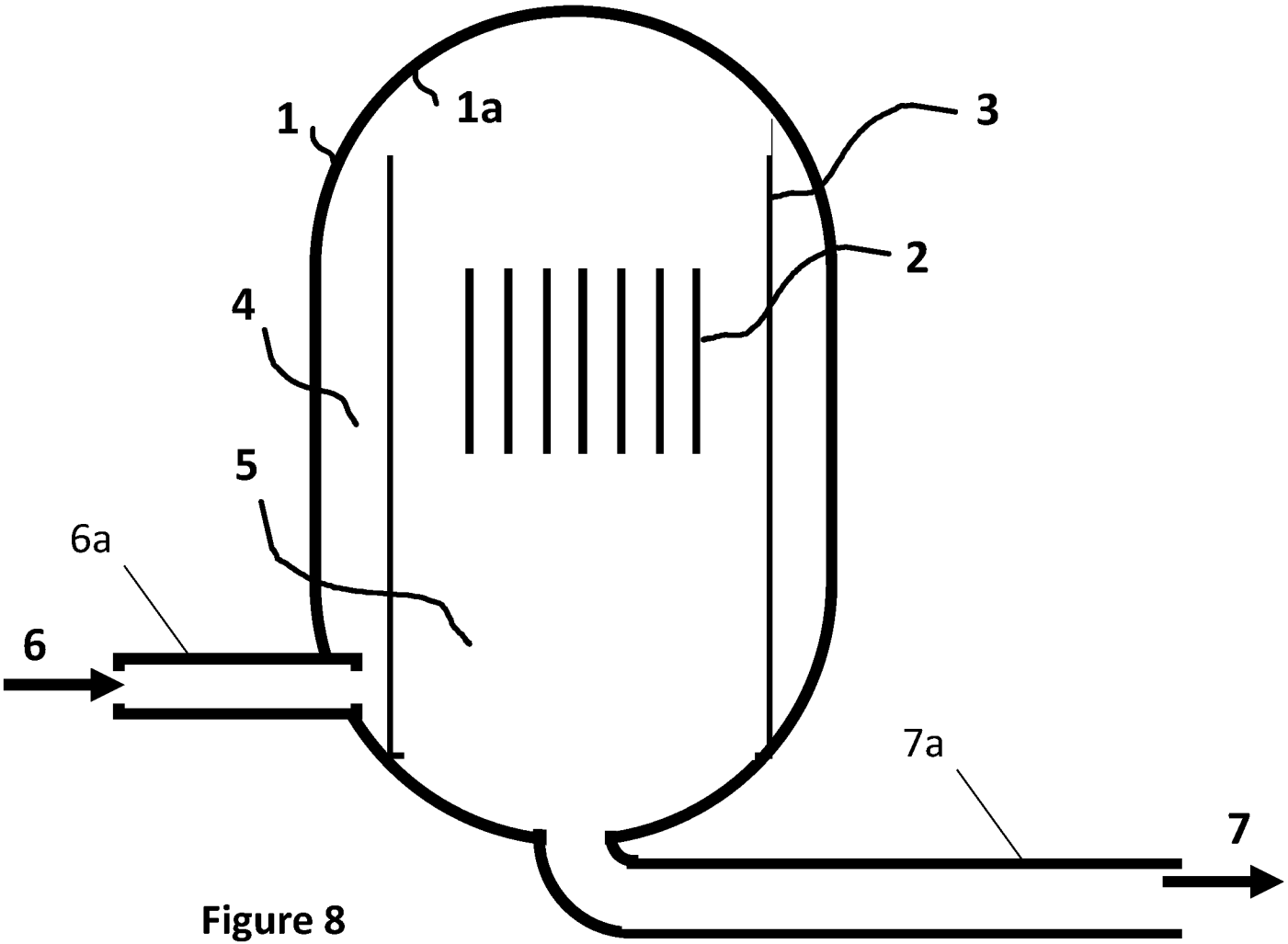
FIG. 8 schematically illustrates a thermal gradient flow reactor with a central heated zone containing many heat sources isolated from a concentric cooler zone by a heat shield cooled by incoming reactant gas.

In some embodiments, the heat source 2 can be made from a high temperature material and can be heated either electrically, or by way of hot combustion gasses. Suitable high temperature materials useful for the heat source 2 can include, but are not limited to, tungsten, molybdenum, tantalum (and their carbides) rhenium, and/or silicon carbide. The heat source 2 may be fashioned into a variety of shapes including a filament or wire. FIG. 7, shows schematically a tubular source 2 heated in the walls to a very high temperature where the reactants flow can occur both through the center and annularly around the outside. The heat shield 3 can reflect infrared emission from the outer wall of the heat source 2. As would be understood to one skilled in the art with the aid of this disclosure, larger reactors using the same concept with a plurality of heat sources 2 arrange in the heated zone can be employed, as shown in FIG. 8. Any suitable number of heat sources 2 can be used and arranged within the reaction zone 5 to effectively cause the reaction of the reactants in the gas. Because it is important that the time reactants are in the heated zone is short, the ratios of the heated zone volume to the flow rates can be very small.

Figure 9:
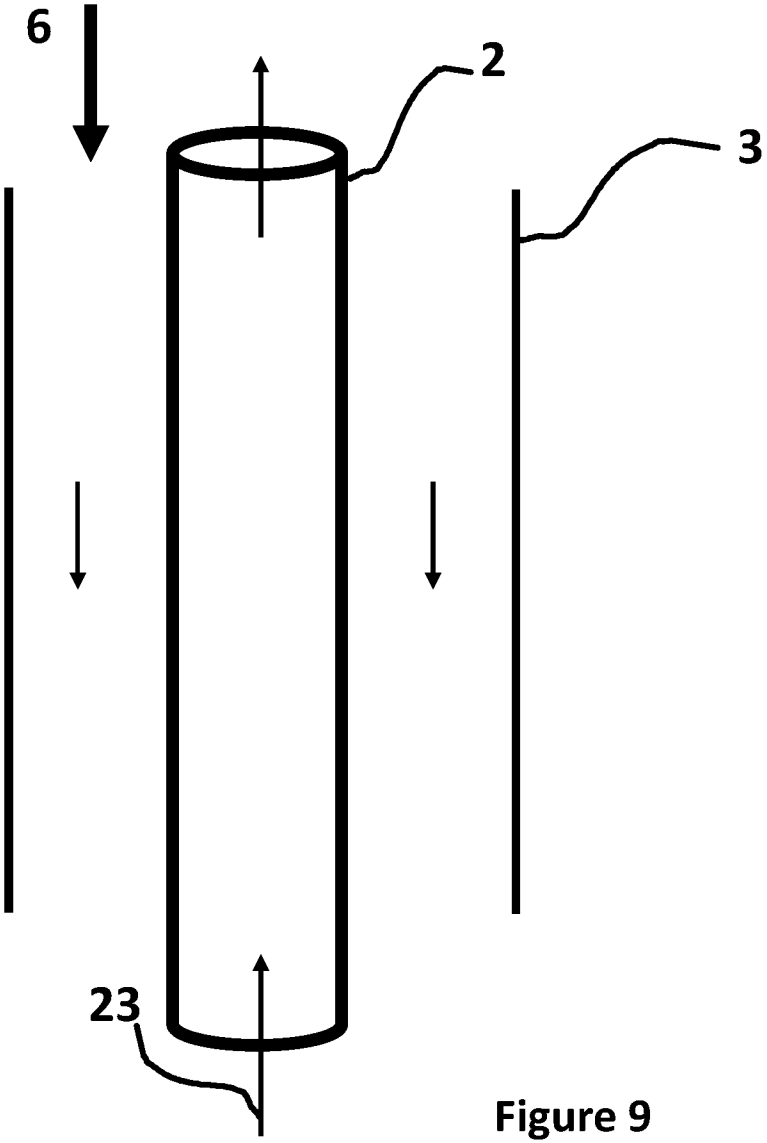
FIG. 9 schematically illustrates a heat source configured for combustion to provide the heat.

The high temperature heat source 2 can be created and configured in a number of ways including but not limited to, AC or DC electrical resistive heating, inductive or microwave heating, and gas combustion. In some embodiments as shown in FIG. 9, a combustible gas, (e.g. hydrogen, natural gas, propane, butane, etc.) can be mixed with oxygen 23, and made to flow into the heat source 2 region separated from the reactor. The combustion of the gas can occur within the heat source region, which may be a tube made of a high temperature material including but not limited to tungsten, molybdenum, tantalum (and their carbides) rhenium, or silicon carbide, where the combustion can heat the walls to a high temperature. As shown in FIG. 9, the combustible gas can flow within the heat source and remain separated from the reactant gas in stream 6 by the wall of the heat source. The combustible gas can flow co-current or counter-current within the heat source 2 relative to the reactant gas flow in stream 6.

In pyrolysis, solid carbon can be formed from hydrocarbons, and in this environment resistive current conducting elements or filaments or tubes in which exothermic reactions can be used to form the heat source 2 (e.g., formed from metals, etc.), can readily form carbides which may be more brittle than the material of the filament. In order to address this issue, material selection, fixation and electrical contact of the filaments, whether or not they are brittle, is contemplated. Further, the lifetimes of high temperature materials may be limited and provisions are included in the disclosed designs for rapidly changing the filamentous sources or continuously refilling or replacing the filament. When carbon is used as the high temperature heat source material erosion of the surface can be anticipated and replaced continuously. Maintaining a high surface temperature on the resistive conducting material or filament or tube or container within which an exothermic reaction is used for heating can be used as a way of preventing carbon accumulation on the heat sources. As an example, maintaining tantalum carbide above 2400° C. can limit or prevent carbon accumulation, and for tungsten carbide, carbon buildup above 2200° C. can be limited or prevented. Alternatively, allowing, by design, for the slow erosion of a carbon tube or filament to maintain a clean source surface can be used to prevent internal product accumulation with a facility or procedure to continuously or periodically replace all or part of the source.

Figure 10:
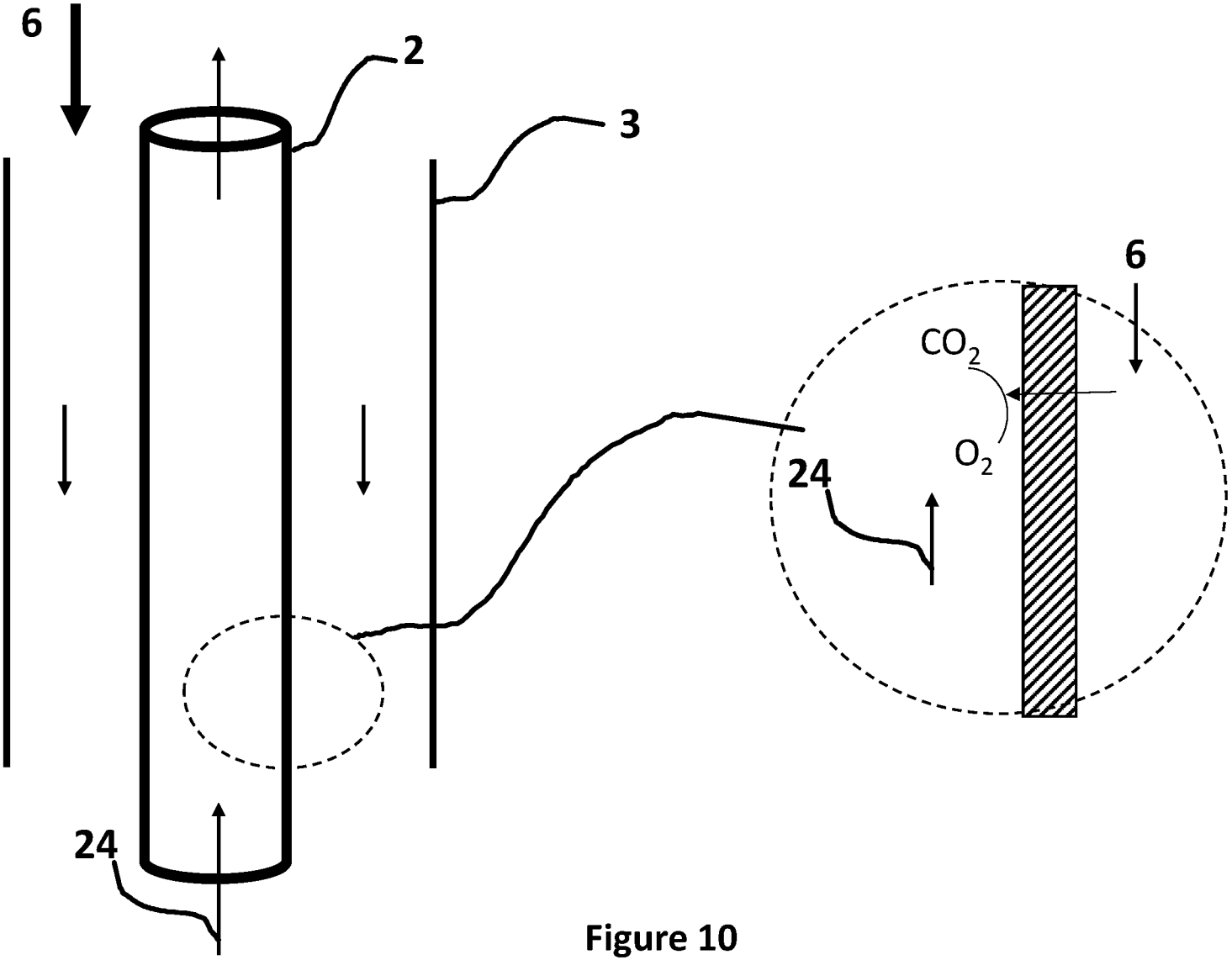
FIG. 10 schematically illustrates a heat source making use of a semipermeable wall that permits a limited amount of reactant gas to pass into the source volume for combustion to provide the heat source.

In another embodiment, a means for producing a high temperature heat source is shown in FIG. 10, whereby the walls of the heat source 2 can be porous or otherwise fabricated to allow limited gas passage. In some embodiments, the walls of the heat source 2 can be a semi-porous barrier made from a high temperature material such as a ceramic (including but not limited to materials containing alumina, silicon carbide, zirconia) or sintered high temperature metal (including but not limited to tungsten, molybdenum, etc.). Oxygen or another oxidant or oxidant mixture (air) 24 can be passed through the interior of the heat source 2. A relatively small amount of the hydrocarbon reactant gas 6 can pass through the walls of the heat source 2 and reacts with the hydrocarbon 6 to produce heat for the heat source 2, thereby heating the walls of the heat source 2 to produce the temperature gradient. The combustion products can remain separate from the reactor volume and leave the reactor separately. This can help to avoid the need to separate the combustion products from the reaction products in a downstream separation unit.

Another important innovation as disclosed herein is the management of the large radiation heat transfer through the reactor design and the use of heat shielding. A particularly novel element of the designs disclosed herein is the use of the reactant itself as thermal insulation to prevent the reactor walls from reaching high temperatures near the heat source accomplished by the specific reactor geometries.

Figure 11:
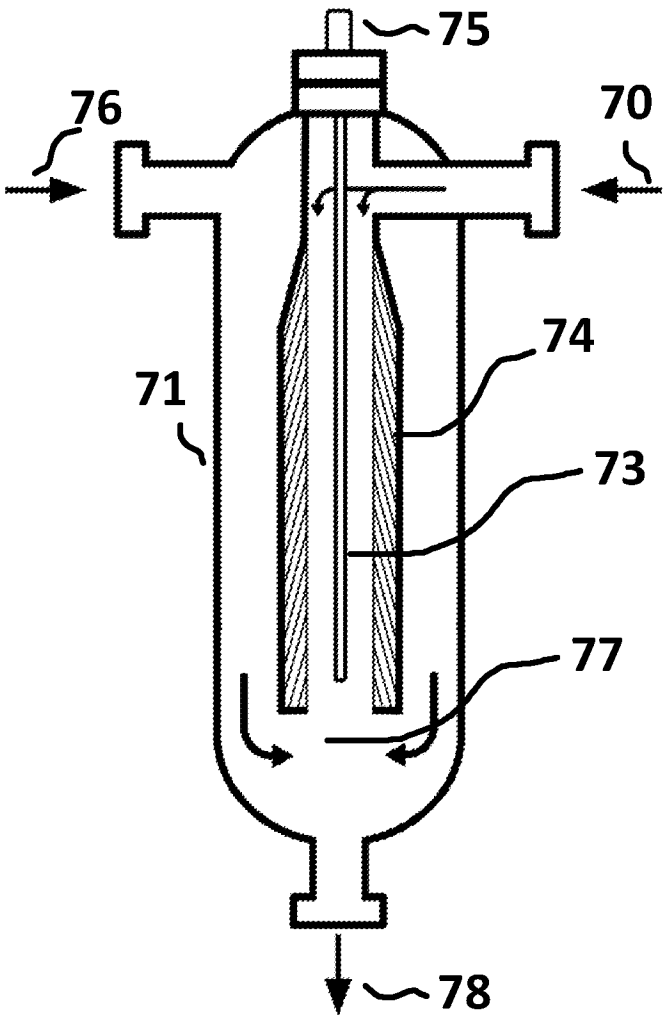
FIG. 11 schematically illustrates a reactor for reacting feedstock in a thermal gradient flow reactor and a central heat source with a quench of the high temperature products within the reactor.

Another embodiment of a reactor is shown in FIG. 11. In this embodiment, the reactor can be a pressure vessel 71 made of a metal including steel and/or nickel and their alloys that is maintained at a pressure preferably greater than about 10 bar. A hydrocarbon gas reactant can enter the reactor 71 as reactant stream 70, at a temperature of less than 900° C. The hydrocarbon gas can include any of those described herein. The reactant stream can be contacted at high velocity with a heat source 73 that is maintained at a temperature greater than 1500° C. In some aspects, the flow of the gas can be turbulent and be introduced at a Reynolds number of greater than 500. The heat source 73 can be the same as or similar to any of the heat sources described herein. The proximity to the high temperature heat source causes pyrolysis to occur producing hydrogen and solid carbon which remains suspended in the gas flow. The heat source can be maintained either by electricity or combustion of a fuel fed to the source 75. The high temperature reaction zone can be protected from the outer structural materials sustaining the reactor pressure by a heat shield and/or insulation 74, which does not support a pressure difference. An element of the reactor configuration is the introduction, within the reactor 71, of a quenching stream 76 separate from the reactants 70, which in FIG. 11 is a low temperature gas that is made to contact the high temperature gaseous product stream and mix in mixing zone 77, thereby lowering the temperature of the combined stream to allow for standard heat exchange with the product stream 78. The quenching stream 76 can enter the reactor and flow about a surface of the heat shield, thereby cooling the heat shield 74.

Figure 12:
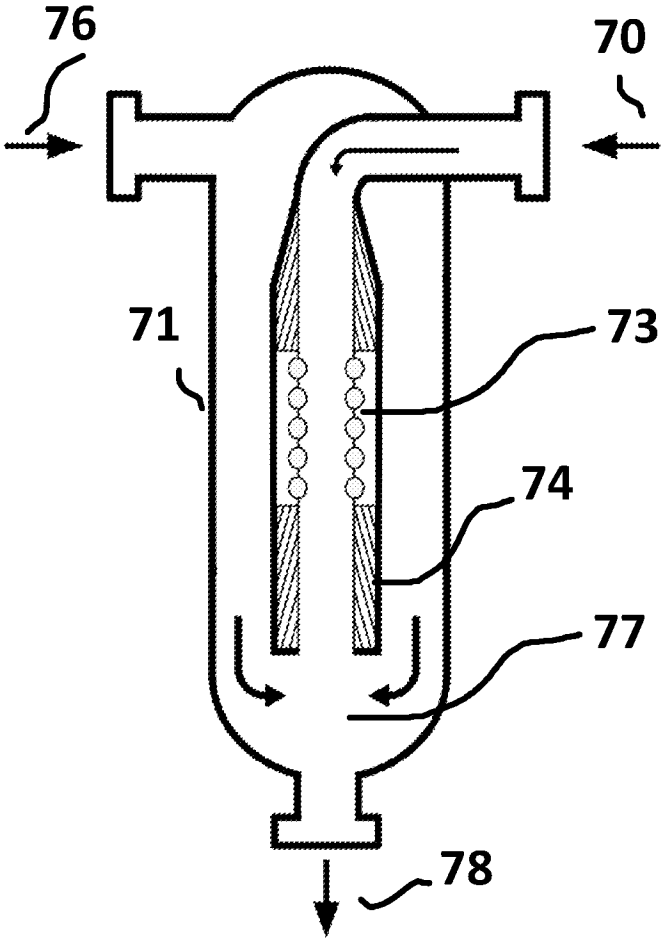
FIG. 12 schematically illustrates a reactor for reacting feedstock in a thermal gradient flow reactor and a peripheral heat source with a quench of the high temperature products within the reactor.

The heat source can be heated using electricity or combustion sources as described herein. The heat source can be designed to have the reactants flow over or near the surface of the heat source, or in a tubular configuration, through an interior of the tube to allow for direct and/or indirect energy transfer from the heat source. Whereas in FIG. 11 the high temperature source is represented as a coaxial tube, in another embodiment of the reactor shown in FIG. 12, the heat source is on the border 73 of the reaction zone. The heat sources as shown in FIGS. 10 and 11 can be in the form of rod or tube formed from a high melting point material. In some embodiments, the heat source can be formed from tungsten, molybdenum, and/or their carbides, and/or aluminum and/or zirconium oxides.

Figure 13B:
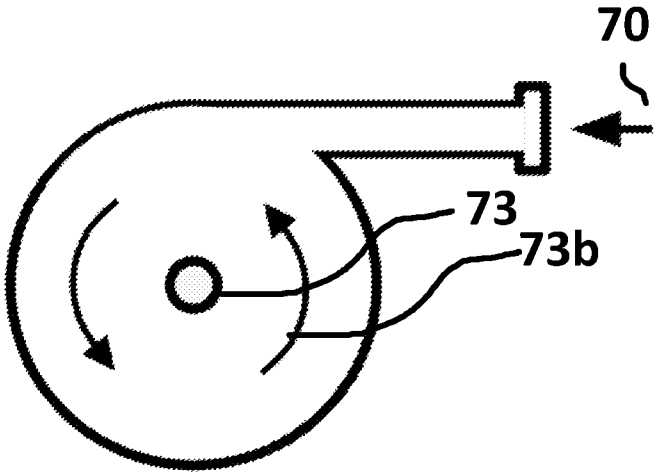
FIGS. 13A and 13B schematically illustrate a reactor for reacting feedstock in a thermal gradient flow reactor and a central heat source and a cyclonic flow field with a quench of the high temperature products within the reactor.
Figure 13A:
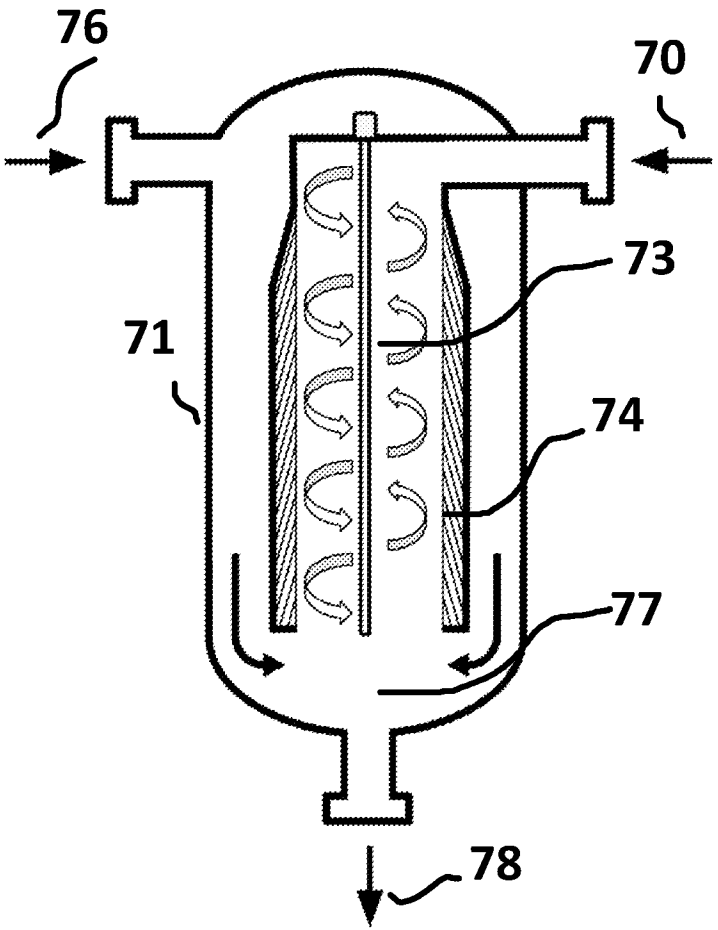

The higher molecular weight intermediates and carbon produced in pyrolysis are denser than the methane and have strong infrared absorbance. In another embodiment shown in FIG. 13A, the density difference can be used to move the strongly absorbing carbon particles to the periphery of a coaxial high temperature source 73. A cyclonic (vortex) flow field can be created by introduction the gaseous reactants 70 at high velocity at the periphery of the reaction zone causing the flow field to rotate and move the dense carbon towards the outer boundary as shown in FIG. 13B. The absorption of the blackbody radiation from the high temperature source 73 by the carbon can cause the solid particles to heat up and themselves serve as catalysts for additional pyrolysis. This, autocatalysis, whereby the solid carbon, heated by the radiation from the high temperature source itself facilitates the pyrolysis reaction is a new feature of this configuration. The autocatalysis can also occur in the absence of the cyclonic flow depicted in FIGS. 13A and 13B.

Figure 14B:
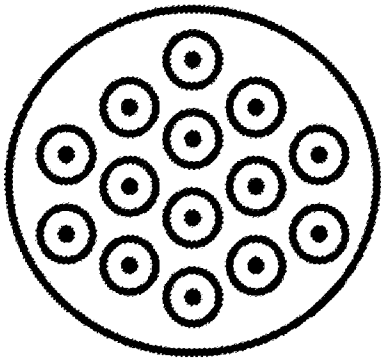
FIGS. 14A and 14B schematically illustrate a multizone reactor with multiple independent channels.
Figure 14A:
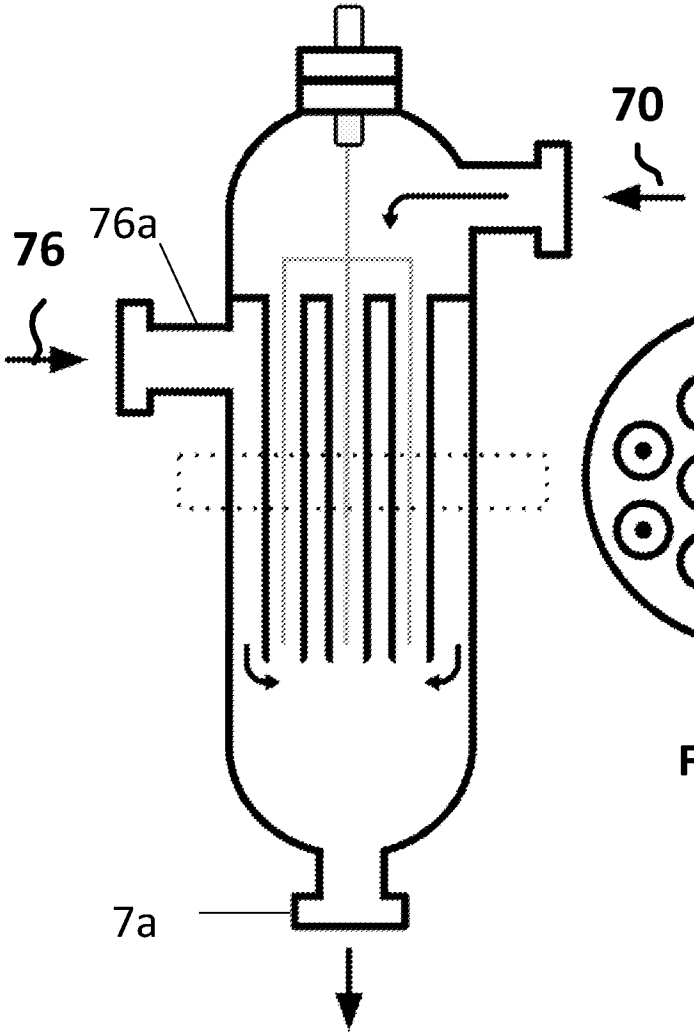
Figure 15:
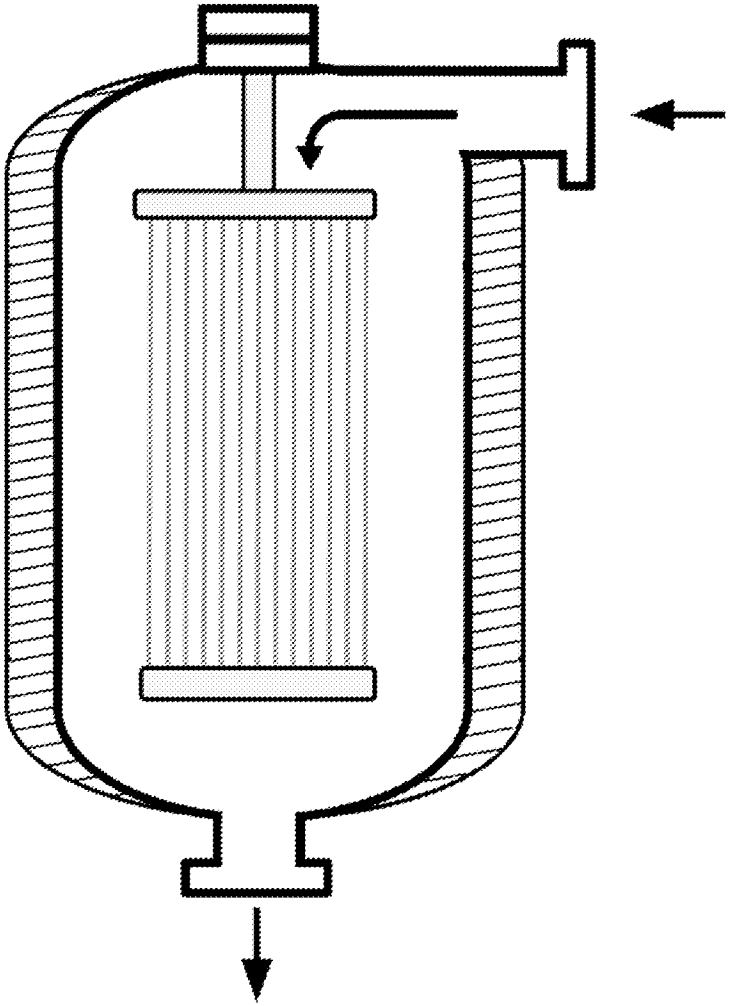
FIG. 15 schematically illustrates a multiple source non-isothermal reactor with multiple heat sources.

The descriptions of single reaction zone reactors are not meant to limit the reactor configurations to relatively small reactors. This skilled in the art with the benefit of this disclosure can realize how to extend the inventive features to larger systems. In FIGS. 14A and 14B, a scaled-up reactor with multiple independent high temperature reaction zones is shown schematically. Each has its own high temperature source and heat shielding. The combined outlets of all reaction zones are quenched at their outlet with the quench stream. In FIG. 15, a large pressure vessel is shown with a large number of high temperature sources that are contacted with the inlet gas stream. Due to the temperature gradient around each source the reaction is driven at high rates in the proximity of the source, however, the bulk temperature of the gas may not exceed the temperature limits of the pressure vessel.

Although a preferred application of the systems and methods disclosed herein is for the pyrolysis of high pressure natural gas from pipelines, the various embodiments disclosed herein can also be naturally suitable for management of hydrocarbon gases now flared and for relatively small sources of natural gas (stranded gas). In an embodiment, the gas source can be passed through the non-isothermal reactor system at a conversion of less than 100% and the products can be a mixture of solid carbon, hydrogen, and unconverted hydrocarbons. The product stream can then be passed into a solid-gas separator and the solid removed while the gas is used in an internal combustion powered generator or a fuel cell to produce electricity. The pyrolysis heat source can be powered either by a fraction of the electricity produced or by diverting a fraction of the product gas stream to combustion. The net result is electricity produced with far lower carbon dioxide emissions than would have resulted from direct use of the hydrocarbons.

Pyrolysis of gaseous hydrocarbon reactants is but one example of how the systems and methods disclosed herein can improve on existing chemical processes. Liquid reactants can similarly be processed and multi-phase products including gases and solids are also possible. In an example of a multi-phase process, a liquid reactant is heated in the temperature gradient, changing phase (possibly with reaction) to form a gas phase region around the high temperature heat source. Heat and mass transfer from the source, through the gas phase and into the liquid phase can all be controlled to maximize the production of the desired products while controlling the overall system conditions.

In an embodiment, a liquid hydrocarbon can be caused to flow concentrically around a coaxial high temperature heat source at a pressure of 1 to 100 bar. Contact with the heat source which is at a temperature above 1000° C. can vaporize the hydrocarbon and facilitate the pyrolysis reaction producing solid carbon and hydrogen gas at the pressure of the liquid.

Figure 16:
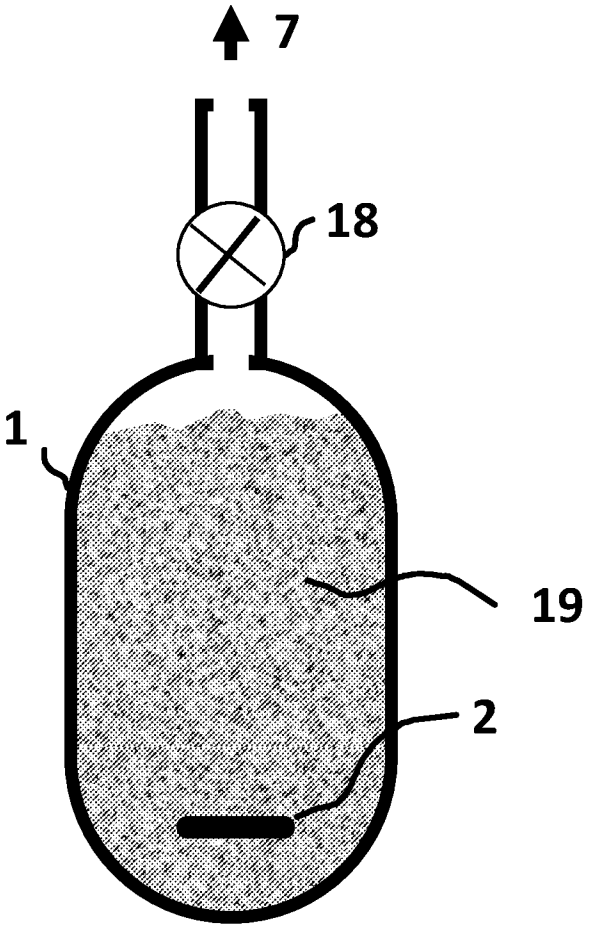
FIG. 16 schematically illustrates a liquid reactant filled reactor with a high temperature gradient source for vaporizing and reacting reactant in the high temperature gradient.

In another embodiment, reference is made to FIG. 16 whereby a pressure vessel 1 can be filled with a liquid reactant 19 at an initial pressure P. Facilities for transferring heat to the pressure vessel or liquid reactant may be included. The heat source 2 can generates a high surface temperature and large temperature gradient that can vaporize and cause the liquid reactant to react and form heated products, which can include gases which move upwards in the liquid away from the heat source 2 and exchange heat such that by the time the gases reach the surface they are in near thermal equilibrium with the liquid. Gas phase products 7 can be removed from the reactor pressure vessel 1, for example, using a pressure control valve 18 to regulate the pressure and flow. The high temperature heat source 2 can be maintained at such a temperature that there is an acceptable amount of residue deposited on the high temperature surface.

Figure 17:
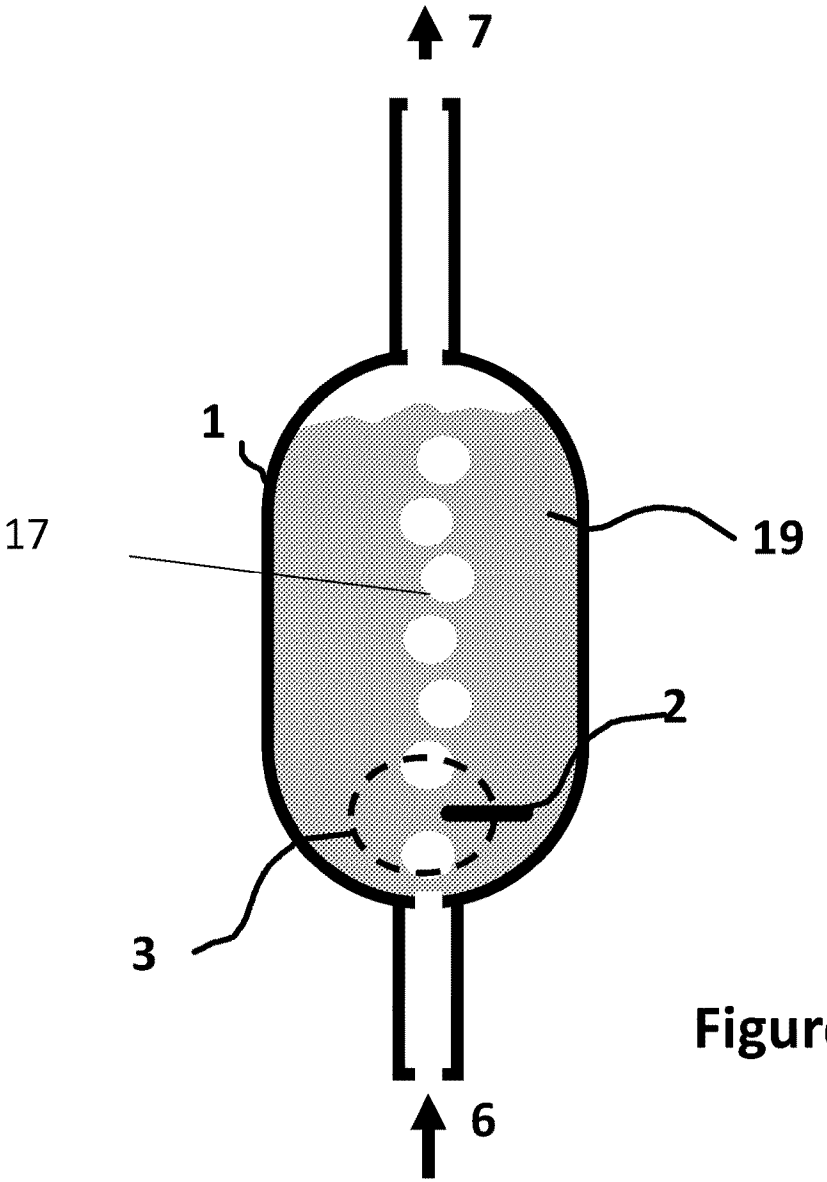
FIG. 17 schematically illustrates a reactor containing a liquid medium whereby the thermal and/or electrically conducting properties of the liquid are important for creating a high temperature gradient in which chemical reactions of reactants in gas bubbles passing into the high temperature zone are accelerated.

In another embodiment, a thermal gradient can be established within a reactor containing a electrically and/or thermally conducting liquid medium that does not participate chemically in the reaction but allows for the creation of the thermal gradient providing for very high reaction rates in localized high temperature zones. Such liquid media can include, but is not limited to, molten salts (including but not limited to NaCl, KCl, NaBr, KBr, and other metal halides, etc.) and molten metals (including but not limited to pure and alloy combinations including, Na, K, Li, Mg, Fe, Ni, Cu, Bi, Sn, Sb, Co, etc.). Reference is made to FIG. 17, which shows schematically a flow reactor 1, containing an electrically and/or thermally conducting liquid medium that does not participate chemically in the reaction. While not shown, a similar reactor configuration can be used as an unstirred batch reactor. In an embodiment, a hydrocarbon reactant gas can be introduced by a feed stream 6 as bubbles into the liquid 19 and pass into the very high temperature region 3 of the liquid where the heat facilitates the reaction. The gas bubble containing the products can then move out of the high temperature region 3 where the product gas bubble can be in cooler media and eventually leaves the liquid at the top to flow out of the reactor as product stream 7. By virtue of the localized high temperature region 3 created either by electrical current passing through the conducting medium or by contact with a localized high temperature heat source 2, very high local reaction rates are possible while the temperature gradient achieved either by limiting the time the heat source is on and/or by removing heat at another location allows the reactor materials to be maintained at much lower temperatures that the heat source. For example, a plurality of electrodes can be present in the liquid media and a voltage can be applied across the electrodes to generate the high temperatures due to resistive heating. In some aspects, the gas can be introduced through a tube or manifold that can act as one of the electrodes to generate the high heat at the reactant introduction location. In some aspects, the temperature gradient created can be greater than 10° C./cm, greater than 100° C./cm, or greater than 1000° C./cm. Heat can be removed from the reactor at a location distant from the high temperature region 3 within the reactor to allow the process to be operated in steady state.

Cooling the reactant gas or heat shield can also be done using a separate, non-reactive cooling fluid (liquid or gas). In one embodiment shown schematically in FIG. 18, the feed stream 6 enters the reactor pressure vessel 1 inside a separate reaction volume 5 and is contacted with the temperature gradient created by the heat source 2. Infrared heat is reflected from the reaction zone wall 3, which is coated with or made from an infrared reflecting material. A separate stream of coolant media 26 is made to enter the reactor system and move in contact with the reaction zone wall 3 to remove heat before passing out as a heated media 27. For example, the coolant media 26 can be present in a cooling jacket and/or the reaction volume can be present in a shell and tube exchanger configuration with coolant passing around the reaction volume 5. Products can leave the reactor 7 after reacting in the temperature gradient from one or more sources.

Figure 18:
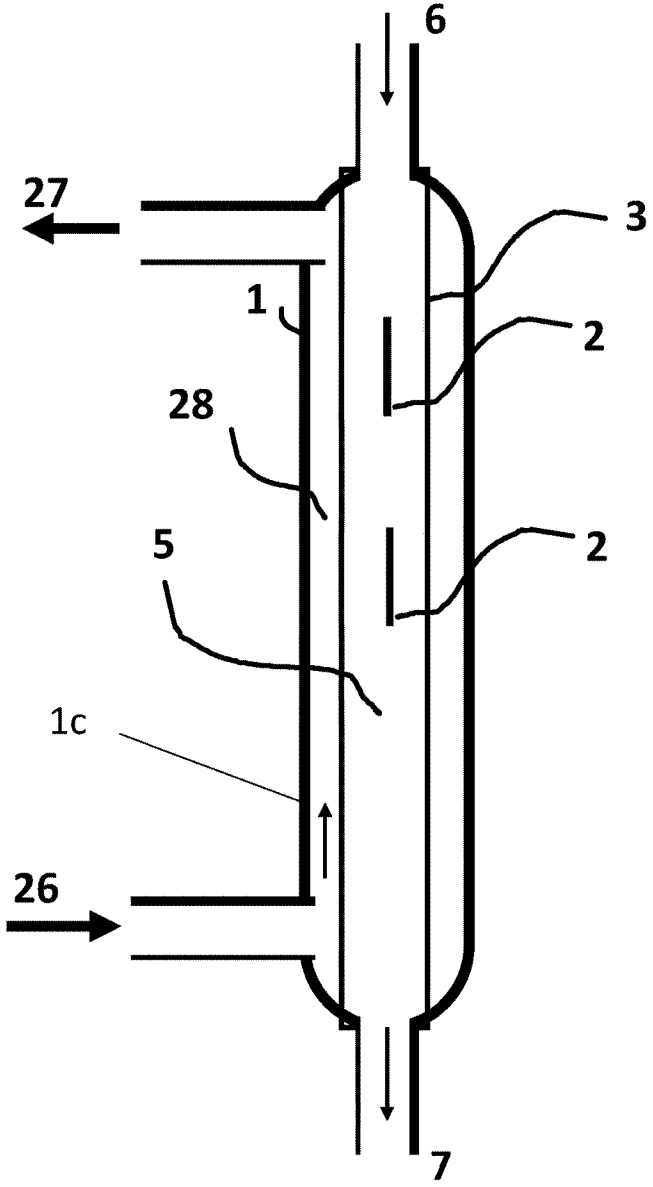
FIG. 18 schematically illustrates a reactor having multiple sources of heat and a cooling jacket disposed thereabout.

As also shown in FIG. 18, one or more sources can be used and placed separate in space to allow for temperature control of the surrounding materials. As shown in FIG. 18, the heat sources can be arranged serially along the flowpath. This configuration may allow for reaction followed by mixing within the gas stream. A second reaction zone can then be present adjacent the next heat source to allow for further reaction. Any number of heat sources can be present within the system.

Figure 19:
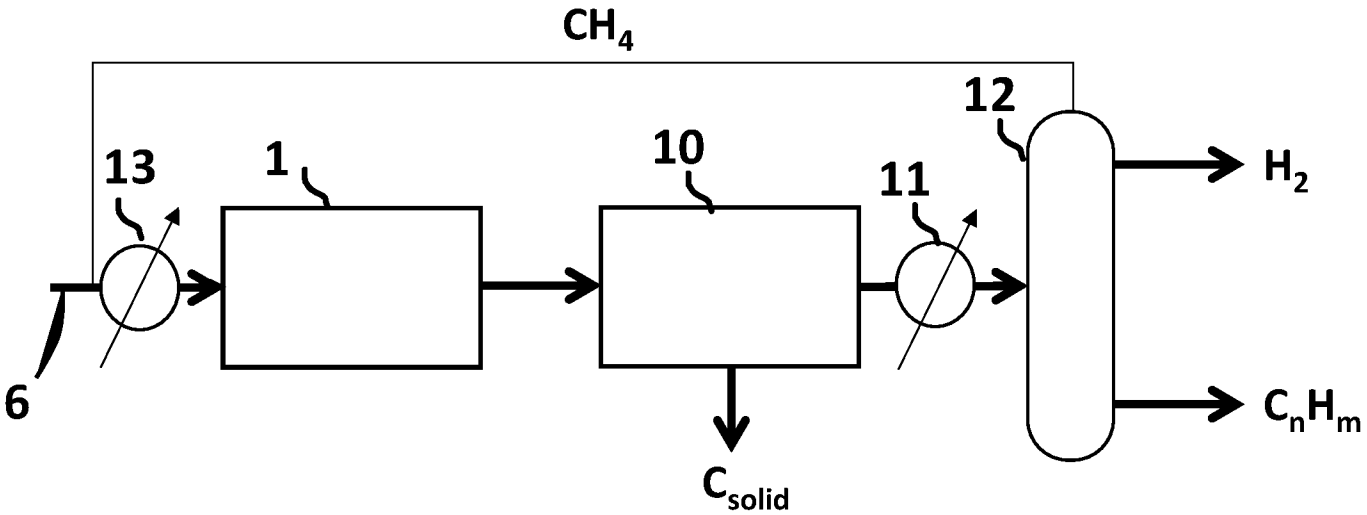
FIG. 19 schematically illustrates an integrated continuous process for the decomposition of methane using a thermal gradient reactor.

An important implementation and novel use of the systems and methods disclosed herein is for hydrocarbon pyrolysis. In an embodiment shown schematically in FIG. 19, an integrated process introduces a feed stream 6 comprising a gas phase hydrocarbon feed of predominately methane and pre-heats the feed stream 6 in a heat exchanger 13 before introducing the feed stream into a thermal gradient reactor 1. Within the reactor 1, the feed stream 6 can be heated and react to produce products comprising solid carbon, which remains suspended in the high velocity gas flow. The solid carbon can be separated in a separator 10 using solid-gas separation techniques and units such as cyclones and/or electrostatic precipitators. Then the gas stream can be cooled in an exchanger 11, and the components separated in separator 12 using such methods as adsorption and/or membranes. Unreacted methane may be returned to the reactor as a recycle stream. The major gaseous product, hydrogen, can be removed from the process together with any other hydrocarbon (which could be returned for decomposition with the recycled methane).

Solid carbon accumulation may generally be undesirable inside a flow reactor. and ideally all carbon produced can leave the reactor suspended in the gas phase products and unreacted reactants. An important distinction from prior systems is the design of the flow reactor system to maintain the solid product suspended within the reactant and product gas stream. Accommodation for this is in the flow design of the reactor which has a very high velocity in all sections of the reactor after reaching the hot reaction zone. In some aspects, the flow of the gas can be turbulent and be introduced at a Reynolds number of greater than 500. All surfaces can have an aerodynamic shape to avoid carbon build-up as part of the technology innovation. Further, because the hydrodynamic design is such to ensure high velocity, the reactor can be periodically cleaned to remove any accumulation by passing suspended solids (e.g., sand, particulates, etc.) to abrade off any accumulated carbon.

Figure 20C:
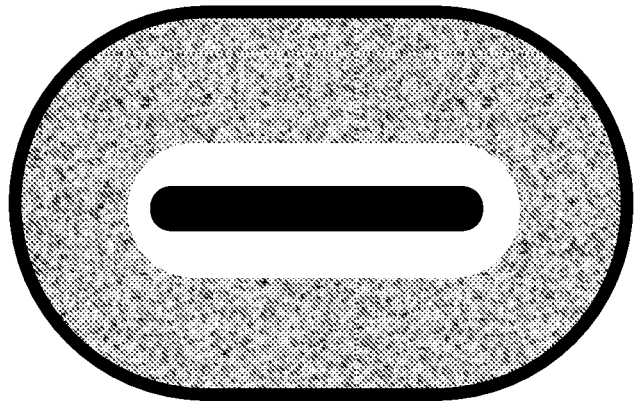
FIGS. 20A-20C schematically illustrate how a batch reactor can be used to accumulate carbon using repetitive operation of the thermal gradient heat source.
Figure 20B:
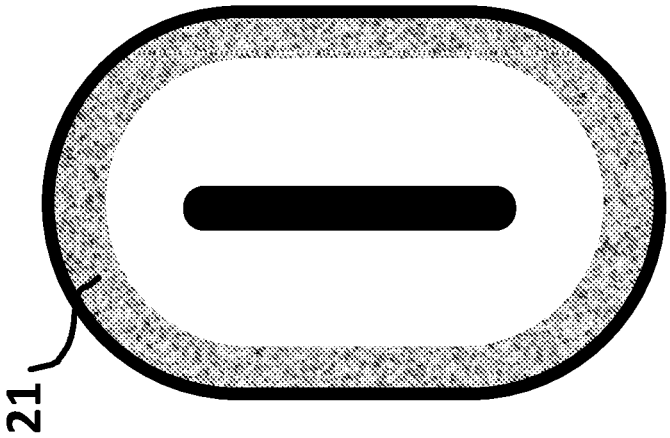
Figure 20A:
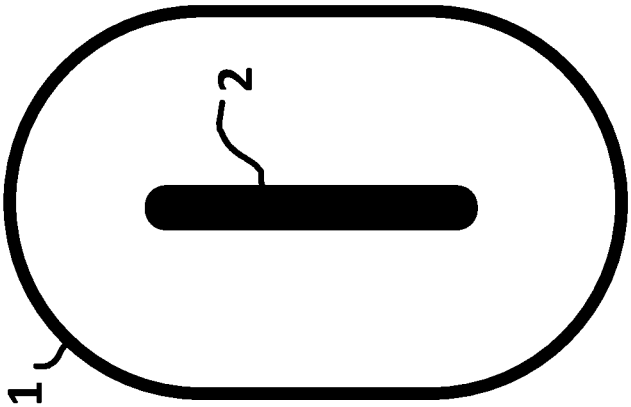

In some embodiments, solid carbon accumulation may be desirable in certain unmixed (batch reactor) configurations because technology already exists to remove the carbon efficiently and at low cost. In these embodiments, carbon can be allowed to accumulate as shown schematically in FIGS. 20A-20C. Initially, the pressure vessel 1 can be filled with methane at pressure. The heat source 2 can then be turned on to produce a thermal gradient whereby high temperature and a high reaction rate occurs near the heat source 2 to produce significant amounts of solid carbon 21, which can accumulate around the heat source 2. The heat source 2 can be cycled on for enough time to produce a desirable amount of product without raising the bulk temperature above a desirable value. By virtue of the very high temperature of the heat source 2, no solid carbon sticks or accumulates on the heat source 2 itself. The product gases can be vented from the reactor leaving behind solid carbon deposits. The reactor can then be refilled with reactant gas (methane) and the process repeated until there is a significant amount of solid carbon within the reactor volume. Once this occurs, the reactor can be opened and the carbon removed using the same methods employed in modern delayed cokers.

Within the embodiment illustrated in FIG. 20, the accumulated carbon can serve to insulate the walls of the reactor 1. As more carbon accumulates, the more the insulating effect will help to maintain the temperature of the walls of the reactor below the desired temperature, and the longer the heat source 2 can be cycled on. Thus, the operating parameters of the reactor may vary as the carbon accumulates and builds up on the reactor walls between carbon removal steps.

Figure 21:
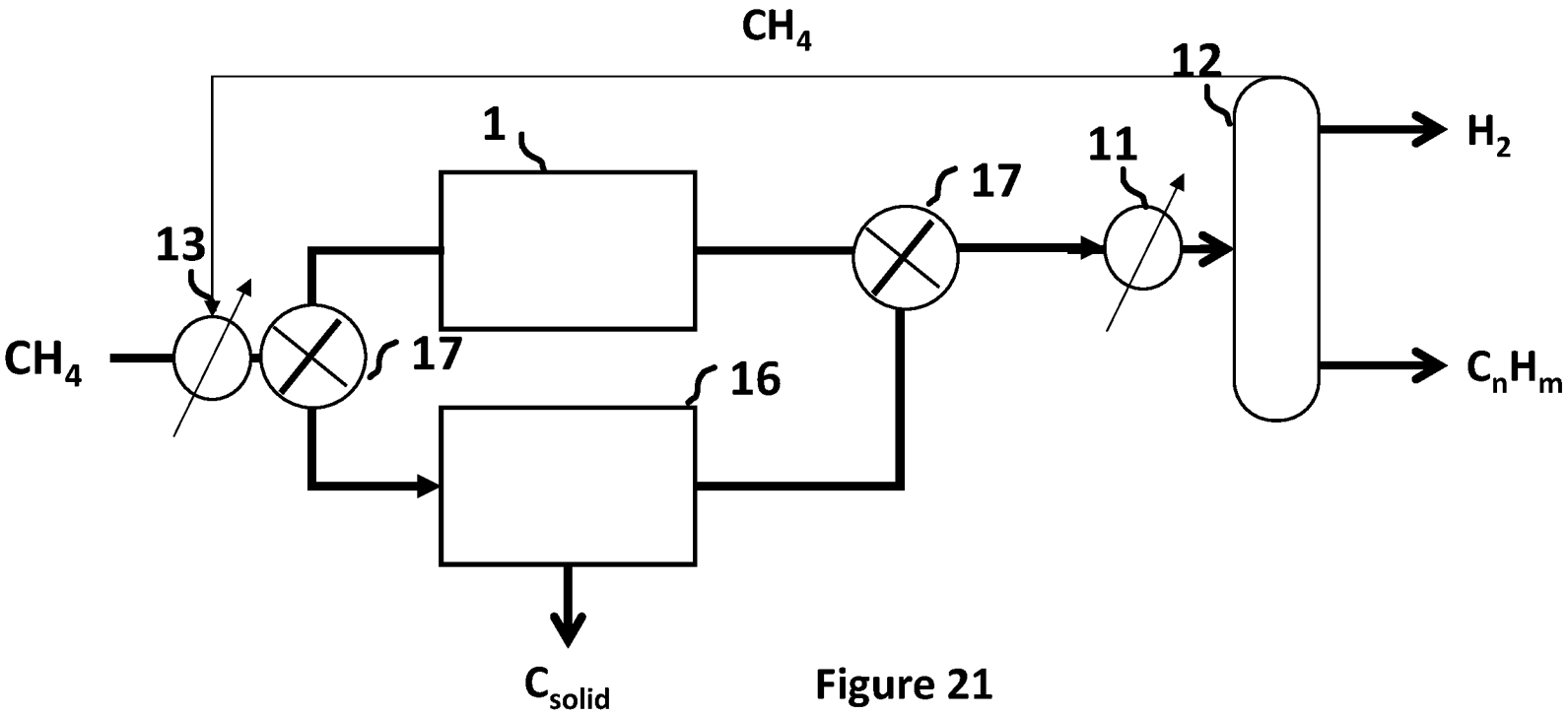
FIG. 21 schematically illustrates a semi-continuous process for the decomposition of methane or other hydrocarbon using an unmixed thermal gradient reactor.

FIG. 21, illustrates how two (or more) batch reactors 1 and 16, described above and by FIG. 20, can be integrated into a semi-continuous process whereby gas reactant can fill one reactor, be reacted to form solid carbon products which fill the reactor 1 over several fill cycles. Then using valves 17, the flow can be switched to the other reactor 16, which during the filling of reactor, 1 was emptied of carbon using such technologies as are deployed for solid removal in delayed coker refinery operations.

Figure 22:
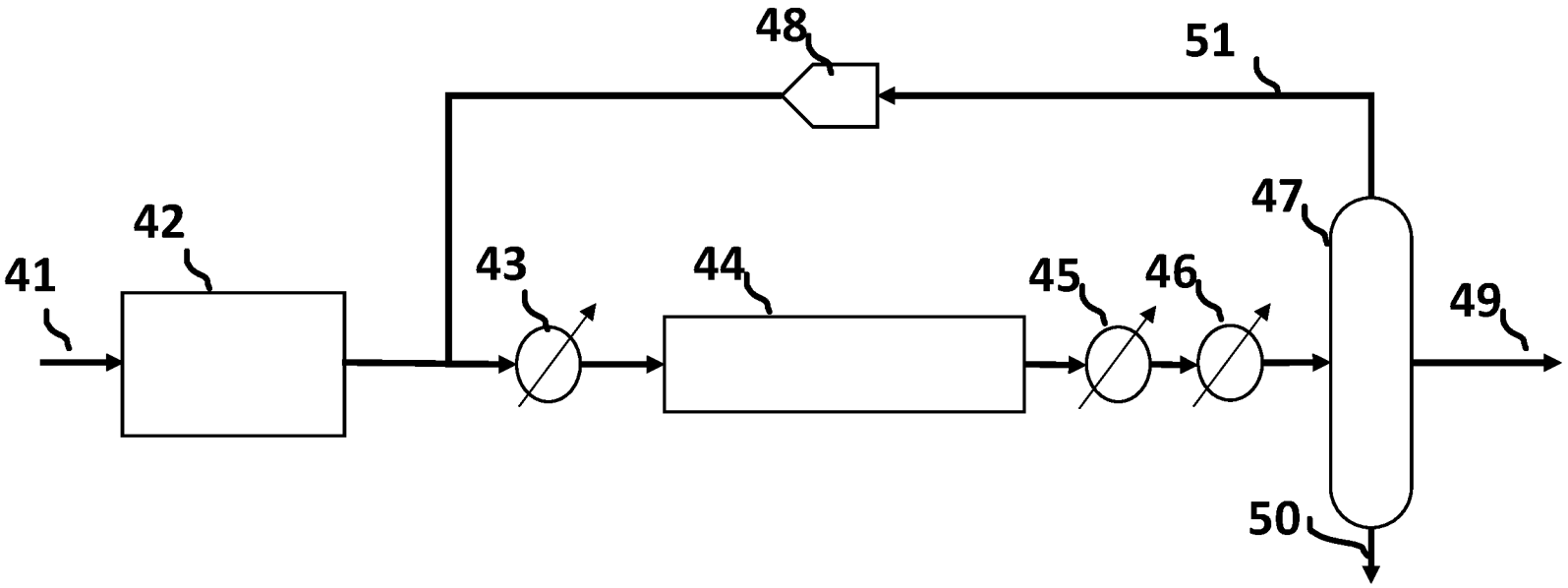
FIG. 22 schematically illustrates an integrated continuous process using a thermal gradient reactor.

FIG. 22 illustrates a basic configuration whereby chemical feedstock is introduced in stream 41, and preconditioned in a pre-treatment unit 42 to remove impurities and adjust conditions (e.g., temperature, pressure, etc.) to introduce the reactants into the reactor 44 possibly with recycled chemicals in stream 51 that are separated from the products 49,50. The reactants can be heated in a heat exchanger 43 and introduced into the thermal gradient reactor 44, described in more detail below, where chemical products are produced in high temperature gradients within the reactor 44. The products leaving the reactor may be quenched either internally or external to the reactor 44 by mixing with another cooler chemical in cooler 45, and then further cooled in a heat exchanger 46, which can be used to cool the products to allow separation in a separator 47 into final products in streams 49 and 50. After separation, unreacted chemicals and selected byproducts may be recycled in stream 51 and reintroduced after compression in compressor 48.

Figure 23:
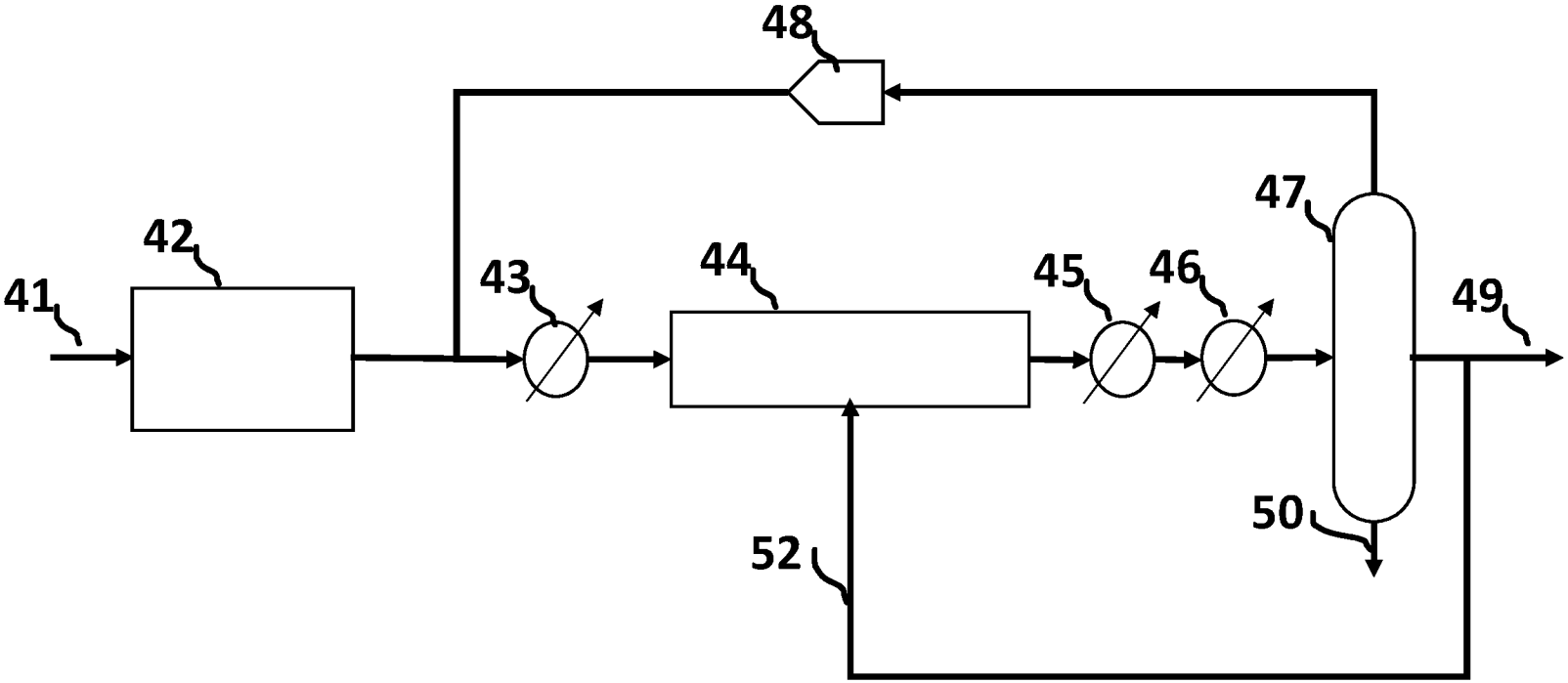
FIG. 23 schematically illustrates an integrated continuous process using a thermal gradient reactor with use of cooled product gas for cooling the high temperature region of the gradient reactor.

In some embodiments, a hydrocarbon gas 41 such as natural gas can be introduced into the process of FIG. 22, and standard pre-treatment 42 can be performed for delivering mostly methane, which can be mixed with recycled hydrocarbons 51, which can be compressed in compressor 48, and heated in a cross-heat exchanger 43 using the heat removed from cooling the product gases in heat exchanger 46, to a temperature between about 500° C. and about 900° C., or approximately 600° C. The reactor 44 can be configured using any of the configurations disclosed herein. In some embodiments, the light alkane gas stream 41 comprised of mostly methane can be introduced into a stainless-steel adiabatic pressure vessel reactor lined with ceramic where it can be contacted with a localized heat source thermally isolated from the pressure vessel walls and maintained at a surface temperature of greater than 1500° C. Within the very high temperature zone the heat source can deliver energy to the reactants through a combination of: i) convection, ii) radiation, and iii) injection of energetic chemical species including methyl radicals from dissociation processes on the hot surface. The combination of these energy transfer processes can drive the reaction to high conversion in the region around the heat source and serve as an aspect of the disclosed methods and systems heretofore unrealized. The products can consist of solid particulate carbon suspended in the product gas, which can be primarily hydrogen and unreacted hydrocarbons such as methane. The reactant gases not near the heat source may not be heated to a sufficient reaction temperature and can remain unreacted. Prior to leaving the reactor 44, the cooler unreacted reactants can mix with the higher temperature gases near the localized heat source and cool the gas/solid suspended mixture to a temperature of less than 900° C. The product mixture can have an excess of hydrogen, which limits coking on the reactor walls as the product stream leave the reactor at the outlet. The product stream may be further cooled by injecting recycled cooled gas 52 into the reactor 44 and/or from the heat exchanger 46 into the product stream in the cooler 45, as shown in FIG. 23. Between heat exchangers 45 and 46 some of the solid carbon may be removed in a cyclone or other standard unit before cooling the stream for final separation. The separation system 47 can comprise a gas-solid separation subsystem utilizing cyclones, bag filters, and/or electrostatic precipitation units well known to those skilled in the art for particulate and/or carbon removal to produce a carbon product 50 followed by gas separation utilizing an adsorption bed and/or distillation to provide an outlet stream of hydrogen 49, and removal or recycling unreacted methane and other hydrocarbons in recycle stream 51.

In another embodiment for natural gas pyrolysis shown schematically in FIG. 23, a fraction of the cooled hydrogen product can be recycled in stream 52 to the reactor 44 and used to internally quench (e.g., lower the temperature) of the product stream leaving the vicinity of the hot source. This can provide increased process efficiency and reduce downstream coking. The stream may also be introduced upstream, at, or downstream of the intermediate heat exchanger 46.

An important continuous process option is thereby made possible and disclosed herein, whereby, in the process shown in FIG. 23 for methane pyrolysis the high temperature stream is heated with electricity and following reaction the stream is quenched with cooled hydrogen to reduce the temperature, the still hot combined stream leaves the reactor and itself is further cooled to generate steam for a steam turbine used to produce a large fraction of the power used for the electrical heater.

Figure 24:
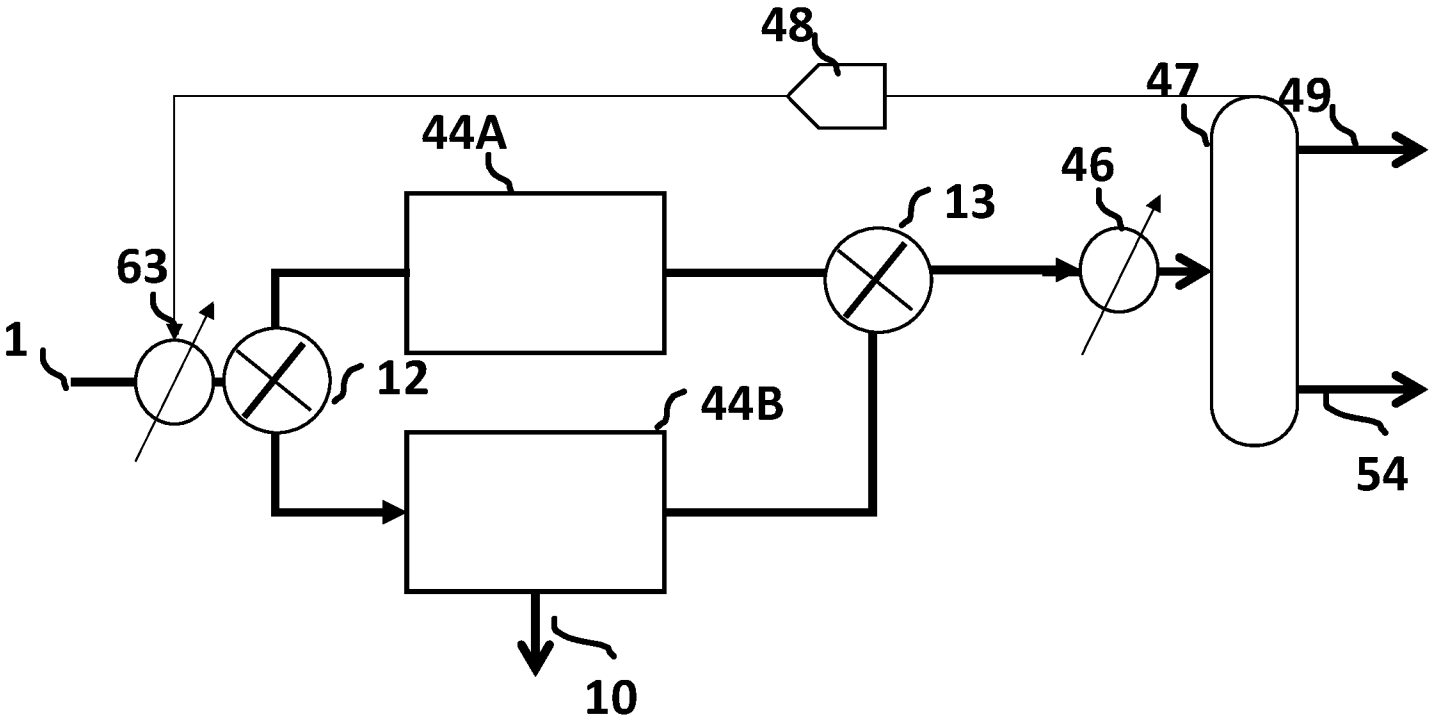
FIG. 24 schematically illustrates a semi-continuous process using a thermal gradient reactor.

Although continuous processes are often desirable, semi-continuous operation may find important applications whereby the solid product produced in the high temperature gradient reactor remains in the reactor for later removal, and only gas phase products leave the reactor. FIG. 24 shows schematically a process whereby reactants enter the system in stream 1, and the reactants may be mixed and conditioned with recycled gases in stream 63. The reactants can include any of those described herein such as a hydrocarbon stream (e.g., natural gas, etc.). The mixed stream can then be directed through a valve 12 to a batch reactor 44A, 44B containing a localized heat source where gas and solid products are produced. The solid products can accumulate in the reactor 44, and the gas phase products can be periodically removed from the reactor through a valve 13 and cooled in cooler 46 before being separated in separator 47. Within the separator 47, the products can produce product streams 49 and 54 with potentially a recycle stream that can be compressed in compressor 48 before passing back to upstream of the reactor 44A or 44B.

Figure 25:
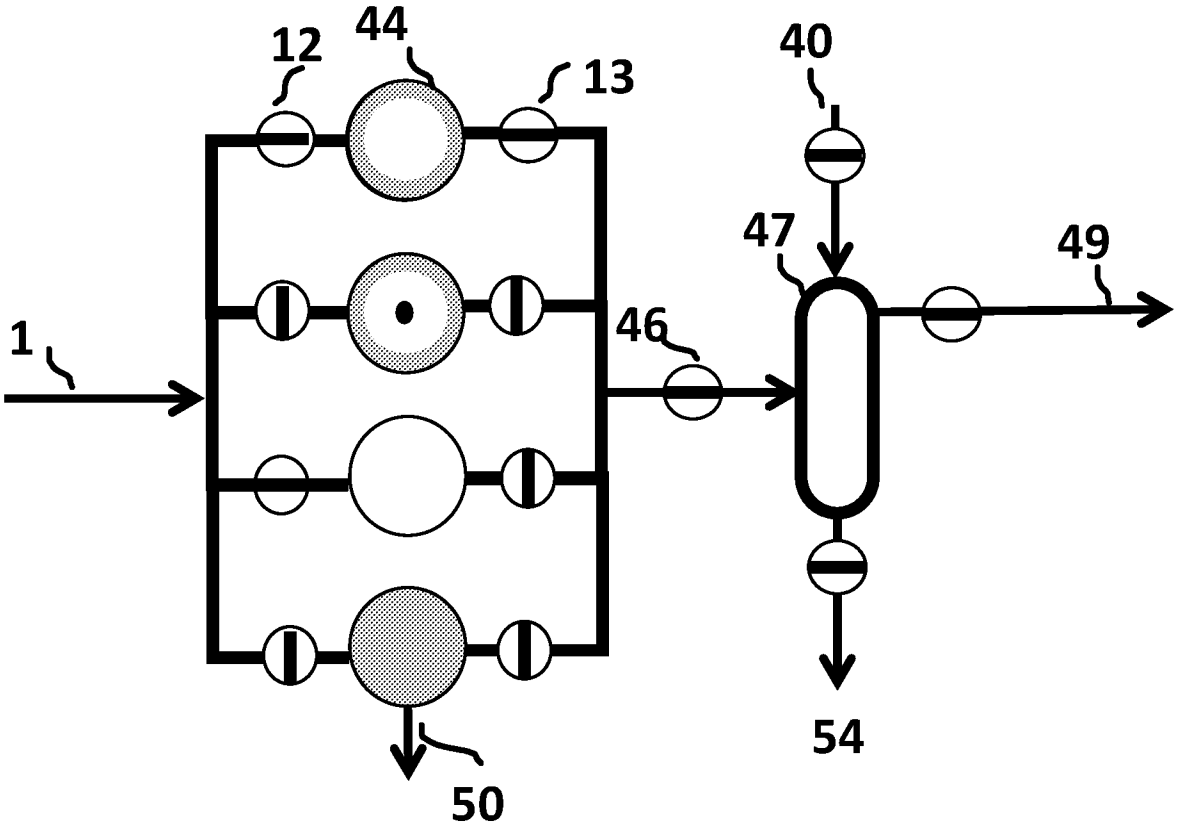
FIG. 25 schematically illustrates a semi-continuous process for the decomposition of methane from a natural gas pipeline to reinject hydrogen enriched methane back into the pipeline.

An embodiment for natural gas pipeline enrichment is shown schematically in FIG. 25 whereby a high pressure stream 1 of natural gas from a pipeline can be introduced into the system at a pressure of greater than about 20 bar and a temperature of less than about 100° C. and directed by a valve 12 into a reactor containing a localized heat source at a temperature greater than 1500° C. The reaction can occur to produce mostly hydrogen and solid carbon. After reacting, the reactor 44 can be allowed to pass any remaining gas through an exit valve 13, leaving behind the solid carbon within the reactor 44. The gas can pass through a separation system 47, such as an adsorption bed that can retain all products except hydrogen and methane, which can be directed back to the pipeline through stream 49. The reactor can be periodically refilled with natural gas and the cycle repeated until sufficient solid carbon has accumulated to require removal as a solid carbon product 50. There can be a plurality of parallel reactors in operation to produce a semi-continuous process and allow a nearly continuous product stream 49 to be produced by cycling the reactors using the valve network. While four reactors are shown in FIG. 25, fewer than 44 reactors or more than 4 reactors can be used in the reactor system configurations. An embodiment and application of the processes and systems disclosed herein include the decomposition of hydrocarbons including methane into products comprising hydrogen and solid carbon. Methane pyrolysis is the process for decomposing methane into hydrogen and solid carbon. The reaction is endothermic and equilibrium limited. For the highest methane conversion at commercially reasonable pressures for hydrogen production, thermodynamics require that the reaction be performed at high temperatures. The higher the pressure, the higher the temperature required for acceptable conversion. For conversion of over 70% at 20 bar, temperatures greater than 1000° C. are needed, and to achieve such temperatures, heat sources at even higher temperatures are required.

Figure 26:
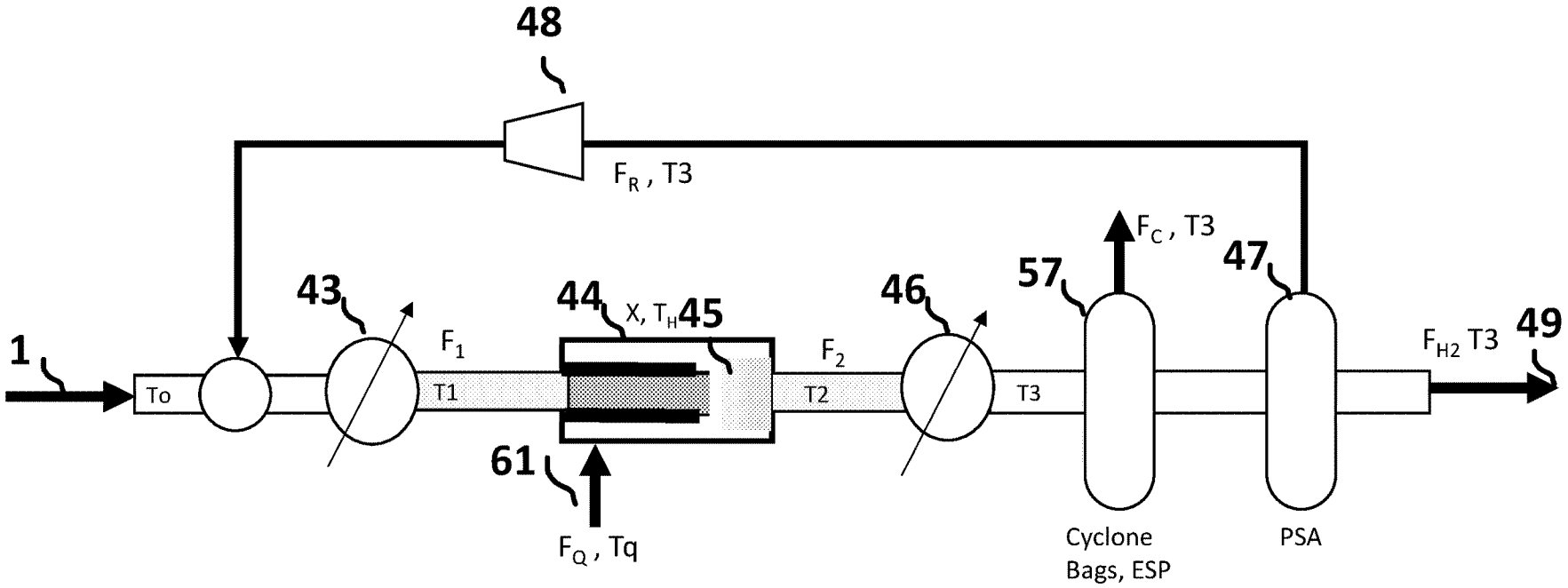
FIG. 26 schematically illustrates the process for reacting feedstock in a thermal gradient flow reactor with a quench of the high temperature products within the reactor.

In some embodiments, the system shown in FIG. 26 can be used for the pyrolysis of natural gas to produce gaseous hydrogen and suspended solid carbon. The gaseous reactants can enter the process in stream 1, at a preferred pressure of greater than about 10 bar, and may be combined with recycled reactant that is pressurized to the same inlet pressure by compressor 48. The reactants can be preheated to approximately 600° C. in a heat exchanger 43 that recovers at least some of the heat from cooling the products in cooler 46, where the exchangers 43, 46 can be heat integrated directly or through the use of a heat transfer fluid. After being heated, the reactants can enter a non-isothermal reactor 44, where the reactants can be exposed to a heat source at a temperature greater than 1500° C., which facilitates the pyrolysis reaction. An element of this configuration can include using anon-isothermal reactor configuration such that the high temperature stream is never in direct contact with the reactor structural elements. Within the reactor 44, a low temperature quenching stream can be contacted with the high temperature stream leaving the reaction zone. The quenching stream for pyrolysis can be hydrogen at a temperature of less than about 200° C., in another embodiment the quenching stream can be cooled using natural gas or methane, and in another embodiment, liquid water can be sprayed into the high temperature stream as a quench. Any combination of a hydrogen stream, hydrocarbon stream, and/or water stream is also envisioned.

Because pyrolysis produces primarily carbon, removal of the carbon suspended in the gas flow is important. In an embodiment, the suspension of carbon in gaseous products exits the reactor at a temperature of less than 900° C. The stream can be cooled and the carbon separated from the gas phase stream using existing technologies. It is anticipated that there will be a small fraction of carbon residue that is retained within the reactor system and builds up over time. Another important novel aspect of the configurations disclosed herein is the addition of a feature for cleaning the deposits without disassembling the reactor. In some embodiments, the reactor system can be cleaned using an inert feed at higher velocity than is typically used during reaction and the suspension in the inert feed abrasive particles (sand) which, as the suspended abrasives pass through the reactor, will remove carbon residue and pass it out to the solid-gas separation systems.

Figure 27:
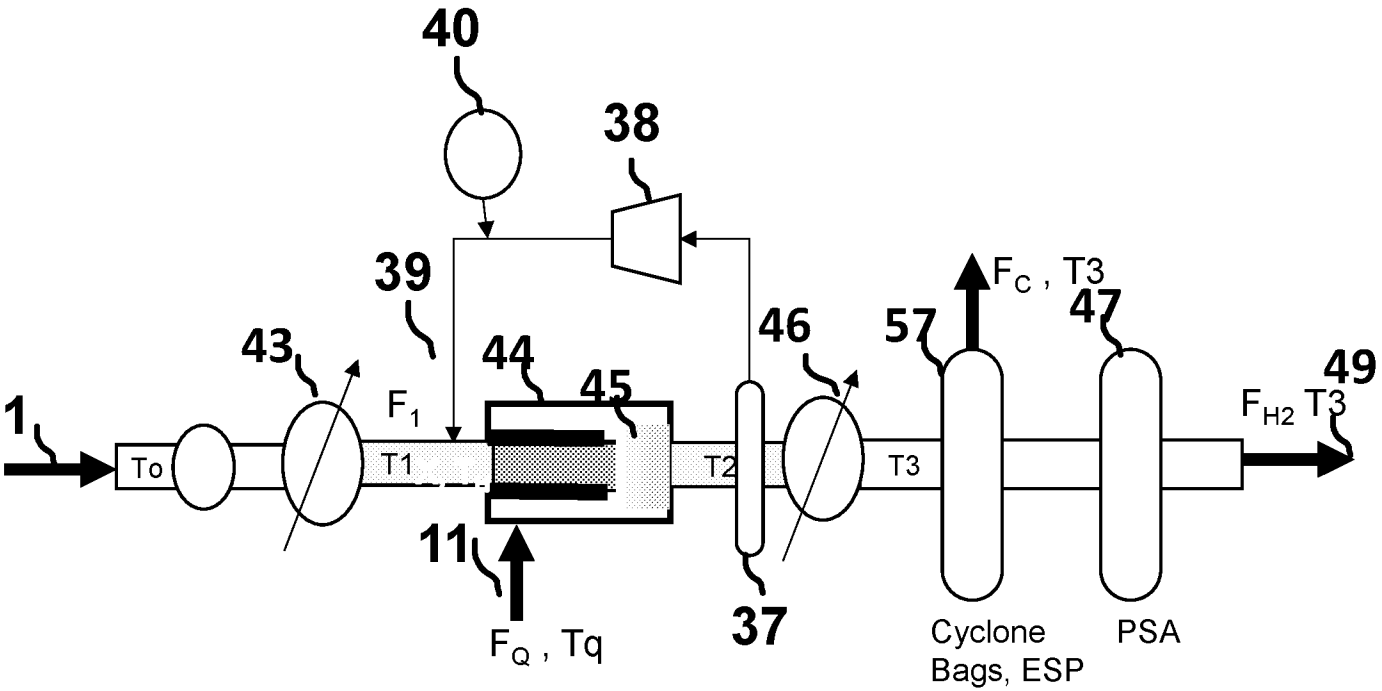
FIG. 27 schematically illustrates an integrated continuous process using a thermal gradient reactor with a means of recycling suspended solids either for cleaning out residual carbon or as a means of adding an infrared absorber.

In another embodiment of the process shown schematically in FIG. 27. Solid particulates are added to the reactor input in particulate stream 39, where the particulates can be suspended in a carrier gas to serve either or both of two purposes. The particles can be separated from the product stream in separator 37 and recycled in a gas carrier stream through the compressor 38. In one case, during reactor operation in pyrolysis with a high temperature heat source, infrared absorbing particles, for example carbon, can be added to the input stream to provide infrared absorption capacity to the bulk gas surrounding the high temperature heat source. The particles can be heated in the infrared from the heat source and serve as additional sites of pyrolysis in the reaction zone. In another case, for periodic maintenance, abrasive particulates such as sand, alumina, etc can be circulated in a gas flow (generally an inert such as nitrogen) at high velocity to abrade off any residual carbon build-up within the reactor. Particulates can be stored 40 for regulated injection, and can be removed from the product stream with a separation system such as a cyclone 57. Gas can be used to suspend the particles and move them through the reactor at the desired flow velocity.

EXAMPLES

The disclosure having been generally described, the following examples are given as particular embodiments of the disclosure and to demonstrate the practice and advantages thereof. It is understood that the examples are given by way of illustration and are not intended to limit the specification or the claims in any manner.

Example 1

Methane Pyrolysis in an Unmixed Thermal Gradient Reactor

Figure 29:
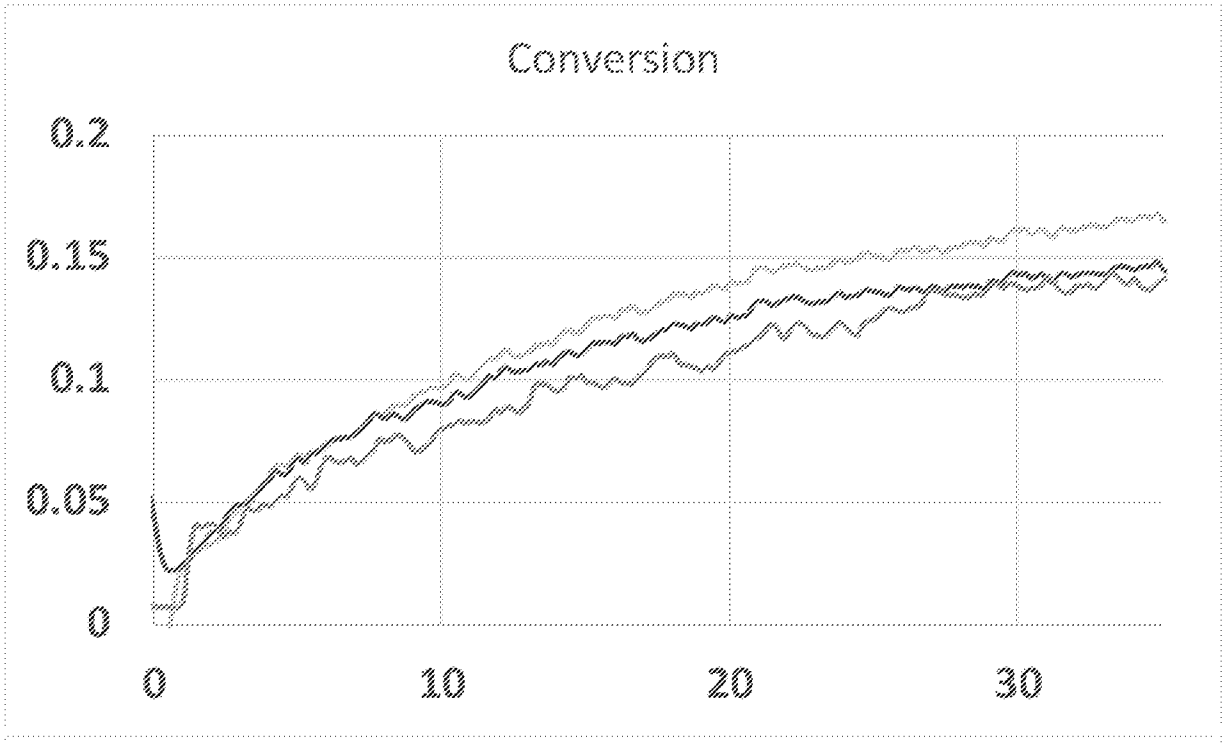
FIG. 29 data described in Example 1 of methane pyrolysis in a temperature gradient reactor.

In a specific example, methane is converted into hydrogen and carbon in the laboratory configuration shown FIG. 28. The 75 ml reactor contains 3.3 mMoles of methane at STP. A 14 mm tungsten wire 0.25 mm (SA=10 $mm^2$) in diameter is at the center and heated electrically. The wire surface was maintained at approximately 2500° C. and was not observed to accumulate any deposited carbon. The reactor was inserted into a container of water at room temperature. The pressure of the reactor was monitored and compared to control experiments with Argon in the reactor to correct for the pressure increase due to heating. In FIG. 29 the methane conversion measured in three different trials is plotted versus time. In approximately 10 seconds the conversion was 10% for an overall volume averaged reaction rate of 0.4 moles/$m^3$-s. Considering the very low surface area of the wire, the reaction is not catalytic on the wire surface, rather thermally driven in the vicinity of the wire. In the presence of the methane, in time the tungsten wire is transformed into tungsten carbide which remains as a stable heat source.

Example 2

Methane Pyrolysis in a Flow Reactor

Figure 30:
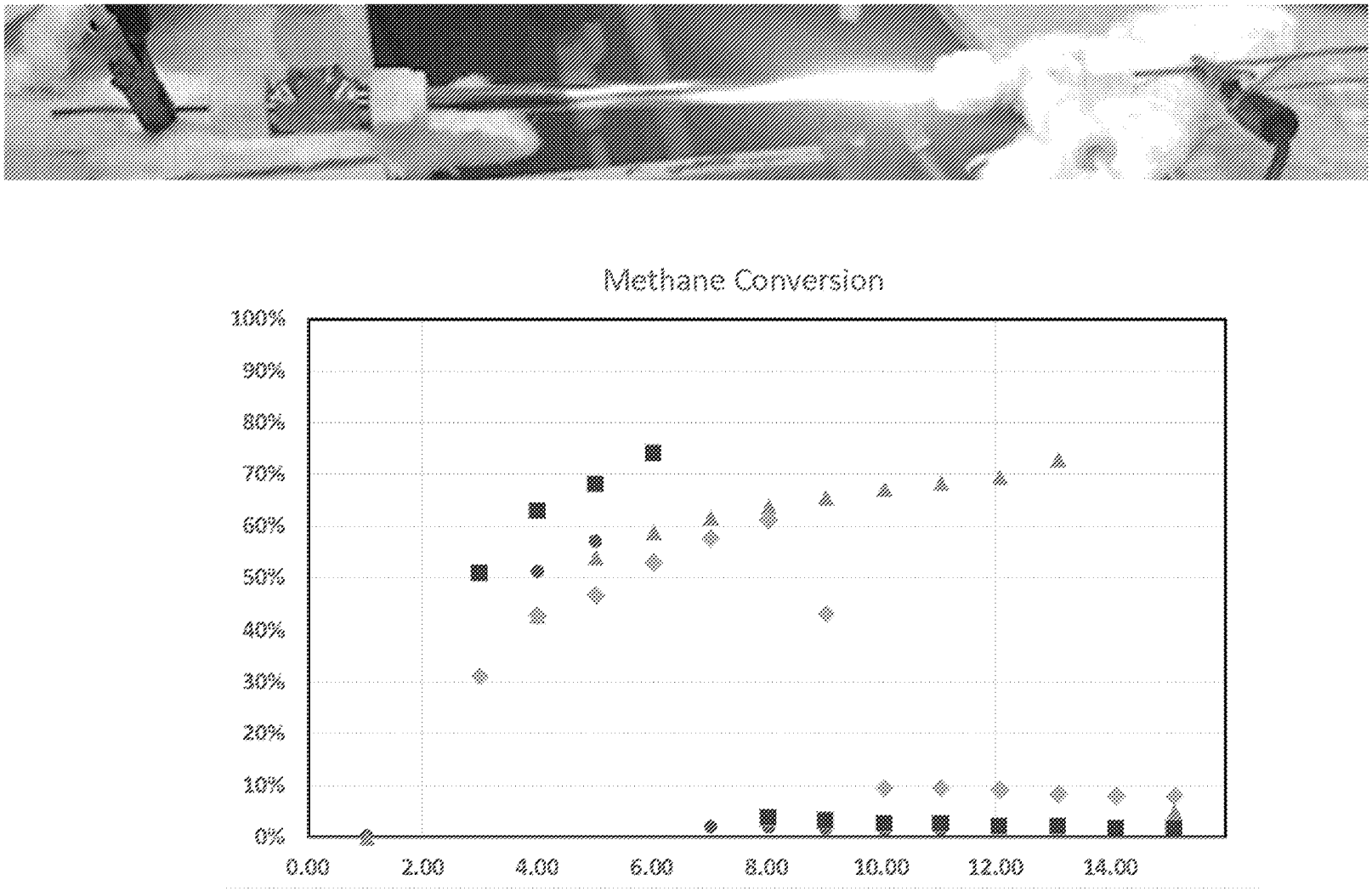
FIG. 30 photographs and data described in Example 2 of methane pyrolysis in a temperature gradient flow reactor.

In another specific example, methane is converted into hydrogen and carbon in a flow reactor similar to the concept of FIG. 4 the laboratory configuration is shown in FIG. 30. The reactor is a 0.25 inch diameter quartz tube with a 9 cm tungsten filament heated electrically to approximately 2400 C in the center and a reaction volume of 1.2 ml. The gas residence time at 5 ml/sec methane flow rate was less than 0.24 seconds. FIG. 30 shows the methane conversion as a function of time when the filament power was turned on (t=1 sec) then turned off. The conversion is seen to rise to over 50% in all cases. The volumetric reaction rate was approximately 29 moles/$m^3$-s. In the presence of the methane, in time the tungsten wire is transformed into tungsten carbide which remains as a stable heat source.

Example 3

Methane Pyrolysis in a Flow Reactor

Figure 31:
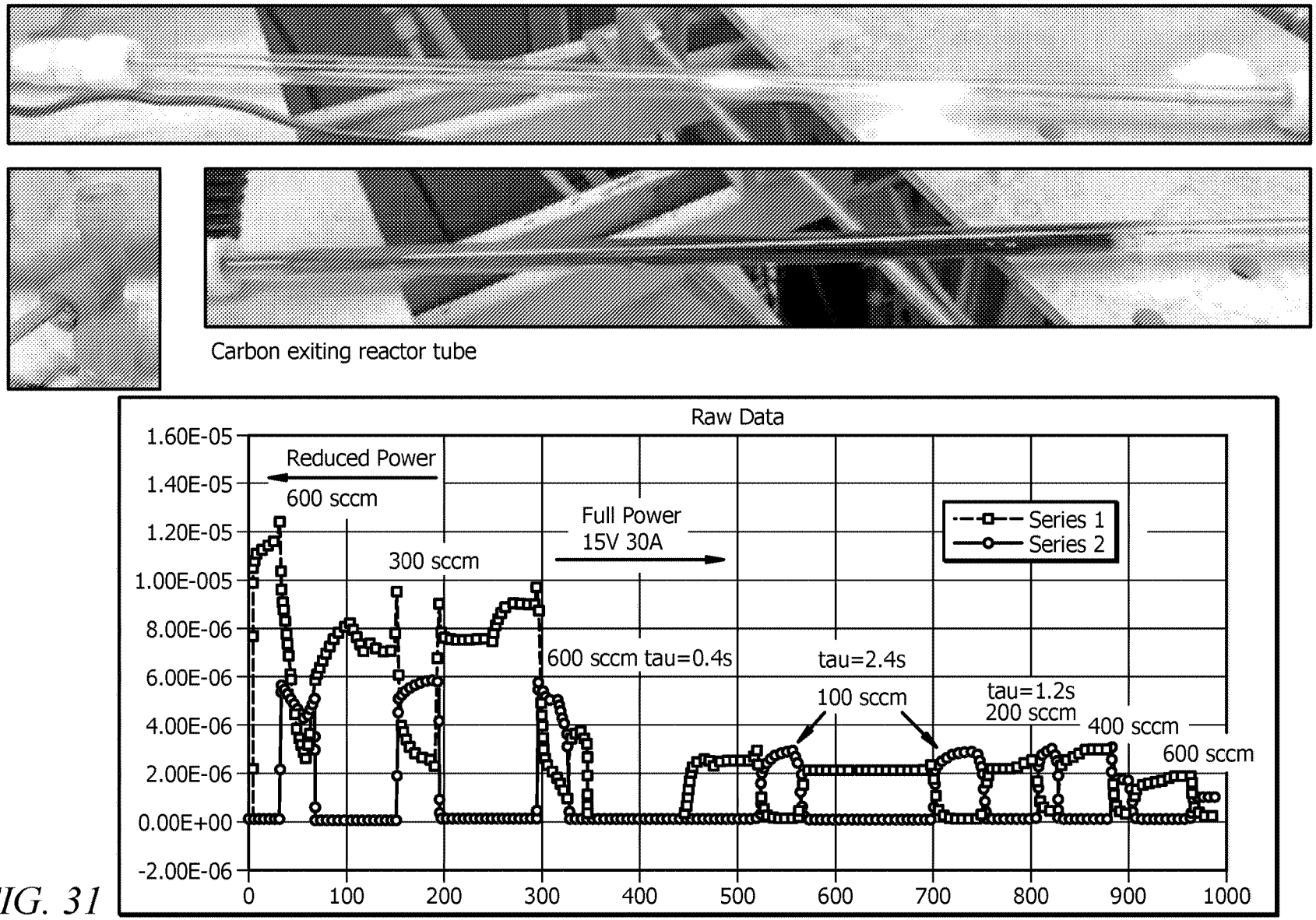
FIG. 31 photographs and data described in Example 3 of methane pyrolysis in a temperature gradient flow reactor.

In another specific example, methane is converted into hydrogen and carbon in a flow reactor of larger diameter than Example 2. A 0.38 inch diameter quartz tube reactor with a reaction volume of 4 ml with a 10 cm tungsten filament heated electrically to approximately 2400° C. in the center. The methane residence time was varied between 0.4 and 2.4 seconds by changing the flow rates. FIG. 31 shows a photograph of the reactor and the methane and hydrogen signals as measured by the mass spectrometer. Each time the filament power was turned on the hydrogen signal is seen to rise and the methane signal falls. The filament power was increased after the first two runs. Large quantities of solid carbon were observed to flow out of the reactor as seen in the photograph. In the presence of the methane, in time the tungsten wire is transformed into tungsten carbide which remains as a stable heat source.

Example 4

Liquid Hexane Pyrolysis in Batch Reactor

In another example, a 200 ml 316 stainless steel reactor is filled to 180 ml with liquid hexane at 30° C., as shown schematically in FIG. 16. The reactor has a single outlet of ½ inch OD 316 stainless steel tubing. Near the base of the reactor a tungsten carbide filament heat source, 1 mm in diameter and 5 mm in length is electrically heated to a surface temperature of approximately 2000° C. In the vicinity of the filament when the heat source was turned on hexane vaporized and reacts to form carbon and hydrogen which are transported away from the heat source upwards in a rising gas bubble, unreacted hexane condenses such that by the time the bubble reaches the surface only hydrogen remains in the gas phase and the solid carbon remains suspended accumulating in the liquid. A pressure relief valve at the reactor exit maintains a pressure of 10 bar on the reactor. In an extension of this example some amount of methane can be dissolved in the hexane.

Example 5

Pyrolysis in Thermal Gradient in Molten Salt

Figure 32:
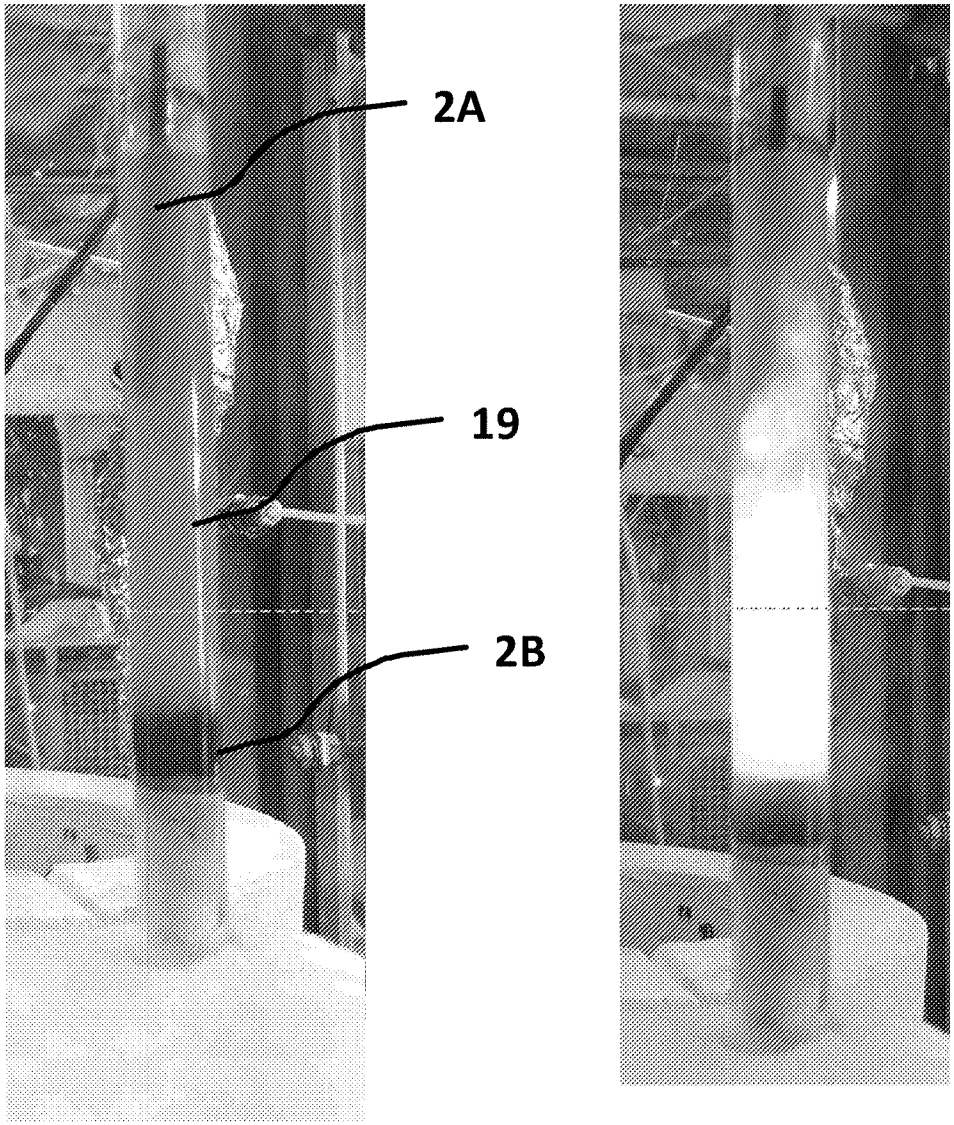
FIG. 32 three photographs of the experimental reactor containing conducting molten salt described herein (Example 5) in operation using a high temperature gradient to convert methane to solid carbon and hydrogen gas with thermal gradient in molten salt.

In another example, shown schematically in FIG. 17 with photographs of the experiment shown in FIG. 32. The reaction was performed in a 1 inch quartz reactor filled with a eutectic mixture of NaKCl where heating was performed by passing AC electrical current through the salt from carbon electrodes 2A and 2B. Methane was passed at 100 sccm through the carbon electrode tube (¼ inch OD), 2A, and reacted in the very high temperature gradient produced by current flow between the electrodes and focusing at the tip of electrode 2A where the maximum gradient and temperature occurs at the gas outlet of 2A. The maximum temperature was approximately 1600° C. The methane was converted to solid carbon and hydrogen at over 90% conversion. In the photographs, the left image shows the heated salt at low current, the middle photograph shows the high radiative heat emission at high current density and the maximum temperature where the reactant was introduced through the hollow carbon electrode. Methane conversion was measured by mass spectroscopy.

Example 6

Pyrolysis in Thermal Gradient Reactor with Infrared Reflector

Figure 34:
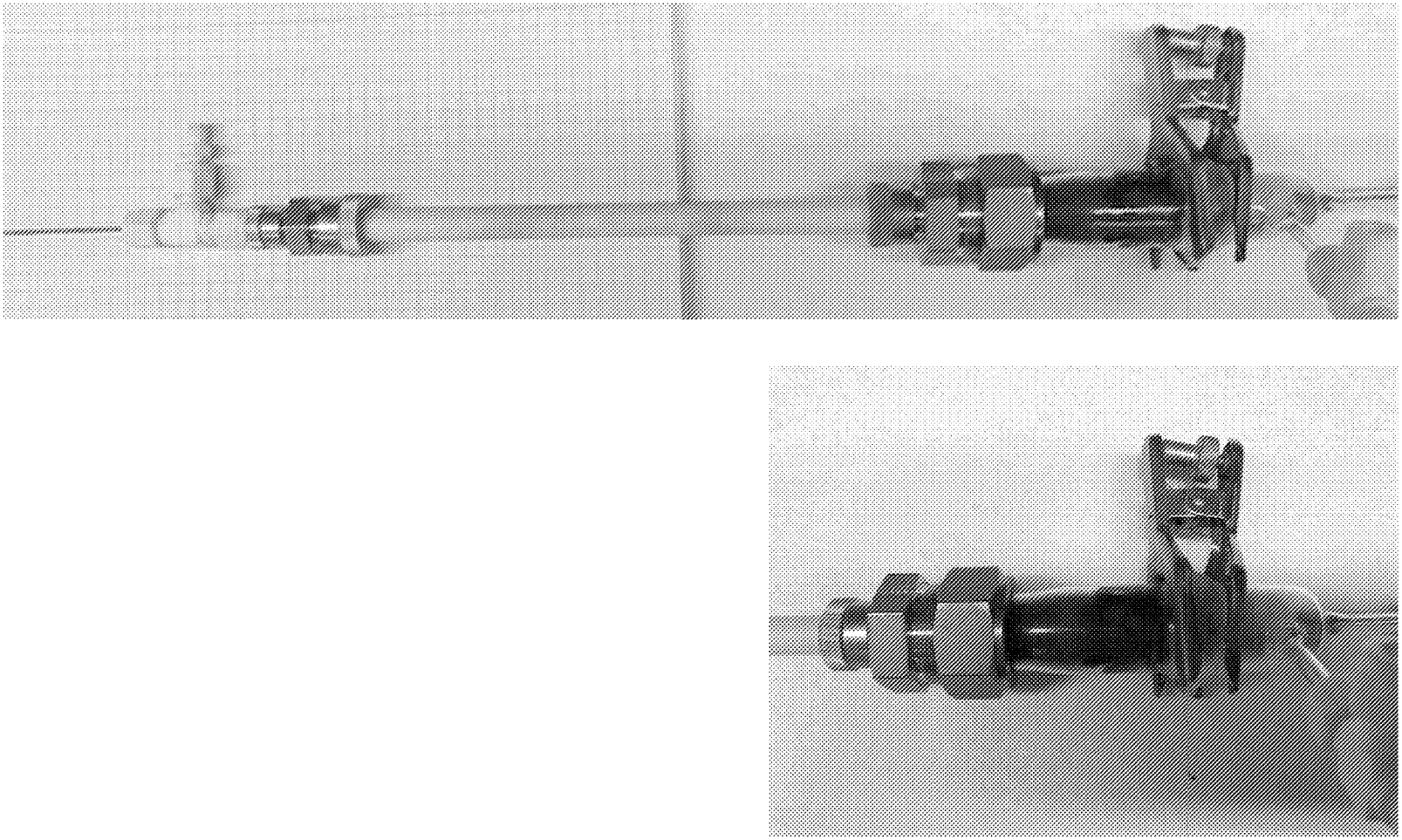
FIG. 34 photographs of the experimental thermal gradient reactor that is an infrared reflecting ceramic described in Example 6 showing carbon collected on silica filter wool.

In another example, shown in photographs in FIGS. 33-35. Surrounding a 100 mm central tungsten heat source connected to two copper conductors configured axially is a 9 mm ID alumina tube which reflects infrared radiation from the tungsten source. The hot zone with the temperature gradient around the filament heat source has a volume of approximately 6.4 ml. The heat source at the center was approximately 2300° C. and the average temperature was approximately 900° C. The residence time was 0.1 sec at 1200 sccm methane feed. The methane conversion was measured by mass spectroscopy to be 50% which translates to a reaction rate of 140 moles/$m^3$-s. Inspection of the inside of the alumina tube showed no significant accumulation of carbon. The tungsten source maintained its integrity as a filament, however, it converted to tungsten carbide in the presence of methane.

Example 7

Batch Reactor for High Pressure Natural Gas Conversion

In an example, methane is converted into hydrogen and carbon in a batch reactor described schematically in FIGS. 20, 21, 24, and 25 and shown in the laboratory in FIG. 36. A 182 ml stainless steel reactor contained a tungsten filament and was filled with methane at a pressure of 10 bar and 20° C. A 14 mm tungsten wire 0.25 mm (SA=10 $mm^2$) at the center was powered on for approximately 100 seconds and the reactor pressure and temperature inside the reactor was observed to increase to maximums of 30 bar and 180° C. respectively. The power to the filament was then turned off and the reactor allowed to cool. The pressure of the reactor was compared to control experiments with Argon to correct for the pressure increase due to heating. From the data in FIG. 36 and gas chromatography of a sample of the gas after reaction the methane conversion was determined and found to be 60%. The wire surface was maintained at approximately 2500° C. and was not observed to accumulate any carbon as all carbon produced was easily removed.

Example 8

High Flow Non-Isothermal Reactor

In another specific example, methane is converted into hydrogen and carbon in a flow reactor similar to the concepts of FIG. 3 and FIG. 4 the laboratory configurations are shown in FIG. 37. The photograph shows two different reactors with inside diameters of 1.5 cm and 2.3 cm. Data is obtained from the 1.5 cm diameter reactor where pure methane was fed at flowrates of between 1 and 5 liters per minute and with an inlet temperature of 22° C. and the outlet temperature measured. The heat added to the gas was determined from the inlet and outlet temperatures and the heat added to drive the pyrolysis determined from the methane conversion measured by mass spectrometry and gas chromatography. A conversion of 20% was obtained with a relatively low outlet gas temperature and a gas residence time of less than 1 second. Carbon produced in the reaction flowed out of the reactor with the hydrogen produced and unreacted methane.

Example 9

High Flow Quench Reactor

Figure 38:
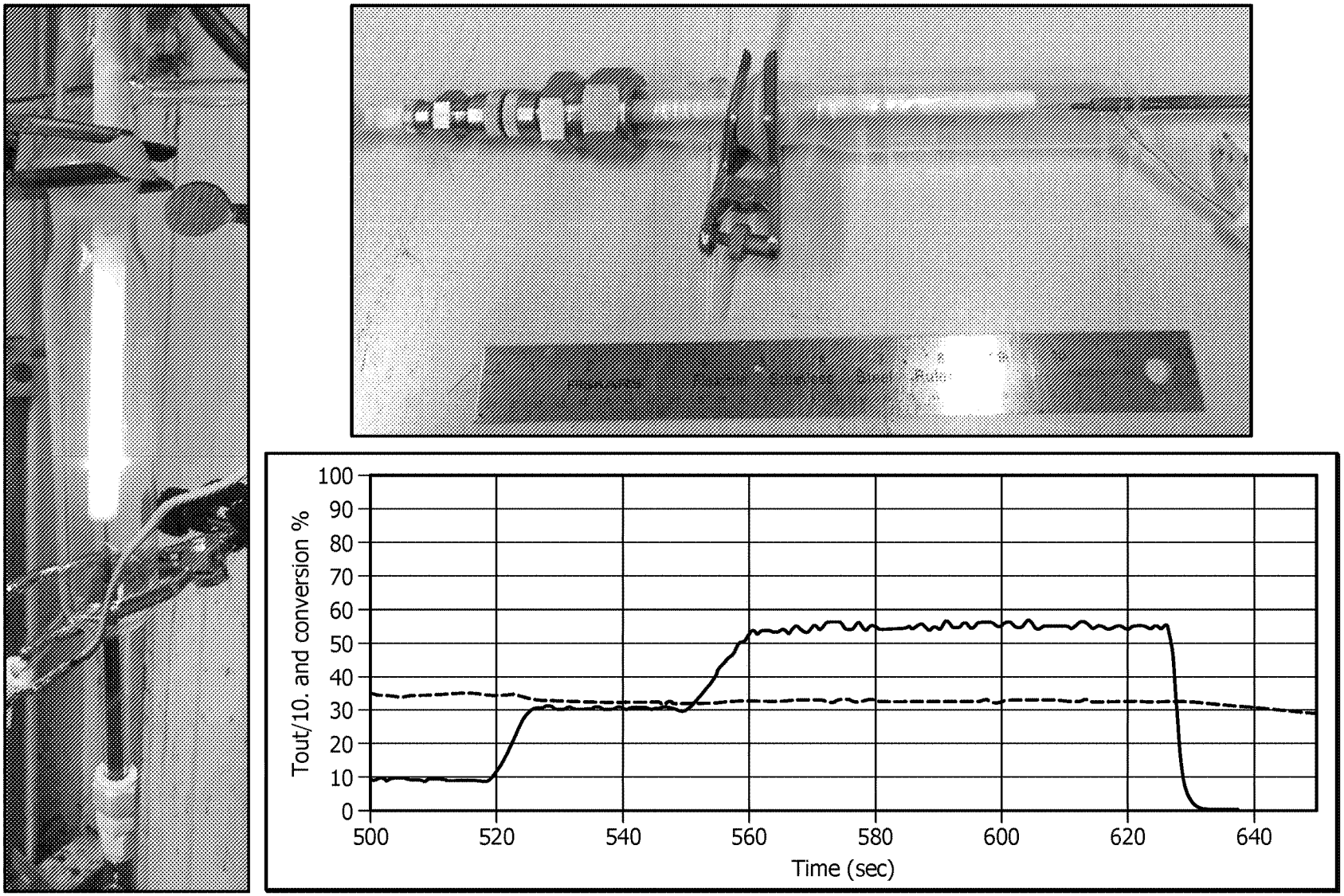
FIG. 38 photograph and data from experiment, Example 9, demonstrating quench in non-isothermal reactor for methane pyrolysis.

In another specific example, a reactor which converted methane to hydrogen and solid carbon in a high temperature zone, was brought to moderate temperatures by a quench gas of nitrogen described in FIGS. 11 and 13. The experimental reactors are shown in FIG. 38 together with data obtained from a reactor consisting of a 30 cm alumina tube 0.8 cm in inside diameter in which a 15 cm, 0.5 mm diameter tungsten filament was used as the high temperature heat source at approximately 1700 to 2000° C. After leaving the alumina insulated reactor zone the product gases were mixed with the low temperature nitrogen quench gas flowing at a constant rate of 6 liters/min. The data shows that from 500 to 520 seconds at a methane flowrate of 5 liters/min the methane conversion of 10% was achieved with an outlet temperature of 350° C. (data is plotted as T/10), the flow was reduced to 2.5 liters/min and the conversion increased to 30%. At 550 seconds the flow rate was reduced to 1 liter/min and the conversion increased to approximately 55%. Note the outlet gas temperature was never greater than approximately 360° C. which is the point of the non-isothermal gradient reactor. The gas was heated and the reaction driven by convection, radiation, and production of excited molecules on the high temperature filament, however, the structural materials were never at a high temperature.

Having described various systems and methods, certain aspects can include, but are not limited to (referring also to the figures):

In a first aspect, an integrated process for conversion of chemical feedstocks into chemical products, the process comprising: contacting a feedstock with a high-temperature heat source in a non-isothermal reactor; producing products comprising hydrogen and carbon based on the contacting; and separating the products from any reacted feedstock; and producing at least one product stream from the separating.

A second aspect can include the process of the first aspect, further comprising: treating a hydrocarbon feedstock to produce the feedstock.

A third aspect can include the process of the first or second aspect, further comprising: pre-heating the feedstock in at least one heat exchanger prior to contacting the feedstock with the high-temperature heat source;

A fourth aspect can include the process of any one of the first to third aspects, further comprising: cooling the products from the non-isothermal reactor prior to separating the products.

In a fifth aspect, a reactor system can comprise a subsection for feedstock pre-treatment and heat exchange, a reactor for transforming feedstocks to products at high pressures using a non-isothermal reactor with a high temperature heat source, a subsection for product heat exchange, and a separation subsystem for separating products from byproducts and unreacted feedstock.

In a sixth aspect, an integrated process for conversion of alkane containing chemical feedstocks into molecular hydrogen and solid carbon comprises: a heat exchanger system for preheating the alkane feedstock, a non-isothermal reactor where the chemical reaction is accelerated by a spatially localized high temperature heat source producing primarily hydrogen gas and suspended solid carbon and where the high temperature products are intermixed with lower temperature chemicals such that the product stream leaving the reactor and in contact with reactor structures away from the heat source are at a lower temperature, a heat exchanger system for cooling the product stream, a subsystem for separating the suspended solid carbon from the gas phase product stream, and a subsystem for separating the hydrogen product from unreacted alkanes and reaction byproducts.

A seventh aspect can include the process of the sixth aspect, whereby natural gas at a pressure greater than 10 bar is the feedstock and it is preheated to a temperature greater than 500° C. and introduced at high velocity with a Reynolds number greater than 500 into a non-isothermal reactor with a heat source maintained at a temperature greater than 1500° C. which facilitates reaction to produce solid carbon suspended in the gas which is at a temperature lower than the heat source. The high temperature product stream is intermixed with a quenching stream within the reactor lowering the mixture temperature to less than 900° C. where it exits the reactor for subsequent cooling and separation.

In an eighth aspect, an integrated process for enriching high pressure natural gas pipelines in hydrogen by using the pipeline gas as a feedstock to a process which i) transforms the natural gas into hydrogen and solid carbon, and ii) removes the solid carbon and other products from hydrogen and methane, and iii) returns the hydrogen and methane to the pipeline.

In a ninth aspect, a chemical reactor for increasing the production of a desired product from reactants, comprises: a. a vessel; b. a localized high temperature heat source creating a spatially varying temperature gradient; c. an inlet for contacting reactants with the heat source; and d. an outlet for removing the desired products.

In a tenth aspect, a chemical reactor for production primarily of hydrogen and solid carbon from natural gas containing methane comprises: a. a steel pressure vessel; b. a localized high temperature heat source creating a spatially varying temperature gradient; c. an inlet for contacting reactants with the heat source; and d. an outlet for removing the desired products.

In an eleventh aspect, an integrated process for conversion of alkane containing chemical feedstocks into molecular hydrogen and solid carbon in a reactor maintained with spatially varying temperatures enabled by a localized high temperature heat source such that, i) the reaction rate in the vicinity of the heat source is maintained fast producing solid carbon suspended in the gas, ii) the heat consumed in the reaction and the infrared absorption by reactants and products reduces the heating of the reactants and reactor containment materials distant from the heat source.

In a twelfth aspect, an integrated process for enriching high pressure natural gas pipelines in hydrogen by using the pipeline gas as a feedstock to a process which i) transforms the natural gas into hydrogen and solid carbon, and ii) removes the solid carbon and other products from hydrogen and methane, and iii) returns the hydrogen and methane to the pipeline.

A thirteenth aspect can include the process of the eleventh or twelfth aspect whereby the source temperature in the reactor is greater than 1500 C and the pressure is greater than 5 bar.

A fourteenth aspect can include the process of the eleventh or twelfth aspect whereby the source temperature in the reactor is greater than 2000 C and the pressure is greater than 20 bar.

A fifteenth aspect can include the process of the eleventh or twelfth aspect whereby the high temperature source is surrounded by a material with a high reflectivity for thermal radiation.

A sixteenth aspect can include the process of the eleventh or twelfth aspect whereby the reactor pressure vessel is made from materials such as steel that is not rated for temperatures as high as the heat source at the reaction temperatures in the vicinity of the heat source.

In a seventeenth aspect, a reactor system for producing products from fluids (gas or liquid), comprises: 1) a reactor section comprising a feed inlet, a reactor outer wall, an annular space cooled partially by the inlet feed and an internal outlet to a second continuous reactor section enclosed in the reactor outer wall; and 2) a second reactor section located within said annular space and including: a. a flow channel causing the feed to pass around a centrally located localized heat source producing a large thermal gradient between the source and the channel wall which is coated with an infrared heat reflecting material on the inner surface facing the source, b. a high temperature heat source in fluid communication with the feed in the flow channel, and, c. a reactor outlet whereby hot reaction products produced in the vicinity of the heat source are mixed with unreactive, cooler, feed fluids that moved through the region of the heat source far from the source with relative thermal isolation thereby lowering the temperature of the intermixed materials.

An eighteenth aspect can include the reactor system of the seventeenth aspect whereby the reactor is for producing solid carbon and gaseous hydrogen from a hydrocarbon gas feed, and: a. the reactor section comprising a feed inlet, a reactor outer wall, an annular space is cooled partially by the hydrocarbon gas feed and with reactor walls made primarily from stainless steel and having an internal outlet to a second continuous section enclosed in the reactor outer wall; and b. a second reactor section located in said annular space and including: c. a flow channel made of a metal including but not limited to stainless steel which causes the hydrocarbon feed to pass around a centrally located heat source with the channel wall having an infrared reflecting material on the inner surface including but not limited to alumina, d. a high temperature heat source in communication with the hydrocarbon feed in the flow channel comprised of a refractory material (e.g. tungsten, molybdenum, or their carbides or silicides, or silicon carbide, heated with electricity or by a chemical reaction (combustion), and e. a reactor outlet whereby reaction products produced in the vicinity of the heat source including solid carbon suspended in the gases are mixed with unreacted, cooler, feed gas that moved through the region of the heat source a distance from the heat source with relative thermal isolation.

In a nineteenth aspect, a reactor system for producing products from fluids (gas or liquid), comprises: a. a reactor section in fluid communication comprising a pressure vessel which can be pre-filled with the reactant fluid and an outlet for semicontinuous removal of gas phase reaction products; and b. a second reactor section located within said reactor a distance apart from the pressure vessel walls whereby a localized heat source producing a large thermal gradient between the source and the pressure vessel walls with the high temperature heat source in fluid communication with the reactant fluid allowing rapid reaction rates in the local vicinity of the heat source.

In a twentieth aspect, a reactor system for producing products from gas phase reactants at high temperatures with a large thermal gradient comprises: a. a reactor pressure vessel containing a non-reacting liquid in fluid communication with the pressure vessel walls with an inlet to allow gas phase reactants to enter the liquid and an outlet for removal of gas phase reaction products and unreacted reactants; and b. a high temperature localized heat source in fluid communication with the non-reacting liquid that produces a very high localized temperature in the liquid through which reactant gases in bubbles are made to move where they react in the high temperature environment.

In a twenty first aspect, a process for pyrolysis producing solid carbon and hydrogen from gaseous hydrocarbons uses solid particulates suspended in a high velocity carrier gas are added to remove accumulated carbon within the reactor body.

In a twenty second aspect, a process for pyrolysis producing solid carbon and hydrogen from gaseous hydrocarbons uses solid particulates are introduced in the reactant stream to specifically absorb infrared radiation from a high temperature source or heat thereby facilitating the heating of the gas within the reactor.

In a twenty third aspect, an integrated process for performing reactions requiring very high temperatures that cannot be tolerated by the reactor structural materials is disclosed whereby reactants are introduced into a reactor containing a heat source which operates with a temperature gradient such that only a fraction of the reactants are exposed to the high reaction temperatures while the reactor structural materials are only in contact with a mixture of reactants and products at a reduced temperature below the very high reaction temperatures.

A twenty fourth aspect can include the process of the twenty third aspect whereby the hydrocarbon reactants are primarily methane which are passed into the body of the reactor such that a fraction of the reactants are contacted with a high temperature heat source within the reactor at a temperature greater than 1400° C. and undergo decomposition to produce mostly solid carbon and hydrogen while a fraction of the reactants pass through colder regions of the reactor in contact with the structural elements of the reactor. The products and remaining reactants are mixed prior to leaving the reactor.

In a twenty fifth aspect, a thermal gradient reactor is disclosed whereby the heating elements are comprised of high temperature materials including but not limited to silicon carbide, tungsten, tungsten carbide, molybdenum, molybdenum carbide, molybdenum silicide, tantalum, tantalum carbide, carbon, nickel, chromium, rhenium, and high temperature materials containing their mixtures.

In a twenty sixth aspect, a thermal gradient reactor is disclosed whereby the heating elements are heated by electricity.

In a twenty seventh aspect, a thermal gradient reactor is disclosed whereby the heating elements are tubes heated internally by combustion or other exothermic chemical reactions.

In a twenty eighth aspect, a thermal gradient reactor is disclosed whereby the heating elements are semi-porous tubes heated by reaction of a portion of the reactant gas with oxygen on or near the surface of the heating element.

In a twenty ninth aspect, a thermal gradient reactor is disclosed whereby the reactant flow is of high velocity and laminar.

In a thirtieth aspect, a thermal gradient reactor is disclosed whereby the reactant flow is of low or zero velocity, and the reactant diffuses within the reactor.

In a thirty first aspect, a thermal gradient reactor is disclosed whereby the reactant flow is of high velocity and turbulent.

In a thirty second aspect, a thermal gradient reactor is disclosed whereby the heat source is surrounded by an infrared reflecting material, including but not limited to alumina.

In a thirty third aspect, a thermal gradient reactor is disclosed whereby the thermal gradient is maintained by the specific flow profile of the reactants.

In a thirty fourth aspect, a thermal gradient reactor is disclosed whereby accumulation of carbon within the reactor is removed periodically by suspending abrasive fine particles in a high velocity gas flow made to move through the reactor and contact carbon accumulated on the reactor structural elements and suspending that carbon in the gas moving through the reactor.

In a thirty fifth aspect, a thermal gradient reactor is disclosed whereby the reactor is configured such that a solid product is produced in the gas which has a high infrared absorption and serves to shield the high temperature source from radiative heat flow and itself is heated serving as a high temperature source for additional reaction.

In a thirty sixth aspect, a thermal gradient reactor is disclosed whereby the high temperature heat source is created by a semiporous barrier between the reactor and the source volume and the heat generated by the combustion of reactant gas in the source volume. The semiporous barrier may consist of a high temperature material such as a ceramic (including but not limited to materials containing alumina, silicon carbide, zirconia) or sintered high temperature metal (including but not limited to tungsten, molybdenum).

In a thirty seventh aspect, an alkane pyrolysis process for producing hydrogen gas and solid carbon in a large thermal gradient produced by a localized high temperature heat source at a temperature around which the alkane gas reacts in the high temperature environment to produce the gas phase products and solid carbon suspended in the gas and where the reactor walls are maintained at a temperature far lower than the source temperature is disclosed.

A thirty eighth aspect can include the process of the thirty seventh aspect, whereby the source temperature in the reactor is greater than 1500 C and the pressure is greater than 5 bar.

A thirty ninth aspect can include the process of the thirty seventh aspect, whereby the source temperature in the reactor is greater than 2000 C and the pressure is greater than 20 bar.

A fortieth aspect can include the process of the thirty seventh aspect, whereby the high temperature source is surrounded by a material with a high reflectivity for thermal radiation.

A forty first aspect can include the process of the thirty seventh aspect, whereby the reactor pressure vessel is made from materials such as steel that is not rated for temperatures as high as the heat source at the reaction temperatures in the vicinity of the heat source.

In a forty second aspect, a reactor system for producing products from fluids (gas or liquid) comprises: 1) a reactor section comprising a feed inlet, a reactor outer wall, an annular space cooled partially by the inlet feed and an internal outlet to a second continuous reactor section enclosed in the reactor outer wall; and 2) a second reactor section located within said annular space and including: a. a flow channel causing the feed to pass around a centrally located localized heat source producing a large thermal gradient between the source and the channel wall which is coated with an infrared heat reflecting material on the inner surface facing the source, b. a high temperature heat source in fluid communication with the feed in the flow channel, and c. a reactor outlet whereby hot reaction products produced in the vicinity of the heat source are mixed with unreactive, cooler, feed fluids that moved through the region of the heat source far from the source with relative thermal isolation thereby lowering the temperature of the intermixed materials.

A forty third aspect can include the reactor system of the forty second aspect, whereby the reactor is for producing solid carbon and gaseous hydrogen from a hydrocarbon gas feed, and: a. the reactor section comprising a feed inlet, a reactor outer wall, an annular space is cooled partially by the hydrocarbon gas feed and with reactor walls made primarily from stainless steel and having an internal outlet to a second continuous section enclosed in the reactor outer wall; and b. a second reactor section located in said annular space and including: c. a flow channel made of a metal including but not limited to stainless steel which causes the hydrocarbon feed to pass around a centrally located heat source with the channel wall having an infrared reflecting material on the inner surface including but not limited to alumina, d. a high temperature heat source in communication with the hydrocarbon feed in the flow channel comprised of a refractory material (e.g. tungsten, molybdenum, or their carbides or silicides, or silicon carbide, heated with electricity or by a chemical reaction (combustion), and e. a reactor outlet whereby reaction products produced in the vicinity of the heat source including solid carbon suspended in the gases are mixed with unreacted, cooler, feed gas that moved through the region of the heat source a distance from the heat source with relative thermal isolation.

In a forty fourth aspect, a reactor system for producing products from fluids (gas or liquid), comprises: a. a reactor section in fluid communication comprising a pressure vessel which can be pre-filled with the reactant fluid and an outlet for semicontinuous removal of gas phase reaction products; and b. a second reactor section located within said reactor a distance apart from the pressure vessel walls whereby a localized heat source producing a large thermal gradient between the source and the pressure vessel walls with the high temperature heat source in fluid communication with the reactant fluid allowing rapid reaction rates in the local vicinity of the heat source.

In a forty fifth aspect, a reactor system for producing products from gas phase reactants at high temperatures with a large thermal gradient comprises: b. a reactor pressure vessel containing a non-reacting liquid in fluid communication with the pressure vessel walls with an inlet to allow gas phase reactants to enter the liquid and an outlet for removal of gas phase reaction products and unreacted reactants; and c. a high temperature localized heat source in fluid communication with the non-reacting liquid that produces a very high localized temperature in the liquid through which reactant gases in bubbles are made to move where they react in the high temperature environment.

A forty sixth aspect can include the reactor system of the forty fifth aspect, whereby the non-reacting liquid is a molten salt (including but not limited to NaCl, KCl, NaBr, KBr, and other metal halides) or a molten metal (including but not limited to pure and alloy combinations including, Na, K, Li, Mg, Fe, Ni, Cu, Bi, Sn, Sb, Co).

A forty seventh aspect can include the reactor system of the forty fifth aspect for producing hydrogen and solid carbon by pyrolysis of a hydrocarbon gas whereby the reactor vessel is a structural metal and operated a pressure greater than 5 bar and an average bulk liquid temperature of below 900 C and a hot source temperature of greater than 1500 C.

A forty eighth aspect can include the reactor system of the forty fifth aspect, where the hot source consists of electrodes within the non-reacting conducting liquid or otherwise in electromagnetic contact that when a voltage is applied cause an electrical current to flow within the liquid that heats the liquid between the electrodes where the current flows. The current density and local heating is shaped by the specific means of contacting the gas and the liquid.

A forty ninth aspect can include the reactor system of the forty fifth aspect, where the hot source consists of a tube or tubes inside of which high temperature exothermic chemical reactions occur separately and isolated from the reactor system including but not limited to silicon carbide tubes in which hydrogen combustion is occurring to heat the tube.

A fiftieth aspect can include the reactor system of any one of the previous aspects, where the temperature gradient in the reaction zone is greater than 10° C./cm.

A fifty first aspect can include the reactor system of any one of the previous aspects, where the temperature gradient in the reaction zone is greater than 100° C./cm.

A fifty second aspect can include the reactor system of any one of the previous aspects, where the temperature gradient in the reaction zone is greater than 1000° C./cm.

A fifty third aspect can include the reactor system of any one of the previous aspects, whereby an external gas or liquid not in contact with the reactants is used to remove heat from the reaction zone.

A fifty fourth aspect can include the reactor system of any one of the previous aspects, whereby the source of heat for producing the temperature gradients consists of multiple spatially separate sources.

Figure 6:
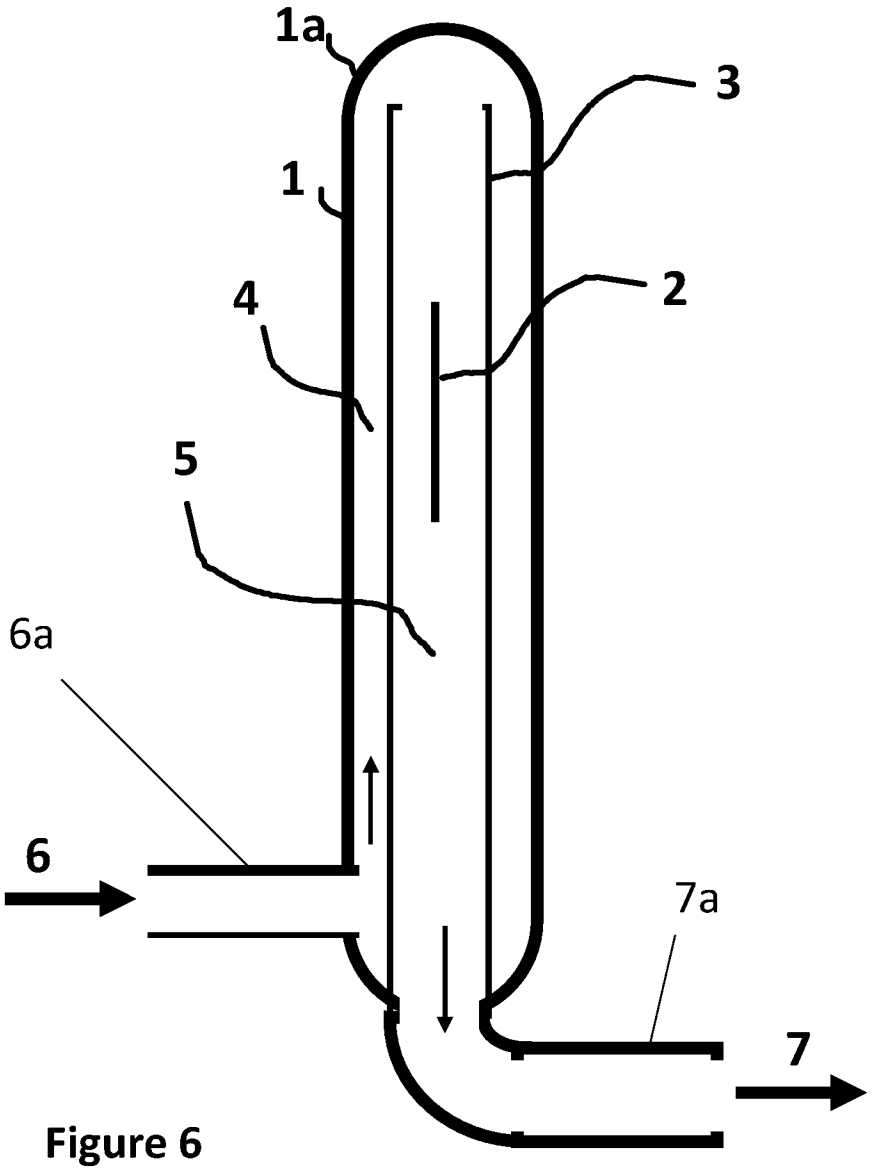
FIG. 6 schematically illustrates a thermal gradient flow reactor with a central heated zone isolated from a peripheral cooler zone by a heat shield cooled by incoming reactant gas.

In a fifty fifth aspect, e.g., as illustrated in FIG. 4 and FIG. 6, a process for performing high temperature reactions comprises: introducing reactants 6 into a reactor vessel 1; generating a high temperature within the reactor vessel, wherein the high temperature is higher than a lower temperature of a wall 1*a* of the reactor vessel, and wherein a temperature gradient is generated between the high temperature and the lower temperature of the wall; exposing a first portion of the reactants 6 to the high temperature; reacting the first portion of the reactants based on contact with the high temperature to produce one or more products, wherein a second portion of the reactants are not exposed to the high temperature, and wherein the second portion of the reactants do not react.

A fifty sixth aspect can include the process of the fifty fifth aspect, where the wall of the reactor vessel cannot maintain structural integrity at a pressure of the reacting and the high temperature.

A fifty seventh aspect can include the process of the fifty fifth or fifty sixth aspect, further comprising: maintaining the lower temperature of the wall based on the second portion of the reactants not reacting.

A fifty eighth aspect can include the process of any one of the fifty fifth to fifty seventh aspects, wherein the reactants comprise methane.

A fifty ninth aspect can include the process of any one of the fifty fifth to fifty eighth aspects, wherein the high temperature is 1,400 C or greater.

A sixtieth aspect can include the process of any one of the fifty fifth to fifty ninth aspects, wherein the products comprise solid carbon and hydrogen gas.

A sixty first aspect can include the process of any one of the fifty fifth to sixtieth aspects, further comprising: mixing the products and the second portion of the reactants to produce a mixed product stream, wherein the mixed product stream is at a temperature lower than the high temperature; and passing the mixed product stream out of the reactor vessel.

A sixty second aspect can include the process of any one of the fifty fifth to sixty first aspects, wherein generating the high temperature comprises using a heating element 2 to generate the high temperature.

A sixty third aspect can include the process of the sixty second aspect, wherein heating element 2 is formed from silicon carbide, tungsten, tungsten carbide, molybdenum, molybdenum carbide, molybdenum silicide, tantalum, tantalum carbide, carbon, nickel, chromium, rhenium, or mixtures thereof.

A sixty fourth aspect can include the process of any one of the sixty second to sixty third aspects, wherein generating the high temperature comprises passing an electrical current through the heating element.

A sixty fifth aspect can include the process of the sixty second aspect, wherein the heating element comprises a tube, and wherein the process further comprises:

heating the tube internally using an exothermic reaction.

A sixty sixth aspect can include the process of the sixty fifth aspect, wherein the exothermic reaction comprises a combustion reaction.

A sixty seventh aspect can include the process of the sixty fifth or sixty sixth aspect, wherein the tube is porous, and wherein heating the tube comprises passing a third portion of the reactants through the tube; contacting the third portion of the reactants with oxygen within the tube; and combusting the third portion of the reactants within the tube based on contacting the third portion of the reactants with the oxygen.

A sixty eighth aspect can include the process of any one of the sixty fifth aspect to sixty seventh aspects, wherein the tube is formed from alumina, silicon carbide, zirconia, tungsten, molybdenum, or any combination thereof.

A sixty ninth aspect can include the process of any one of the fifty fifth aspect to sixty eighth aspects, wherein the reactants pass through the reactor vessel in a laminar flow.

A seventieth aspect can include the process of any one of the fifty fifth aspect to sixty ninth aspects, wherein the reactants pass through the reactor vessel in a turbulent flow.

A seventy first aspect can include the process of any one of the fifty fifth aspect to seventieth aspects, wherein generating the high temperature occurs within a heat shield, wherein the heat shield 3 is positioned within the reactor vessel, and wherein the process further comprises: shielding the wall of the reactor vessel from the high temperature using the heat shield.

A seventy second aspect can include the process of the seventy first aspect, wherein the first portion of the reactants passes through the heat shield 3 to be exposed to the high temperature, wherein the second portion of the reactants passes around an exterior of the heat shield and is not exposed to the high temperature.

A seventy third aspect can include the process of any one of the fifty fifth to seventy second aspects, further comprising: contacting an external surface of the wall with a coolant 26, and maintaining the lower temperature of the wall based on the contacting of the external surface of the wall with the coolant.

A seventy fourth aspect can include the process of any one of the fifty fifth to seventy third aspects, wherein generating the high temperature within the reactor vessel comprises using a plurality of heat sources 2 within the reactor vessel.

A seventy fifth aspect can include the process of the seventy fourth aspect, wherein the plurality of heat sources are arranged in series along the flow path within the reactor vessel.

In a seventy sixth aspect, e.g., as illustrated in FIGS. 3 and 6-14, a thermal gradient reactor comprises: a reactor vessel 1 comprising a reactor wall 1*a*; an inner wall 3 disposed within the reactor vessel, wherein an annular space 4 is created within the reactor vessel between the reactor wall and the inner wall; a reaction zone 5 defined within the inner wall 3; and a heat source 2 disposed within the inner wall, wherein the heat source 2 is configured to generate a reaction temperature within the reaction zone, wherein the annular space 4 and the reaction zone 5 are configured to pass a reactant gas 6 through an inlet 6*a*, through the annular space 4, through the reaction zone 5, and out an outlet 7*a*.

A seventy seventh aspect can include the reactor of the seventy sixth aspect, where the wall 1*a* of the reactor vessel cannot maintain structural integrity at a pressure of the reaction and the reaction temperature.

A seventy eighth aspect can include the reactor of the seventy sixth or seventy seventh aspect, wherein heat source 2 comprises heating filament, and wherein the heating filament is formed from silicon carbide, tungsten, tungsten carbide, molybdenum, molybdenum carbide, molybdenum silicide, tantalum, tantalum carbide, carbon, nickel, chromium, rhenium, or mixtures thereof.

A seventy ninth aspect can include the reactor of the seventy eighth aspect, wherein the heat source 2 comprises a tube configured to be heated using an exothermic reaction.

An eightieth aspect can include the reactor of the seventy ninth aspect, wherein the tube is porous.

An eighty first aspect can include the reactor of the seventy ninth or eightieth aspect, wherein the tube is formed from alumina, silicon carbide, zirconia, tungsten, molybdenum, or any combination thereof.

An eighty second aspect can include the reactor of any one of the seventy sixth to eighty first aspects, wherein the inner wall comprises a heat shield 3.

An eighty third aspect can include the reactor of any one of the seventy sixth to eighty second aspects, further comprising: a cooling jacket 1*c* disposed about the reactor vessel, wherein the cooling jacket defines a cooling annulus 28 about the reactor vessel, wherein the cooling jacket is configured to pass a coolant 26 in contact with an external surface of the reactor vessel 1 to maintain a temperature of a wall 1*a* of the reactor vessel lower than the reaction temperature.

An eighty fourth aspect can include the reactor of any one of the seventy sixth to eighty third aspects, wherein the heat source 2 comprises a plurality of heat sources within the reactor vessel.

An eighty fifth aspect can include the reactor of the eighty fourth aspect, wherein the plurality of heat sources are arranged in series along the flow path within the reactor vessel.

In an eighty sixth aspect, a thermal gradient reactor comprises an outer reactor wall; an inner wall disposed within the reactor vessel, wherein an annular space is created between the outer reactor wall and the inner wall; a reaction zone defined within the inner wall; and a heat source disposed within the inner wall, wherein the heat source is configured to generate a reaction temperature within the reaction zone, wherein the annular space and the reaction zone are configured to pass a first portion of a reactant gas through the annular space, a second portion of the reactant gas through the inner wall to create reaction products, and combine the first portion of the reactant gas and the reaction products past the reaction zone.

An eighty seventy aspect can include the reactor of the eighty sixth aspect, wherein the outer reactor wall is formed from steel or stainless steel.

An eighty eighth aspect can include the reactor of the eighty sixth or eighty seventh aspect, wherein the inner wall is formed from a high temperature metal of ceramic.

In an eighty ninth aspect, e.g., as illustrated in FIG. 20, a high temperature reaction process comprises passing a reactant gas 6 into a reactor vessel 1; heating a heat source 2 to generate a high temperature at the heat source, wherein the heat source is only heated for a first time period; reacting at least a portion of the reactant within the reactor vessel 1 based on generating the high temperature to create reaction products comprising solid carbon 21; cooling the heat source to maintain a wall 1*a* of the reactor vessel below a threshold temperature, wherein the threshold temperature is below the high temperature; depositing the solid carbon 21 within the reactor vessel 1; repeating the passing, heating, and reacting until an accumulation of solid carbon 21 forms in the reactor vessel; and removing the solid carbon from the reactor vessel to recover the solid carbon.

A ninetieth aspect can include the process of the eighty ninth aspect, wherein the high temperature is greater than 1,500 C.

A ninety first aspect can include the process of the eighty ninth aspect, wherein the high temperature is greater than 2,000 C.

A ninety second aspect can include the process of any one of the eighty ninth to ninety first aspects, wherein a pressure in the reactor is greater than 5 bar.

A ninety third aspect can include the process of any one of the eighty ninth to ninety first aspects, wherein a pressure in the reactor is greater than 20 bar.

A ninety fourth aspect can include the process of any one of the eighty ninth to ninety third aspects, wherein the reactor vessel is formed from a material that is structurally unstable at the high temperature and pressure of the reacting.

A ninety fifth aspect can include the process of any one of the eighty ninth to ninety fourth aspects, wherein the reactants comprise methane.

A ninety sixth aspect can include the process of any one of the eighty ninth to ninety fifth aspects, wherein generating the high temperature comprises using a heating element 2 to generate the high temperature.

A ninety seventh aspect can include the process of the ninety sixth aspect, wherein heating element is formed from silicon carbide, tungsten, tungsten carbide, molybdenum, molybdenum carbide, molybdenum silicide, tantalum, tantalum carbide, carbon, nickel, chromium, rhenium, or mixtures thereof.

A ninety eighth aspect can include the process of the ninety sixth or ninety seventh aspect, wherein generating the high temperature comprises passing an electrical current through the heating element.

A ninety ninth aspect can include the process of the ninety sixth, wherein the heating element comprises a tube, and wherein the process further comprises:

heating the tube internally using an exothermic reaction.

A one hundredth aspect can include the process of the ninety ninth aspect, wherein the exothermic reaction comprises a combustion reaction.

A one hundred first aspect can include the process of the ninety ninth or one hundredth aspect, wherein the tube is porous, and wherein heating the tube comprises passing a third portion of the reactants through the tube; contacting the third portion of the reactants with oxygen within the tube; and combusting the third portion of the reactants within the tube based on contacting the third portion of the reactants with the oxygen.

A one hundred second aspect can include the process of any one of the ninety ninth to one hundred first aspect, wherein the tube is formed from alumina, silicon carbide, zirconia, tungsten, molybdenum, or any combination thereof.

In a one hundred third aspect, a thermal gradient reactor comprises a reactor vessel; a heat source disposed within the reactor vessel, wherein the heat source is configured to be cycled on to generate a high temperature, and cycled off, and wherein the heat source is configured to be cycled to generate a reaction temperature at the heat source while maintaining the reactor vessel below a threshold temperature; a reactant inlet; and a reactant outlet, wherein the reactant inlet and the reactant outlet are configured to pass a reactant gas into the reactor vessel in a semi-batch configuration.

In a one hundred fourth aspect, e.g., as illustrated in FIGS. 16 and 17, a high temperature reaction process comprises generating a high temperature at a first location 3 within a liquid 19, wherein the liquid is within a reactor vessel 1, and wherein the liquid away from the first location 3 is at a lower temperature; passing a reactant gas 6 through the high temperature within the liquid 19; forming reaction products based on the reactant gas passing through the high temperature; passing 17 the reaction products away from the first location 3; cooling the reaction products based on passing the reaction products 7 through the liquid away from the first location; and removing at least a portion of the reaction products 7 from the reactor vessel 1.

A one hundred fifth aspect can include the process of the one hundred fourth aspect, wherein the liquid is a conductive liquid, and wherein generating the high temperature comprises passing an electrical current through the liquid at the first location.

A one hundred sixth aspect can include the process of the one hundred fifth aspect, wherein passing the electrical current through the liquid comprises: immersing electrodes 2A, 2 within the liquid; and applying a voltage across the electrodes; and generating the high temperature in response to current passing between the electrodes based on applying the voltage.

A one hundred seventh aspect can include the process of the one hundred fifth aspect, wherein one or more of the electrodes comprises an inlet tube, and wherein passing the reactant gas comprises passing the reactant gas through the inlet tube.

A one hundred eighth aspect can include the process of any one of the one hundred fourth to one hundred seventh aspects, wherein the liquid is non-reacting liquid, and wherein the non-reacting liquid comprises a molten salt or a molten metal.

A one hundred ninth aspect can include the process of the one hundred eighth aspect, wherein the molten salt comprises a halide salt.

A one hundred tenth aspect can include the process of the one hundred eighth aspect, wherein the molten metal comprise Na, K, Li, Mg, Fe, Ni, Cu, Bi, Sn, Sb, Co, alloys thereof, or combinations thereof.

A one hundred eleventh aspect can include the process of any one of the one hundred fourth to one hundred tenth aspects, wherein generating the high temperature at the first location comprises using a heating element 2 within the liquid at the first location 3.

A one hundred twelfth aspect can include the process of the one hundred eleventh aspect, wherein the heating element 2 comprises a tube (e.g., as illustrated in FIG. 7), and where generating the high temperature comprises: passing a combustible gas through the tube; contacting the combustible gas with oxygen within the tube; and combusting the combustible gas within the tube to generate heat within the tube, wherein the heat within the tube generates the high temperature.

A one hundred thirteenth aspect can include the process of any one of the one hundred fourth to one hundred twelfth aspects, wherein the reactor vessel comprises a structural metal.

A one hundred fourteenth aspect can include the process of any one of the one hundred fourth to one hundred thirteenth aspects, wherein the high temperature is greater than 1500° C., and wherein the lower temperature is below about 900° C.

A one hundred fifteenth aspect can include the process of any one of the one hundred fourth to one hundred fourteenth aspects, wherein a temperature gradient within the reactor vessel is greater than 10° C./cm.

A one hundred sixteenth aspect can include the process of any one of the one hundred fourth to one hundred fourteenth aspects, wherein a temperature gradient within the reactor vessel is greater than 100° C./cm.

A one hundred seventeenth aspect can include the process of any one of the one hundred fourth to one hundred fourteenth aspects, wherein a temperature gradient within the reactor vessel is greater than 1000° C./cm.

A one hundred eighteenth aspect can include the process of any one of the one hundred fourth to one hundred seventeenth aspects, further comprising: contacting an external surface of the reactor vessel with a coolant 26, and maintaining a lower temperature of a wall 1*a* of the reactor vessel based on the contacting of the external surface of the reactor vessel 1 with the coolant 26.

In a one hundred nineteenth aspect, a process for conversion of chemical feedstocks into chemical products comprises contacting a feedstock with a high-temperature heat source in a non-isothermal reactor; producing products based on the contacting; and separating the products from at least a portion of unreacted feedstock; and producing at least one product stream from the separating.

A one hundred twentieth aspect can include the process of the one hundred nineteenth aspect, wherein the feedstock comprises a hydrocarbon stream.

A one hundred twenty first aspect can include the process of the one hundred nineteenth or one hundred twentieth aspect, wherein the feedstock comprises natural gas.

A one hundred twenty second aspect can include the process of the one hundred twentieth or one hundred twenty first aspect, wherein the products comprise hydrogen and solid carbon.

A one hundred twenty third aspect can include the process of the one hundred twenty second aspect, further comprising: removing at least a portion of the solid carbon in the products prior to separating the products from any unreacted feedstock.

A one hundred twenty fourth aspect can include the process of any one of the one hundred nineteenth to one hundred twenty third aspects, further comprising: treating a raw feedstock to produce the feedstock.

A one hundred twenty fifth aspect can include the process of the one hundred twenty fourth aspect, wherein treating the raw feedstock comprises: removing one or impurities from the raw feedstock to produce the feedstock.

A one hundred twenty sixth aspect can include the process of any one of the one hundred nineteenth to one hundred twenty fifth aspects, further comprising: pre-heating the feedstock in at least one heat exchanger prior to contacting the feedstock with the high-temperature heat source.

A one hundred twenty seventh aspect can include the process of the one hundred twenty sixth aspect, wherein pre-heating the feedstock comprises heating the feedstock to a temperature between about 500° C. and about 900° C.

A one hundred twenty eighth aspect can include the process of any one of the one hundred nineteenth to one hundred twenty seventh aspects, wherein the high-temperature heat source is at a temperature of 1500° C. or greater.

A one hundred twenty ninth aspect can include the process of any one of the one hundred nineteenth to one hundred twenty eighth aspects, further comprising: maintaining a wall of the non-isothermal reactor at a temperature below 1000° C. during the contacting of the feedstock with the high-temperature heat source.

A one hundred thirtieth aspect can include the process of any one of the one hundred nineteenth to one hundred twenty ninth aspects, further comprising: cooling the products from the non-isothermal reactor prior to separating the products.

A one hundred thirty first aspect can include the process of the one hundred thirtieth aspect, wherein cooling the products comprises: mixing the products with a cooling stream; and quenching the product stream based on the mixing.

A one hundred thirty second aspect can include the process of the one hundred thirty first aspect, wherein the cooling stream comprises a cooled stream recycled from the separation of the products.

A one hundred thirty third aspect can include the process of any one of the one hundred thirtieth to one hundred thirty second aspects, wherein cooling the products comprises: cooling the products to a temperature of 900 C or less.

A one hundred thirty fourth aspect can include the process of any one of the one hundred nineteenth to one hundred thirty third aspects, further comprising: recycling at least a portion of the unreacted feedstock from the separating to an inlet of non-isothermal reactor.

A one hundred thirty fifth aspect can include the process of any one of the one hundred nineteenth to one hundred thirty fourth aspects, wherein the products comprise hydrogen, and where the process further comprises: recycling at least a portion of the hydrogen from the separating to an inlet of the non-isothermal reactor; and preventing coking within the non-isothermal reactor based on the presence of the recycled hydrogen.

A one hundred thirty sixth aspect can include the process of any one of the one hundred nineteenth to one hundred thirty fifth aspects, wherein the feedstock is introduced into the non-isothermal reactor with a Reynolds number greater than 500.

In a one hundred thirty seventh aspect, a process for conversion of chemical feedstocks into chemical products comprises: contacting a feedstock with a high-temperature heat source in a non-isothermal reactor; producing products based on the contacting, wherein the products comprise a gaseous product and a solid product; passing gaseous product out of the non-isothermal reactor; retaining the solid product in the non-isothermal reactor; separating the gaseous product from at least a portion of unreacted feedstock; and producing at least one product stream from the separating.

A one hundred thirty eighth aspect can include the process of the one hundred thirty seventh aspect, further comprising: ceasing the contacting of the feedstock with the high-temperature heat source; removing the solid product from the non-isothermal reactor; and reintroducing the feedstock to contact the feedstock with the high-temperature heat source.

A one hundred thirty ninth aspect can include the process of the one hundred thirty seventh or one hundred thirty eighth aspect, wherein the non-isothermal reactor comprises: a first reaction chamber; a second reaction chamber; and an inlet valve configured to direct the feedstock into the first reaction chamber or the second reaction chamber; and an outlet valve configured to direct the gaseous product and the unreacted feedstock out of the first reaction chamber or the second reaction chamber, respectively.

A one hundred fortieth aspect can include the process of any one of the one hundred thirty seventh to one hundred thirty ninth aspects, wherein the non-isothermal reactor comprises: a plurality of reaction chambers connected in parallel; one or more inlet valves configured to direct the feedstock into the first reaction chamber of the plurality of reaction chambers; and one or more outlet valves configured to direct the gaseous product and the unreacted feedstock out of the first reaction chamber of the plurality of reaction chambers.

A one hundred forty first aspect can include the process of any one of the one hundred thirty seventh to one hundred fortieth aspects, wherein the feedstock comprises a hydrocarbon stream.

A one hundred forty second aspect can include the process of any one of the one hundred thirty seventh to one hundred forty first aspects, wherein the feedstock comprises natural gas.

A one hundred forty third aspect can include the process of any one of the one hundred forty first to one hundred forty second aspects, wherein the gaseous product comprises hydrogen and wherein the solid product comprises solid carbon.

A one hundred forty fourth aspect can include the process of any one of the one hundred thirty seventh to one hundred forty third aspects, further comprising: treating a raw feedstock to produce the feedstock.

A one hundred forty fifth aspect can include the process of the one hundred forty fourth aspect, wherein treating the raw feedstock comprises: removing one or impurities from the raw feedstock to produce the feedstock.

A one hundred forty sixth aspect can include the process of any one of the one hundred thirty seventh to one hundred forty fifth aspects, further comprising: pre-heating the feedstock in at least one heat exchanger prior to contacting the feedstock with the high-temperature heat source.

A one hundred forty seventh aspect can include the process of the one hundred forty sixth aspect, wherein pre-heating the feedstock comprises heating the feedstock to a temperature between about 500° C. and about 900° C.

A one hundred forty eighth aspect can include the process of any one of the one hundred thirty seventh to one hundred forty seventh aspects, wherein the high-temperature heat source is at a temperature of 1500° C. or greater.

A one hundred forty ninth aspect can include the process of any one of the one hundred thirty seventh to one hundred forty eighth aspects, further comprising: maintaining a wall of the non-isothermal reactor at a temperature below 1000° C. during the contacting of the feedstock with the high-temperature heat source.

A one hundred fiftieth aspect can include the process of any one of the one hundred thirty seventh to one hundred fiftieth aspects, further comprising: cooling the gaseous product from the non-isothermal reactor prior to separating the gaseous product.

A one hundred fifty first aspect can include the process of the one hundred fiftieth aspect, wherein cooling the products comprises: mixing the products with a cooling stream; and quenching the product stream based on the mixing.

A one hundred fifty second aspect can include the process of the one hundred fifty first aspect, wherein the cooling stream comprises a cooled stream recycled from the separation of the gaseous product.

A one hundred fifty third aspect can include the process of any one of the one hundred fiftieth to one hundred fifty second aspects, wherein cooling the gaseous product comprises: cooling the gaseous product to a temperature of 900 C or less.

A one hundred fifty fourth aspect can include the process of any one of the one hundred thirty seventh to one hundred fifty fourth aspects, wherein the feedstock comprises natural gas from a pipeline, and further comprising: passing the at least one product stream to the pipeline.

In a one hundred fifty fifth aspect, e.g., as illustrated in FIGS. 8 and 14A, a non-isothermal reactor comprises: a pressure vessel 1; a high-temperature heat source 2 disposed within the pressure vessel, a heat shield 3 disposed about the high-temperature heat source 2 within the pressure vessel, wherein the high-temperature heat source 2 is configured to create a spatially varying temperature gradient within heat shield 3; an inlet 6*a* configured to introduce reactants 6 into the pressure vessel; and an outlet 7*a* configured to pass products out of the pressure vessel 1.

A one hundred fifty sixth aspect can include the reactor of the one hundred fifty fifth aspect, wherein the pressure vessel 1 is formed from steel, nickel, and/or alloys thereof.

A one hundred fifty seventh aspect can include the reactor of the one hundred fifty fifth or one hundred fifty sixth aspect, wherein high-temperature heat source is an electrical heat source or a combustion heat source.

A one hundred fifty eighth aspect can include the reactor of any one of the one hundred fifty fifth to one hundred fifty seventh aspects, further comprising: a quenching gas inlet 76*a* configured to introduce a quenching stream 76 between an interior of the pressure vessel and an exterior of the heat shield 3, wherein the outlet 7*a* is configured to pass a mixture of the products and the quenching gas 76 out of the pressure vessel 1.

A one hundred fifty ninth aspect can include the reactor of any one of the one hundred fifty fifth to one hundred fifty eighth aspects, wherein the high-temperature heat source is disposed coaxially within the heat shield.

A one hundred sixtieth aspect can include the reactor of any one of the one hundred fifty fifth to one hundred fifty eighth aspects, wherein the high-temperature heat source 2 is disposed about an interior border of the heat shield 3.

A one hundred sixty first aspect can include the reactor of any one of the one hundred fifty fifth to one hundred sixtieth aspects, wherein the inlet is configured to generate a cyclonic flow field 73*b* within the heat shield (e.g. as illustrated in FIG. 13B).

A one hundred sixty second aspect can include the reactor of any one of the one hundred fifty fifth to one hundred sixty first aspects, wherein the high-temperature heat source comprises a rod or tube.

A one hundred sixty third aspect can include the reactor of any one of the one hundred fifty fifth to one hundred sixty second aspects, wherein the high-temperature heat source is formed from tungsten, tungsten carbide, molybdenum, molybdenum carbide, aluminum, aluminum oxide, zirconium, zirconium oxide, or combinations thereof.

In a one hundred sixty fourth aspect, a non-isothermal reactor comprises: a pressure vessel; a plurality of high-temperature heat sources disposed within the pressure vessel, at least one heat shield, wherein the high-temperature heat source is configured to create a spatially varying temperature gradient within heat shield; an inlet configured to introduce reactants into the pressure vessel; and an outlet configured to pass products out of the pressure vessel.

A one hundred sixty fifth aspect can include the reactor of the one hundred sixty fourth aspect, wherein the at least one heat shield comprises a plurality of heat shields, and wherein each heat shield of the plurality of heat shields is disposed about a corresponding high-temperature heat source of the plurality of high temperature heat sources.

A one hundred sixty sixth aspect can include the reactor of the one hundred sixty fourth aspect, wherein the at least one heat shield is disposed about the plurality of high-temperature heat sources within the pressure vessel.

A one hundred sixty seventh aspect can include the reactor of any one of the one hundred sixty fourth to one hundred sixty sixth aspects, wherein the pressure vessel is formed from steel, nickel, and/or alloys thereof.

A one hundred sixty eighth aspect can include the reactor of any one of the one hundred sixty fourth to one hundred sixty seventh aspects, wherein the plurality of high-temperature heat sources is an electrical heat source or a combustion heat source.

A one hundred sixty ninth aspect can include the reactor of any one of the one hundred sixty fourth to one hundred sixty eighth aspects, further comprising: a quenching gas inlet configured to introduce a quenching stream between an interior of the pressure vessel and an exterior of the at least one heat shield, wherein the outlet is configured to pass a mixture of the products and the quenching gas out of the pressure vessel.

In a one hundred seventieth aspect, e.g., as illustrated in FIG. 4, 5, 13, 27 and associated text, a reaction process using a non-isothermal reactor comprises: contacting a hydrocarbon with a high-temperature heat source 2 within a pressure vessel 1; generating solid carbon 22 and hydrogen in response to contacting the hydrocarbon with the high-temperature heat source; radiating heat from the high-temperature heat source 2; absorbing, by the solid carbon 22, the radiating heat; heating the solid carbon 22 to a reaction temperature; contacting the hydrocarbon with the heated solid carbon 22 to generate additional solid carbon and hydrogen; and shielding the radiating heat from a wall 1*a* of the pressure vessel 1 based on absorbing the radiating heat with the solid carbon.

A one hundred seventy first aspect can include the process of the one hundred seventieth aspect, wherein the non-isothermal reactor comprises: the pressure vessel 1; the high-temperature heat source disposed within the pressure vessel; a heat shield 3 disposed about the high-temperature heat source within the pressure vessel, an inlet 6*a* configured to introduce reactants 6 into the pressure vessel; and an outlet 7*a* configured to pass products out of the pressure vessel 1.

A one hundred seventy second aspect can include the process of the one hundred seventieth or one hundred seventy first aspect, wherein the high-temperature heat source is at a temperature of 1500° C. or greater, or at a temperature of 2000° C. or greater.

A one hundred seventy third aspect can include the process of any one of the one hundred seventieth to one hundred seventy second aspects, wherein a pressure within the pressure vessel is at 5 bar or greater, or at 20 bar or greater.

A one hundred seventy fourth aspect can include the process of any one of the one hundred seventieth to one hundred seventy third aspects, wherein the hydrocarbon is contacted with the high-temperature heat source at a Reynolds number of 500 or greater.

A one hundred seventy fifth aspect can include the process of any one of the one hundred seventieth to one hundred seventy fourth aspects, e.g., as illustrated in FIG. 13B and associated text, wherein contacting the hydrocarbon with the high-temperature heat source comprises: introducing the hydrocarbon at an angle around the high-temperature heat source; passing the hydrocarbon in a cyclonic flow 73*b* about the high-temperature heat source 2 during the contacting; and conveying the solid carbon away from the high-temperature heat source based on the cyclonic flow 73*b*.

A one hundred seventy sixth aspect can include the process of any one of the one hundred seventieth to one hundred seventy fifth aspects, e.g., as illustrated in FIG. 27 and associated text, further comprising: ceasing a flow of the hydrocarbon 6 to the pressure vessel 44; introducing a gas 39 with a suspended solid; allowing the suspended solid to abrade an interior of the reactor vessel 44; and removing any carbon deposits within the reactor vessel based on abrading the interior of the reactor vessel with the suspended solids.

A one hundred seventy seventh aspect can include the process of the one hundred seventy sixth aspect, wherein the suspended solids comprise sand.

A one hundred seventy eighth aspect can include the process of any one of the one hundred seventieth to one hundred seventy seventh aspects, further comprising: introducing a solid reactant with the hydrocarbon; absorbing, by the solid reactant, the radiating heat; heating the solid reactant to a reaction temperature; contacting the hydrocarbon with the heated solid reactant to generate the additional solid carbon and hydrogen.

A one hundred seventy ninth aspect can include the process of the one hundred seventy eighth aspect, wherein the solid reactant is solid carbon.

The process, reactor, or system of any of the aspects, wherein the reactants comprise hydrocarbons, the reacting comprises pyrolysis, the products comprise at least one of a hydrocarbon, carbon, or hydrogen.

Embodiments are discussed below with reference to the Figures. However, those skilled in the art will readily appreciate that the detailed description given herein with respect to these figures is for explanatory purposes as the systems and methods extend beyond these limited embodiments. For example, it should be appreciated that those skilled in the art will, in light of the teachings of the present description, recognize a multiplicity of alternate and suitable approaches, depending upon the needs of the particular application, to implement the functionality of any given detail described herein, beyond the particular implementation choices in the following embodiments described and shown. That is, there are numerous modifications and variations that are too numerous to be listed but that all fit within the scope of the present description. Also, singular words should be read as plural and vice versa and masculine as feminine and vice versa, where appropriate, and alternative embodiments do not necessarily imply that the two are mutually exclusive.

It is to be further understood that the present description is not limited to the particular methodology, compounds, materials, manufacturing techniques, uses, and applications, described herein, as these may vary. It is also to be understood that the terminology used herein is used for the purpose of describing particular embodiments only, and is not intended to limit the scope of the present systems and methods. It must be noted that as used herein and in the appended claims (in this application, or any derived applications thereof), the singular forms "a," "an," and "the" include the plural reference unless the context clearly dictates otherwise. Thus, for example, a reference to "an element" is a reference to one or more elements and includes equivalents thereof known to those skilled in the art. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

Unless defined otherwise, all technical and scientific terms used herein have the same meanings as commonly understood by one of ordinary skill in the art to which this description belongs. Preferred methods, techniques, devices, and materials are described, although any methods, techniques, devices, or materials similar or equivalent to those described herein may be used in the practice or testing of the present systems and methods. Structures described herein are to be understood also to refer to functional equivalents of such structures. The present systems and methods will now be described in detail with reference to embodiments thereof as illustrated in the accompanying drawings.

From reading the present disclosure, other variations and modifications will be apparent to persons skilled in the art. Such variations and modifications may involve equivalent and other features which are already known in the art, and which may be used instead of or in addition to features already described herein.

Although Claims may be formulated in this Application or of any further Application derived therefrom, to particular combinations of features, it should be understood that the scope of the disclosure also includes any novel feature or any novel combination of features disclosed herein either explicitly or implicitly or any generalization thereof, whether or not it relates to the same systems or methods as presently claimed in any Claim and whether or not it mitigates any or all of the same technical problems as do the present systems and methods.

Features which are described in the context of separate embodiments may also be provided in combination in a single embodiment. Conversely, various features which are, for brevity, described in the context of a single embodiment, may also be provided separately or in any suitable sub-combination. The Applicants hereby give notice that new claims may be formulated to such features and/or combinations of such features during the prosecution of the present Application or of any further Application derived therefrom.

The invention claimed is:

1. A process for performing high temperature reactions, the process comprising:

introducing reactants into a reactor vessel;

generating a high temperature in a first region within the reactor vessel, wherein the high temperature is higher than a lower temperature of a wall of the reactor vessel, and wherein a temperature gradient is generated between the high temperature and the lower temperature of the wall;

exposing a first portion of the reactants to the high temperature;

reacting the first portion of the reactants based on contact with the high temperature to produce one or more products in a mixture, wherein a second portion of the reactants are not exposed to the high temperature, and wherein the second portion of the reactants do not react; and wherein:

generating the high temperature comprises using a heating element to generate the high temperature, the heating element comprises a porous tube, and the process further comprises:

heating the tube internally using an exothermic reaction, wherein the exothermic reaction comprises a combustion reaction and the heating of the tube comprises passing a third portion of the reactants through the tube;

contacting the third portion of the reactants with oxygen within the tube; and combusting the third portion of the reactants within the tube based on contacting the third portion of the reactants with the oxygen.

2. The process of claim 1, where the wall of the reactor vessel cannot maintain structural integrity at a pressure of the reacting mixture and the high temperature.

3. The process of claim 1, further comprising:

maintaining the lower temperature of the wall based on the second portion of the reactants not being heated to the high temperature because of the temperature gradient.

4. The process of claim 1, wherein the reactants comprise methane.

5. The process of claim 1, wherein the high temperature is 1,400° C. or greater.

6. The process of claim 1, wherein the products comprise solid carbon and hydrogen gas.

7. The process of claim 1, further comprising:

mixing the products and the second portion of the reactants to produce a mixed product stream, wherein the mixed product stream is at a temperature lower than the high temperature; and passing the mixed product stream out of the reactor vessel.

8. The process of claim 1, wherein the heating element is formed from silicon carbide, tungsten, tungsten carbide, molybdenum, molybdenum carbide, molybdenum silicide, tantalum, tantalum carbide, carbon, nickel, chromium, rhenium, or mixtures thereof.

9. The process of claim 1, wherein generating the high temperature comprises passing an electrical current through the heating element.

10. The process of claim 1, wherein generating the high temperature occurs within a heat shield, wherein the heat shield is positioned within the reactor vessel, and wherein the process further comprises:

shielding the wall of the reactor vessel from the high temperature using the heat shield.

11. The process of claim 10, wherein the first portion of the reactants passes through the heat shield to be exposed to the high temperature, wherein the second portion of the reactants passes around an exterior of the heat shield and is not exposed to the high temperature.

12. The process of claim 1, further comprising:

contacting an external surface of the wall with a coolant, and maintaining the lower temperature of the wall based on the contacting of the external surface of the wall with the coolant.

13. The process of claim 1, the reactor vessel comprising:

the wall;

an inner wall disposed within the reactor vessel, wherein an annular space is created within the reactor vessel between the wall and the inner wall;

a reaction zone defined within the inner wall; and the heating element disposed within the inner wall, wherein the heating element is configured to generate the high temperature within the reaction zone, wherein the annular space and the reaction zone are configured to pass a portion of the reactants through an inlet, through the annular space, through the reaction zone, and out an outlet.

14. The process of claim 13, wherein the heating element comprises a heating filament, and wherein the heating filament is formed from silicon carbide, tungsten, tungsten carbide, molybdenum, molybdenum carbide, molybdenum silicide, tantalum, tantalum carbide, carbon, nickel, chromium, rhenium, or mixtures thereof.

15. The process of claim 13, wherein the inner wall comprises a heat shield.

16. The process of claim 13, wherein the reactor vessel further comprises:

a cooling jacket disposed about the reactor vessel, wherein the cooling jacket defines a cooling annulus about the reactor vessel, wherein the cooling jacket is configured to pass a coolant in contact with an external surface of the reactor vessel to maintain a temperature of a wall of the reactor vessel lower than the reaction temperature.

17. The process of claim 1, wherein the reactants comprise a hydrocarbon and the reacting decomposes the hydrocarbon.

18. The process of claim 17, wherein the products comprise at least one of solid carbon or hydrogen.

19. The process of claim 1, further comprising generating the high temperature for a period of time using the heating element and switching off the heating element so that the wall is not exposed to the high temperature.

* * * * *